US005747214A

United States Patent [19]

Kato et al.

[11] Patent Number: 5,747,214

[45] Date of Patent: *May 5, 1998

[54] METHOD OF FORMING AN ELECTROPHOTOGRAPHIC COLOR TRANSFER IMAGE AND APPARATUS USED THEREFOR

[75] Inventors: Eiichi Kato; Yusuke Nakazawa; Sadao Osawa, all of Shizuoka, Japan

[73] Assignee: Fuji Photo Film Co., Ltd., Kanagawa, Japan

[ * ] Notice: The term of this patent shall not extend beyond the expiration date of Pat. No. 5,582,943.

[21] Appl. No.: 343,476

[22] PCT Filed: Mar. 25, 1994

[86] PCT No.: PCT/JP94/00487

§ 371 Date: Nov. 25, 1994

§ 102(e) Date: Nov. 25, 1994

[87] PCT Pub. No.: WO94/23345

PCT Pub. Date: Oct. 13, 1994

[30] Foreign Application Priority Data

Mar. 26, 1993 [JP] Japan ..... 5-090488
Mar. 30, 1993 [JP] Japan ..... 5-093832

[51] Int. Cl.[6] ..... G03G 13/14; G03G 13/01; G03G 15/16

[52] U.S. Cl. ..... 430/126; 430/47; 430/132; 156/277; 399/159; 399/298; 204/492; 204/499

[58] Field of Search ..... 430/46, 47, 126, 430/132; 355/210, 211, 212; 204/492–500; 156/277; 399/159, 298

[56] References Cited

U.S. PATENT DOCUMENTS 3,847,642 11/1974 Rhodes ..... 430/126
4,946,753 8/1990 Elmasry et al. ..... 430/45
5,176,974 1/1993 Till et al. ..... 430/126 X
5,342,720 8/1994 Zwadlo et al. ..... 430/132
5,378,575 1/1995 Rajan et al. ..... 430/126
5,395,721 3/1995 Kato et al. ..... 430/49
5,582,941 12/1996 Kato et al. ..... 430/47
5,582,943 12/1996 Kato et al. ..... 430/66
5,589,308 12/1996 Kato et al. ..... 430/49

FOREIGN PATENT DOCUMENTS 4833183 10/1973 Japan .
2176777 7/1990 Japan .

OTHER PUBLICATIONS

U.S. application 08/256,185 filed Jun. 27, 1994.

U.S. application 08/279,068 filed Jul. 22, 1994.

English Translation of JP 48–33183 Makino et al., Oct. 12, 1973.

*Primary Examiner*—Bernard P. Codd
*Attorney, Agent, or Firm*—Sughrue, Mion, Zinn, Macpeak & Seas, PLLC

[57] ABSTRACT

A method and apparatus for forming a color image is disclosed which provide simply and stably color duplicates of high accuracy and high quality without color shear and color images excellent in storage stability. A method of forming color images comprising applying a compound (S) which contains a fluorine atom and/or silicon atom to the surface of electrophotographic light-sensitive element, forming a peelable transfer layer on the surface of electrophotographic light-sensitive element, forming at least one color toner image by an electrophotographic process on the transfer layer and transferring the toner image together with the transfer layer to a receiving material and an apparatus used therefor are disclosed.

11 Claims, 6 Drawing Sheets

METHOD OF FORMING AN ELECTROPHOTOGRAPHIC COLOR TRANSFER IMAGE AND APPARATUS USED THEREFOR

This application is a 371 of PCT/JP94/00487 filed Mar. 25, 1994.

TECHNICAL FIELD

The present invention relates to a method of forming an electrophotographic color transfer image and an apparatus used therefor, and more particularly to a method of forming an electrophotographic color transfer image which forms color images free from color shear, by which toner images are completely transferred onto a receiving material without being accompanied by degradation of image quality upon the transfer and which provides color duplicates having good storage stability, and an apparatus used therefor.

TECHNICAL BACKGROUND

Methods of forming color printings, color duplicates or color proofs (proofs for printing) which comprises providing a plurality of overlapping color toner images directly on the surface of electrophotographic light-sensitive element using an electrophotographic development process and transferring at once the resulting color images onto a receiving material such as printing paper are known.

The developing methods include a so-called dry type developing method and wet type developing method. Color images obtained by the wet type developing method are preferred because of little color shear and good resolution as compared with those formed with dry toners. However, it is very difficult to directly transfer wet type toner images entirely from the surface of the light-sensitive element to a receiving material such as printing paper.

In order to solve this problem, a transfer technique in which a non-aqueous solvent is supplied between a light-sensitive element and a receiving material and then transfer is electrostatically performed is described in JP-A-2-272469 (the term "JP-A" as used herein means an "unexamined published Japanese patent application").

Also, a method in which a transparent film is first laminated on the surface of a light-sensitive element, wet type toner images are formed by an electrophotographic process on the film, and then the film bearing the toner images is separated from the light-sensitive element and stuck on paper, thereby forming transferred images is described in JP-A-2-115865 and JP-A-2-115866. According to the method, the film to be laminated has suitably a thickness of 9 μm. However, the production and handling of a film having such a thickness is very troublesome and it is necessary to arrange a special system for them.

Further, in JP-B-2-43185 (the term "JP-B" as used herein means an "examined Japanese patent publication"), a method in which imagewise exposure through a transparent electrophotographic light-sensitive element and development are conducted repeatedly to form over-lapping color separation images on a dielectric support releasably provided on the light-sensitive element and the dielectric support bearing the images is transferred to a receiving material, is described. Since the image-wise exposure is performed from the side of the substrate for the light-sensitive element according to this method, the substrate is required to be transparent. This is disadvantageous in view of cost.

On the other hand, an electrophotographic transfer method using a so-called dry type developing method in which a releasable transfer layer is provided on the surface of a light-sensitive element, toner images are formed on the transfer layer and the toner images are transferred together with the transfer layer to printing paper is described in JP-A-1-112264, JP-A-1-281464 and JP-A-3-11347.

However, in order to obtain good color images by a color image-forming method in which toner images are transferred together with the transfer layer to a printing paper various kinds of requirements must be satisfied.

First, it is important that the transfer layer be uniform in order to perform uniform charging and exposure to light and not degrade electrophotographic characteristics of an electrophotographic light-sensitive element since toner images are formed upon an electrophotographic process. Also, the transfer layer is desired to have good releasability from an electrophotographic light-sensitive element and good adhesion to a receiving material in order to conduct easy transfer in the transfer step. Particularly, an enlarged latitude of transfer conditions (for example, heating temperature, pressure and transportation speed) is required.

Moreover, it is desired that color duplicates obtained accept retouching and sealing without causing any trouble and have good storage stability, for example, in that the transfer layer is not peeled off when the color duplicates have been filed between various plastic sheets and piled up.

However, these characteristics have not been fully considered in the techniques hitherto known and image forming performance of color image, transferability of transfer layer and retouching property, sealing property and storage stability of color duplicate are not satisfactorily good.

Also, in order to employ the light-sensitive element repeatedly in the techniques hitherto known, a special operation is required at the time of transfer or difficulties in the formation of transfer layer are encountered. On the other hand, the method using a light-sensitive element having a transfer layer (or a releasable layer) previously formed thereon is disadvantageous in point of cost since the light-sensitive element used is inevitably thrown.

The present invention is to solve the above-described problems associated with conventional techniques.

An object of the present invention is to provide a method of forming an electrophotographic color transfer image which provides simply and stably color images of high accuracy and high quality without color shear, in which a transfer layer has good releasability from an electrophotographic light-sensitive element and good adhesion to a receiving material, a color duplicate formed by which method has good retouching property, sealing property and storage stability, and in which the transfer layer is easily provided.

Another object of the present invention is to provide an apparatus for forming an electrophotographic color transfer image which can be employed for the above-described method of forming an electrophotographic color transfer image, which provides color transferred images of stable performance after continuous operation for a long period of time, and which is suitable for reducing a running cost.

A further object of the present invention is to provide a method of forming a transfer layer which can easily provide a thin layer of a uniform thickness on an electrophotographic light-sensitive element and which is suitable for use in the method of forming an electrophotographic color transfer image.

DISCLOSURE OF THE INVENTION

It has been found that the above described objects of the present invention are accomplished by a method of forming an electrophotographic color transfer image comprising (i) a step of forming a peelable transfer layer on the surface of electrophotographic light-sensitive element, (ii) a step of forming at least one color toner image by an electrophotographic process on the transfer layer and (iii) a step of heat-transferring the toner image together with the transfer layer onto a receiving material, wherein prior to or simultaneously with the formation of transfer layer a compound (S) which contains a fluorine atom and/or silicon atom is applied to the surface of electrophotographic light-sensitive element to improve releasability of the surface of electrophotographic light-sensitive element.

It has also been found that they are accomplished by an apparatus for forming an electrophotographic color transfer image comprising (i) an electrophotographic light-sensitive element, (ii) a means for applying a compound (S) which contains a fluorine atom and/or silicon atom to the surface of electrophotographic light-sensitive element, (iii) a means for forming a peelable transfer layer on the surface of electrophotographic light-sensitive element, (iv) a means for forming a toner image by an electrophotographic process on the transfer layer and (v) a means for heat-transferring the toner image together with the transfer layer onto a receiving material, and wherein the electrophotographic light-sensitive element is repeatedly usable.

Specifically the method of forming an electrophotographic color transfer image according to the present invention is characterized in that the compound (S) containing a fluorine atom and/or silicon atom is applied to the surface of electrophotographic light-sensitive element prior to or simultaneously with the formation of transfer layer. By the action of compound (S) applied, the transfer layer becomes peelable and is released from the surface of electrophotographic light-sensitive element to be transferred on a receiving material.

According to the present invention, a means for applying the compound (S) and a means for forming the transfer layer can be provided individually in the apparatus for forming an electrophotographic color transfer image, or only one means effecting both functions can be provided therein.

The compound (S) containing a fluorine and/or silicon atom is not particularly limited in its structure as far as it can improve releasability of the surface of electrophotographic light-sensitive element, and includes a low molecular weight compound, an oligomer, and a polymer. The compound (S) which is soluble at least 0.01 g in one liter of an electrically insulating organic solvent having an electric resistance of not less than $10^8$ Ω·cm and a dielectric constant of not more than 3.5 is preferred.

When the compound (S) is an oligomer or a polymer, the moiety having a fluorine and/or silicon atom includes that incorporated into the main chain of the oligomer or polymer and that contained as a substituent in the side chain thereof.

The fluorine atom-containing moieties in the compound (S) which can be used in the present invention include monovalent or divalent organic residues, for example, $-C_hF_{2h+1}$ (wherein h represents an integer of from 1 to 22), $-(CF_2)_jCF_2H$ (wherein j represents an integer of from 1 to 17),

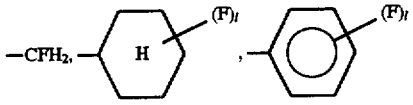

(wherein l represents an integer of from 1 to 5), $-CF_2-$, $-CFH-$,

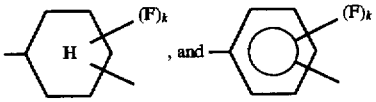

(wherein, k represents an integer of from 1 to 4).

The silicon atom-containing moieties include monovalent or divalent organic residues, for example,

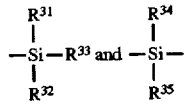

wherein $R^{31}$, $R^{32}$, $R^{33}$, $R^{34}$, and $R^{35}$, which may be the same or different, each represents a hydrocarbon group which may be substituted, $OR^{36}$,

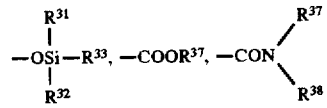

or $-SR^{37}$ (wherein $R^{36}$, $R^{37}$ and $R^{38}$, which may be the same or different, each represents a hydrocarbon group which may be substituted).

The hydrocarbon group represented by $R^{31}$, $R^{32}$, $R^{33}$, $R^{34}$, $R^{35}$, $R^{36}$, $R^{37}$ and $R^{38}$ include specifically an alkyl group having from 1 to 18 carbon atoms (e.g., methyl, ethyl, propyl, butyl, pentyl, hexyl, heptyl, octyl, nonyl, decyl, dodecyl, tridecyl, tetradecyl, hexadecyl, or octadecyl), an aralkyl group having from 7 to 14 carbon atoms (e.g., benzyl, phenethyl, 3-phenylpropyl, α-methylphenethyl, naphthylmethyl, or naphthylethyl), an alicyclic group having from 5 to 8 carbon atoms (e.g., cyclopentyl, cyclohexyl, cycloheptyl, cyclooctyl, adamantly, or cyclohexenyl), an aliphatic unsaturated group having from 2 to 18 carbon atoms (e.g., ethenyl, propenyl, butenyl, pentenyl, hexenyl, octenyl, propynyl, or butynyl), or an aromatic group having from 6 to 12 carbon atoms (e.g., phenyl, or naphthyl).

These hydrocarbon groups may have one or more substituents which are mono-valent organic moieties containing up to 20 atoms in total which may include a so-called hetero atom. Specific examples of the substituent include a hydroxy group, a carboxy group, a cyano group, a halogen atom (e.g., fluorine, chlorine, bromine, or iodine), a thiol group, a formyl group, a nitro group, a phosphono group, —OR', —COOR', —OCOR', —COR',

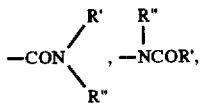

—NHCONHR', —NHCOOR', $-SO_2R'$ or —SR', wherein R' represents a hydrocarbon group as defined for $R^{31}$ or a heterocyclic group (e.g., thienyl, pyranyl, morpholines, pyridyl, piperidino, or imidazolyl), and R" represents a hydrogen atom or a hydrocarbon group as defined for $R^{31}$.

The fluorine atom and/or silicon atom-containing organic residue may be composed of a combination thereof. In such a case, they may be combined either directly or via a linking group. The linking groups include divalent organic residues, for example, divalent aliphatic groups, divalent aromatic groups, and combinations thereof, which may or may not contain a bonding group, e.g., —O—, —S—,

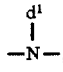

—SO—, —$SO_2$—, —COO—, —OCO—, —CONHCO—, —NHCONH—,

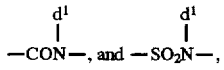

wherein $d^1$ has the same meaning as $R^{31}$ above.

Examples of the divalent aliphatic groups are shown below.

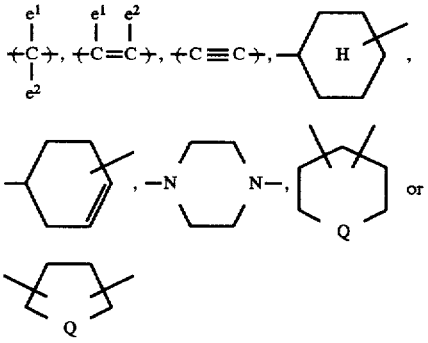

wherein $e^1$ and $e^2$, which may be the same or different, each represents a hydrogen atom, a halogen atom (e.g., chlorine or bromine) or an alkyl group having from 1 to 12 carbon atoms (e.g., methyl, ethyl, propyl, chloromethyl, bromomethyl, butyl, hexyl, octyl, nonyl or decyl); and Q represents —O—, —S—, or

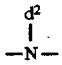

wherein $d^2$ represents an alkyl group having from 1 to 4 carbon atoms, —$CH_2Cl$, or —$CH_2Br$.

Examples of the divalent aromatic groups include a benzene ring, a naphthalene ring, and a 5- or 6-membered heterocyclic ring having at least one hetero atom selected from an oxygen atom, a sulfur atom and a nitrogen atom. The aromatic groups may have a substituent, for example, a halogen atom (e.g., fluorine, chlorine or bromine), an alkyl group having from 1 to 8 carbon atoms (e.g., methyl, ethyl, propyl, butyl, hexyl or octyl) or an alkoxy group having from 1 to 6 carbon atoms (e.g., methoxy, ethoxy, propoxy or butoxy). Examples of the heterocyclic ring include a furan ring, a thiophene ring, a pyridine ring, a piperazine ring, a tetrahydrofuran ring, a pyrrole ring, a tetrahydropyran ring, and a 1,3-oxazoline ring.

Specific examples of the compound (S) containing a fluorine and/or silicon atom which can be used in the present invention include fluorine and/or silicon-containing organic compounds described, for example, in Tokiyuki Yoshida, et al. (ed.), *Shin-ban Kaimenkasseizai Handbook*, Kogaku Tosho (1987), Takao Karikome, *Saishin Kaimenkasseizai Oyo Gijutsu*, C.M.C. (1990), Kunio Ito (ed.), *Silicone Handbook*, Nikkan Kogyo Shinbunsha (1990), Takao Karikome, *Tokushukino Kaimenkasseizai*, C.M.C. (1986), and A. M. Schwartz, et al., *Surface Active Agents and Detergents*, Vol. II.

Further, the compound (S) according to the present invention can be synthesized by utilizing synthesis methods as described, for example, in Nobuo Ishikawa, *Fussokagobutsu no Gosei to Kino*, C.M.C. (1987), Jiro Hirano et al. (ed.), *Ganfussoyukikagobutsu— Sono Gosei to Oyo*, Gijutsu Joho Kokai (1991), and Mitsuo Ishikawa, *Yukikeiso Senryaku Shiryo*, Chapter 3, Science Forum (1991).

Specific examples of components having the fluorine atom and/or silicon atom-containing moiety used in the oligomer or polymer as described above are set forth below, but the present invention should not be construed as being limited thereto. In formulae (F-1) to (F-32) below, Rf represents any one of the following groups of from (1) to (11); b represents a hydrogen atom, a methyl group or a trifluoromethyl group; p represents an integer of from 1 to 12; q represents an integer of from 1 to 20; r represents an integer of from 3 to 6; and $R^{41}$, $R^{42}$ and $R^{43}$ each represents an alkyl group having from 1 to 12 carbon atoms.

$-C_nF_{2n+1}$ (1)

$-CH_2C_nF_{2n+1}$ (2)

$-CH_2CH_2C_nF_{2n+1}$ (3)

$-CH_2(CF_2)_mCFHCF_3$ (4)

$-CH_2CH_2(CF_2)_mCFHCF_3$ (5)

$-CH_2CH_2(CF_2)_mCFHCF_2H$ (6)

$-CH_2(CF_2)_mCFHCF_2H$ (7)

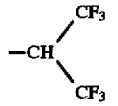

(8)

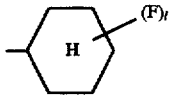

(9)

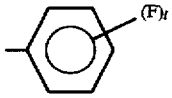

(10)

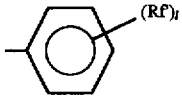

(11)

wherein Rf' represents any one of the above-described groups of from (1) to (8); n represents an integer of from 1 to 18; m represents an integer of from 1 to 18; and t represents an integer of from 1 to 5.

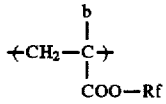

(F-1)

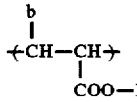

(F-2)

-continued
(F-3)
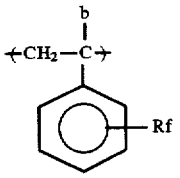
(F-4)
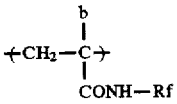
(F-5)
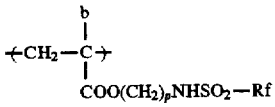
(F-6)
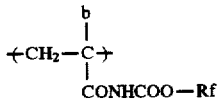
(F-7)
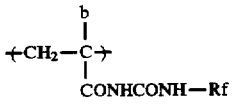
(F-8)
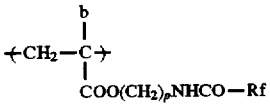
(F-9)
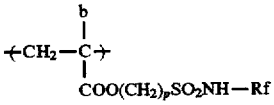
(F-10)
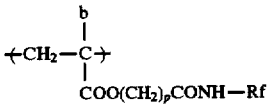
(F-11)
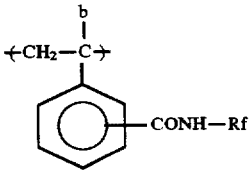
(F-12)
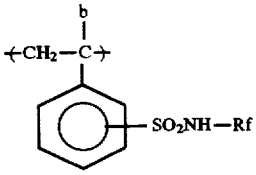
(F-13)
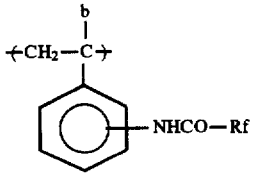
-continued
(F-14)
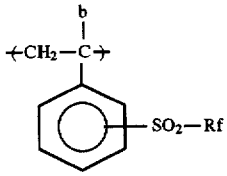
(F-15)
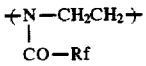
(F-16)
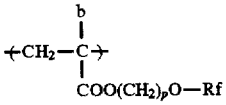
(F-17)
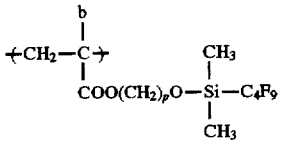
(F-18)
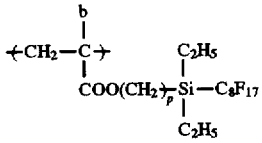
(F-19)
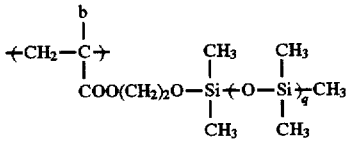
(F-20)
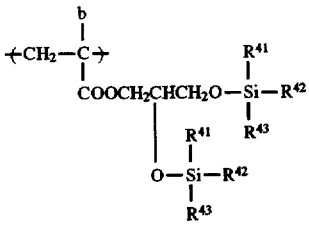
(F-21)
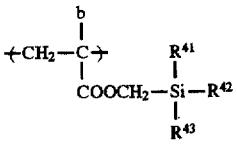
(F-22)
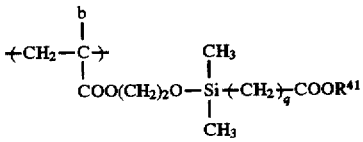
(F-23)
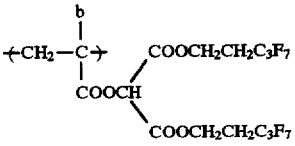

-continued

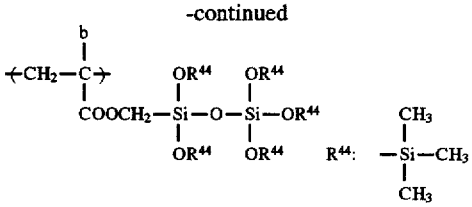
(F-24)

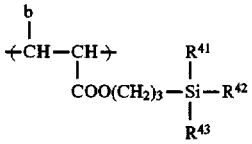
(F-25)

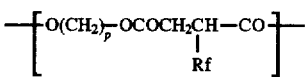
(F-26)

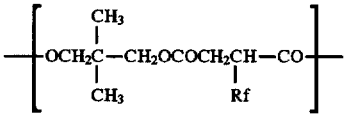
(F-27)

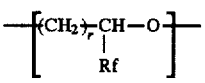
(F-28)

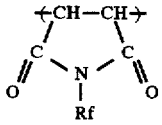
(F-29)

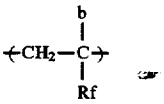
(F-30)

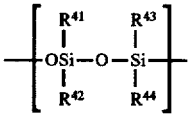
(F-31)

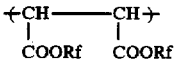
(F-32)

Of the oligomers and polymers of compounds (S) according to the present invention, those containing repeating units containing the moiety having a fluorine and/or silicon atom as a block are preferred since they effectively exhibit adsorbability onto the surface of electrophotographic light-sensitive element and releasability of the transfer layer. These so-called block copolymers may be any type of copolymer as far as it contains the fluorine atom and/or silicon atom-containing components as a block. The term "to be contained as a block" means that the copolymer has a polymer segment comprising at least 70% by weight, preferably at least 80% by weight, of the fluorine atom and/or silicon atom-containing component based on the weight of the polymer segment (Segment (A)) and a polymer segment comprising at most 20% by weight, preferably none, of the fluorine atom and/or silicon atom-containing component based on the weight of the polymer segment (Segment (B)). The forms of blocks include an A-B type block, an A-B-A type block, a B-A-B type block, a graft type block, and a starlike type block as schematically illustrated below.

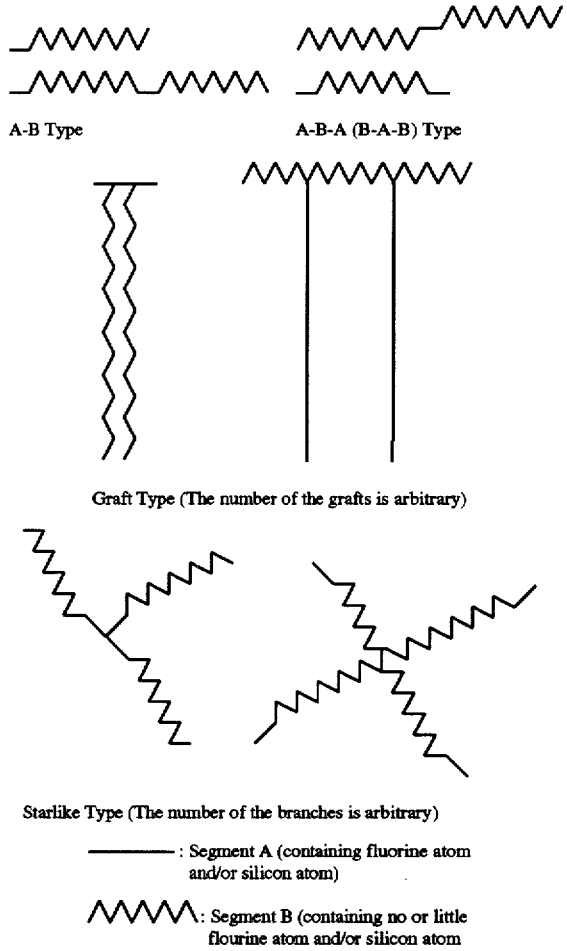

These various types of block copolymers of the compound (S) can be synthesized in accordance with conventionally known polymerization methods. In general, methods as described, e.g., in W. J. Burlant and A. S. Hoffman, *Block and Graft Polymers*, Reuhold (1986), R. J. Cevesa, *Block and Graft Copolymers*, Butterworths (1962), D. C. Allport and W. E. James, *Block Copolymers*, Applied Sci. (1972), A. Noshay and J. E. McGrath, *Block Copolymers*, Academic Press (1977), G. Huvtreg, D. J. Wilson, and G. Riess, *NATO ASIser. SerE.*, Vol. 1985, p. 149, and V. Perces, *Applied Polymer Sci.*, Vol. 285, p. 95 (1985) can be employed.

Specifically, ion polymerization reactions using an organometallic compound (e.g., an alkyl lithium, lithium diisopropylamide, an alkali metal alcoholate, an alkylmagnesium halide, or an alkylaluminum halide) as a polymerization initiator are described, for example, in T. E. Hogeu-Esch and J. Smid, *Recent Advances in Anion Polymerization*, Elsevier (New York) (1987), Yoshio Okamoto, *Kobunshi*, Vol. 38, p. 912 (1989), Mitsuo Sawamoto, *Kobunshi*, Vol. 38, p. 1018 (1989), Tadashi Narita, *Kobunshi*, Vol. 37, p. 252 (1988), B. C. Anderson, et al., *Macromolecules*, Vol. 14, p. 1601 (1981), and S. Aoshima and T. Higashimura, *Macromolecules*, Vol. 22, p. 1009 (1989).

Ion polymerization reactions using a hydrogen iodide/iodine system are described, for example, in T. Higashimura, et al., *Macromol. Chem., Macromol. Symp.*, Vol. 13/14, p. 457 (1988), and Toshinobu Higashimura and Mitsuo Sawamoto, *Kobunshi Ronbunshu*, Vol. 46, p. 189 (1989).

Group transfer polymerization reactions are described, for example, in D. Y. Sogah, et al., *Macromolecules*, Vol. 20, p. 1473 (1987), O. W. Webster and D. Y. Sogah, *Kobunshi*, Vol. 36, p. 808 (1987), M. T. Reetg, et al., *Angew. Chem. Int. Ed. Engl.*, Vol. 25, p. 9108 (1986), and JP-A-63-97609.

Living polymerization reactions using a metalloporphyrin complex are described, for example, in T. Yasuda, T. Aida, and S. Inoue, *Macromolecules*, Vol. 17, p. 2217 (1984), M. Kuroki, T. Aida, and S. Inoue, *J. Am. Chem. Soc.*, Vol. 109, p. 4737 (1987), M. Kuroki, et al., *Macromolecules*, Vol. 21, p. 3115 (1988), and M. Kuroki and I. Inoue, *Yuki Gosei Kagaku*, Vol. 47, p. 1017 (1989).

Ring-opening polymerization reactions of cyclic compounds are described, for example, in S. Kobayashi and T. Saegusa, *Ring Opening Polymerization*, Applied Science Publishers Ltd. (1984), W. Seeliger, et al., *Angew. Chem. Int. Ed. Engl.*, Vol. 5, p. 875 (1966), S. Kobayashi, et al., *Poly. Bull.*, Vol. 13, p. 447 (1985), and Y. Chujo, et al., *Macromolecules*, Vol. 22, p. 1074 (1989).

Photo living polymerization reactions using a dithiocarbamate compound or a xanthate compound, as an initiator are described, for example, in Takayuki Otsu, *Kobunshi*, Vol. 37, p. 248 (1988), Shun-ichi Himori and Koichi Otsu, *Polymer Rep. Jap.*, Vol. 37, p. 3508 (1988), JP-A-64-111, JP-A-64-26619, and M. Niwa, *Macromolecules*, Vol. 189, p. 2187 (1988).

Radical polymerization reactions using a polymer containing an azo group or a peroxide group as an initiator to synthesize block copolymers are described, for example, in Akira Ueda, et al., *Kobunshi Ronbunshu*, Vol. 33, p. 931 (1976), Akira Ueda, *Osaka Shiritsu Kogyo Kenkyusho Hokoku*, Vol. 84 (1989), O. Nuyken, et al., *Macromol. Chem., Rapid. Commun.*, Vol. 9, p. 671 (1988), and Ryohei Oda, *Kagaku to Kogyo*, Vol. 61, p. 43 (1987).

Syntheses of graft type block copolymers are described in the above-cited literature references and, in addition, Fumio Ide, *Graft Jugo to Sono Oyo*, Kobunshi Kankokai (1977), and Kobunshi Gakkai (ed.), *Polymer Alloy*, Tokyo Kagaku Dojin (1981). For example, known grafting techniques including a method of grafting of a polymer chain by a polymerization initiator, an actinic ray (e.g., radiant ray, electron beam), or a mechanochemical reaction; a method of grafting with chemical bonding between functional groups of polymer chains (reaction between polymers); and a method of grafting comprising a polymerization reaction of a macromonomer may be employed.

The methods of grafting using a polymer are described, for example, in T. Shiota, et al., *J. Appl. Polym. Sci.*, Vol. 13, p. 2447 (1969), W. H. Buck, *Rubber Chemistry and Technology*, Vol. 50, p. 109 (1976), Tsuyoshi Endo and Tsutomu Uezawa, *Nippon Secchaku Kyokaishi*, Vol. 24, p. 323 (1988), and Tsuyoshi Endo, *ibid.*, Vol. 25, p. 409 (1989).

The methods of grafting using a macromonomer are described, for example, in P. Dreyfuss and R. P. Quirk, *Encycl. Polym. Sci. Eng.*, Vol. 7, p. 551 (1987), P. F. Rempp and E. Franta, *Adv. Polym. Sci.*, Vol. 58, p. 1 (1984), V. Percec, *Appl. Poly. Sci.*, Vol. 285, p. 95 (1984), R. Asami and M. Takari, *Macromol. Chem. Suppl.*, Vol. 12, p. 163 (1985), P. Rempp, et al., *Macromol. Chem. Suppl.*, Vol. 8, p. 3 (1985), Katsusuke Kawakami, *Kagaku Kogyo*, Vol. 38, p. 56 (1987), Yuya Yamashita, *Kobunshi*, Vol. 31, p. 988 (1982), Shiro Kobayashi, *Kobunshi*, Vol. 30, p. 625 (1981), Toshinobu Higashimura, *Nippon Secchaku Kyokaishi*, Vol. 18, p. 536 (1982), Koichi Itoh, *Kobunshi Kako*, Vol. 35, p. 262 (1986), Takashiro Azuma and Takashi Tsuda, *Kino Zairyo*, Vol. 1987, No. 10, p. 5, Yuya Yamashita (ed.), *Macromonomer no Kagaku to Kogyo*, I.P.C. (1989), Tsuyoshi Endo (ed.), *Atarashii Kinosei Kobunshi no Bunshi Sekkei*, Ch. 4, C.M.C. (1991), and Y. Yamashita, et al., *Polym. Bull.*, Vol. 5, p. 361 (1981).

Syntheses of starlike block copolymers are described, for example, in M. T. Reetz, *Angew. Chem. Int. Ed. Engl.*, Vol. 27, p. 1373 (1988); M. Sgwarc, *Carbanions, Living Polymers and Electron Transfer Processes*, Wiley (New York) (1968), B. Gordon, et al., *Polym. Bull.*, Vol. 11, p. 349 (1984), R. B. Bates, et al., *J. Org. Chem.*, Vol. 44, p. 3800 (1979), Y. Sogah, *A.C.S. Polym. Rapr.*, Vol. 1988, No. 2, p. 3, J. W. Mays, *Polym. Bull.*, Vol. 23, p. 247 (1990), I. M. Khan et al., *Macromolecules*, Vol. 21, p. 2684 (1988), A. Morikawa, *Macromolecules*, Vol. 24, p. 3469 (1991), Akira Ueda and Toru Nagai, *Kobunshi*, Vol. 39, p. 202 (1990), and T. Otsu, *Polymer Bull.*, Vol. 11, p. 135 (1984).

Now, the transfer layer which can be used in the present invention will be described in greater detail below.

The transfer layer of the present invention is radiation-transmittive. Specifically, it is a layer capable of transmitting a radiation having a wavelength which constitutes at least one part of the spectrally sensitive region of electrophotographic light-sensitive element. The layer may be colored. In a case wherein duplicated images transferred onto a receiving material are color images, particularly full-color images, a colorless and transparent transfer layer is ordinarily employed.

The transfer layer is preferred to be transferred under conditions of temperature of not more than 180° C. and/or pressure of not more than 30 Kgf/cm$^2$, more preferably under conditions of temperature of not more than 160° C. and/or pressure of not more than 20 Kgf/cm$^2$. When the transfer conditions exceed the above-described limit, a large-sized apparatus may be necessary in order to maintain the heat capacity and pressure sufficient for release of the transfer layer from the surface of electrophotographic light-sensitive element and transfer to a receiving material, and a transfer speed becomes very slow. The lower limit of transfer conditions is preferably not less than room temperature and/or pressure of not less than 0.1 Kgf/cm$^2$.

The transfer layer according to the present invention is mainly composed of a thermoplastic resin (hereinafter referred to as a resin (A) sometimes). The resins (A) include resins conventionally known as thermoplastic resins, adhesives or sticks. Suitable examples thereof include olefin polymers or copolymers, vinyl chloride copolymers, vinylidene chloride copolymers, vinyl alkanate polymers or copolymers, ally alkanate polymers or copolymers, polymers or copolymers of styrene or derivatives thereof, olefin-styrene copolymers, olefin-unsaturated carboxylic ester copolymers, acrylonitrile copolymers, methacrylonitrile copolymers, alkyl vinyl ether copolymers, acrylic ester polymers or copolymers, methacrylic ester polymers or copolymers, styrene-acrylic ester copolymers, styrene-methacrylic ester copolymers, itaconic diester polymers or copolymers, maleic anhydride copolymers, acrylamide copolymers, methacrylamide copolymers, hydroxy-modified silicone resins, polycarbonate resins, ketone resins, polyester resins, silicone resins, amide resins, hydroxy- or carboxy-modified polyester resins, butyral resins, polyvinyl acetal resins, cyclized rubber-methacrylic ester copolymers, cyclized rubber-acrylic ester copolymers, copolymers containing a heterocyclic ring (the heterocyclic ring including furan, tetrahydrofuran, thiophene, dioxane, dioxofuran, lactone, benzofuran, benzothiophene and 1,3-dioxethane rings), cellulose resins, fatty acid-modified cellulose resins, and epoxy resins.

Further, specific examples of usable resins are described, e.g., in *Plastic Zairyo Koza Series*, Vols. 1 to 18, Nikkan Kogyo Shinbunsha (1981), Kinki Kagaku Kyokai Vinyl Bukai (ed.), *Polyenka Vinyl*, Nikkan Kogyo Shinbunsha (1988), Eizo Omori, *Kinosei Acryl Jushi*, Techno System (1985), Ei-ichiro Takiyama, *Polyester Jushi Handbook*, Nikkan Kogyo Shinbunsha (1988), Kazuo Yuki., *Howa Polyester Jushi Handbook*, Nikkan Kogyo Shinbunsha (1989), Kobunshi Gakkai (ed.), *Kobunshi Data Handbook (Oyohen)*, Ch. 1, Baifukan (1986), Yuji Harasaki (ed.), *Saishin Binder Gijutsu Binran*, Ch. 2, Sogo Gijutsu Center (1985), Taira Okuda (ed.), *Kobunshi Kako*, Vol. 20, Supplement "Nenchaku", Kobunshi Kankokai (1976), Keizi Fukuzawa, *Nenchaku Gijutsu*, Kobunshi Kankokai (1987), Mamoru Nishiguchi, *Secchaku Binran*, 14th Ed., Kobunshi Kankokai (1985), and Nippon Secchaku Kokai (ed.), *Secchaku Handbook*, 2nd Ed., Nikkan Kogyo Shinbunsha (1980).

The resin (A) may be used either individually or in combination of two or more thereof. The resin (A) is preferably used in a range of not less than 70% by weight, more preferably not less than 90% by weight, based on the total amount of composition for the transfer layer.

With respect to the thermal property, the resin (A) has preferably a glass transition point of not more than 140° C. or a softening point of not more than 180° C., and more preferably a glass transition point of not more than 100° C. or a softening point of not more than 150° C.

According to a preferred embodiment of the present invention, the transfer layer is composed of at least two resins (A) having a glass transition point or a softening point different from each other. By using such a combination of the resins (A), transferability of the transfer layer is further improved.

Specifically, the transfer layer mainly contains a resin having a glass transition point of from 30° C. to 140° C. or a softening point of from 35° C. to 180° C. (hereinafter referred to as a resin (AH) sometimes) and a resin having a glass transition point of from −30° C. to 40° C. or a softening point of from 0° C. to 45° C. (hereinafter referred to as a resin (AL) sometimes) in which a difference in the glass transition point or softening point between the resin (AH) and the resin (AL) is at least 2° C.

Further, the resin (AH) has a glass transition point of preferably from 30° C. to 120° C., and more preferably from 35° C. to 90° C., or a softening point of preferably from 38° C. to 160° C., and more preferably from 40° C. to 120° C., and on the other hand, the thermoplastic resin (AL) has a glass transition point of preferably from −25° C. to 38° C., and more preferably from −20° C. to 33° C., or a softening point of preferably from 5° C. to 40° C., and more preferably from 10° C. to 35° C. The difference in the glass transition point or softening point between the resin (AH) and the resin (AL) used is preferably at least 5° C. The difference in the glass transition point or softening point between the resin (AH) and the resin (AL) means a difference between the lowest glass transition point or softening point of those of the resins (AH) and the highest glass transition point or softening point of those of the resins (AL) when two or more of the resins (AH) and/or resins (AL) are employed.

A weight ratio of the resin (AH)/the resin (AL) used in the transfer layer is preferably from 5/95 to 90/10, more preferably from 10/90 to 70/30. In the range of the ratio of resin (AH)/resin (AL) described above, further improved transferability of the transfer layer onto a receiving material can be achieved.

In accordance with a more preferred embodiment, the transfer layer of the present invention has a layered structure composed of a first layer which is contact with the surface of the electrophotographic light-sensitive element and which comprises a resin (AH) having a relatively high glass transition point or softening point and a second layer provided thereon comprising a resin (AL) having a relatively low glass transition point or softening point. By introducing such a configuration of the transfer layer, transferability of the transfer layer to a receiving material is remarkably improved, a further enlarged latitude of transfer conditions (e.g., heating temperature, pressure, and transportation speed) can be achieved, and the transfer can be easily performed irrespective of the kind of receiving material which forms a color duplicate. Moreover, since the surface of the transfer layer transferred onto a receiving material is composed of the resin (AH) having a high glass transition point or softening point, the color duplicate obtained has the good filing property, and the retouching property and sealing property similar to those of plane paper may be imparted to the resulting color duplicate by appropriately selecting the resin (AH).

The resin (A) used in the transfer layer according to the present invention may contain a component containing a moiety having a fluorine atom and/or silicon atom which is effective to increase the peelability of the transfer layer itself as a polymer component. The moiety having a fluorine atom and/or silicon atom contained in the resin (A) includes that incorporated into the main chain of the polymer and that contained as a substituent in the side chain of the polymer. The components containing a moiety having a fluorine atom and/or silicon atom are preferably present as a block in the resin (A).

The content of component containing a moiety having a fluorine atom and/or silicon atom is preferably from 3 to 40 parts by weight, more preferably from 5 to 25 parts by weight per 100 parts by weight of the resin (A).

The component containing a moiety having a fluorine atom and/or silicon atom may be incorporated into any of the resin (AH) and the resin (AL), when at least two resins (A) having a glass transition point or a softening point different from each other are employed in combination. More effectively, the component is incorporated into the resin (AH). Using such a resin, releasability of the transfer layer from the surface of electrophotographic light-sensitive element is increased and as a result, the transferability is improved.

With respect to the moieties having a fluorine atom and/or silicon atom, the polymer components containing the moiety, the block copolymers and the synthesis methods thereof, reference can be made to those described for the compound (S) described above.

If desired, the transfer layer may contain various additives for improving physical characteristics, such as adhesion, film-forming property, and film strength. For example, rosin, petroleum resin, or silicone oil may be added for controlling adhesion; polybutene, DOP, DBP, low-molecular weight styrene resins, low molecular weight polyethylene wax, micro-crystalline wax, or paraffin wax, as a plasticizer or a softening agent for improving wetting property to the light-sensitive element or decreasing melting viscosity; and a polymeric hindered polyvalent phenol, or a triazine derivative, as an antioxidant. For the details, reference can be made to Hiroshi Fukada, *Hot-melt Secchaku no Jissai*, pp. 29 to 107, Kobunshi Kankokai (1983).

The transfer layer suitably has a thickness of from 0.1 to 20 μm, and preferably from 0.5 to 10 μm. If the transfer layer is too thin, it is liable to result in insufficient transfer, and if the layer is too thick, troubles on the electrophotographic process tend to occur, failing to obtain a sufficient image density or resulting in degradation of image quality.

The transfer layer according to the present invention has many advantages in that it does not adversely affect electrophotographic characteristics (such as chargeability, dark charge retention rate, and photosensitivity) until a toner image is formed by an electrophotographic process, thereby forming a good duplicated image, in that it has ability for easy transfer to a receiving material irrespective of the kind of receiving material in a transfer process, and in that it accepts retouching and sealing without any trouble and has good storage stability in a color duplicate obtained, for example, the transfer layer being not peeled off when the color duplicate having been filed between various plastic sheets and piled up.

As described above, the method of forming an image according to the present invention is characterized by applying the compound (S) onto the surface of electrophotographic light-sensitive element before or at the same time as the formation of transfer layer. Specifically, the compound (S) is at first applied to the surface of light-sensitive material and then the transfer layer is formed thereon, or the application of compound (S) is simultaneously conducted with the formation of transfer layer. The term "application of the compound (S) onto the surface of electrophotographic light-sensitive element" means that the compound is supplied on the surface of electrophotographic light-sensitive element to form a state wherein the compound (S) is adsorbed or adhered thereon. By the application of compound (S), the surface of electrophotographic light-sensitive element is modified to have good releasability.

In order to apply the compound (S) to the surface of electrophotographic light-sensitive element, conventionally known various methods can be employed. For example, methods using an air doctor coater, a blade coater, a knife coater, a squeeze coater, a dip coater, a reverse roll coater, a transfer roll coater, a gravure coater, a kiss roll coater, a spray coater, a curtain coater, or a calender coater as described, for example, in Yuji Harasaki, *Coating Kogaku*, Asakura Shoten (1971), Yuji Harasaki, *Coating Hoshiki*, Maki Shoten (1979), and Hiroshi Fukada, *Hot-melt Secchaku no Jissai* Kobunshi Kankokai (1979) can be used.

A method wherein cloth, paper or felt impregnated with the compound (S) is pressed on the surface of light-sensitive element, a method of pressing a curable resin impregnated with the compound (S), a method wherein the light-sensitive element is wetted with a non-aqueous solvent containing the compound (S) dissolved therein, and then dried to remove the solvent, and a method wherein the compound (S) dispersed in a non-aqueous solvent is migrated and adhered on the surface of light-sensitive element due to electrophoresis according to a wet-type electrodeposition method as described hereinafter can also be employed.

Further, the compound (S) can be applied on the surface of light-sensitive element by utilizing a non-aqueous solvent containing the compound (S) according to an ink jet method, followed by drying. The ink jet method can be performed with reference to the descriptions in Shin Ohno (ed.), *Non-impact Printing*, C.M.C. (1986). More specifically, a Sweet process or Hartz process of a continuous jet type, a Winston process of an intermittent jet type, a pulse jet process or bubble jet process of an ink on-demand type, and a mist process of an ink mist type are illustrated. In any system, the compound (S) itself or diluted with a solvent is filled in an ink tank or ink head cartridge in place of an ink to use. The solution of compound (S) used ordinarily has a viscosity of from 1 to 10 cp and a surface tension of from 30 to 60 dyne/cm, and may contain a surface active agent, or may be heated if desired. Although a diameter of ink droplet is in a range of from 30 to 100 μm due to a diameter of an orifice of head in a conventional ink jet printer in order to reproduce fine letters, droplets of a larger diameter can also be used in the present invention. In such a case, an amount of jet of the compound (S) becomes large and thus a time necessary for the application can be shortened. Further, to use multiple nozzles is very effective to shorten the time for application.

Silicone rubber is used as the compound (S). It is preferred that silicone rubber is provided on a metal axis to cover and the resulting silicone rubber roller is directly pressed on the surface of electrophotographic light-sensitive element. In such a case, a nip pressure is ordinarily in a range of from 0.5 to 10 Kgf/cm$^2$ and a time for contact is ordinarily in a range of from 1 second to 30 minutes. Also, the light-sensitive element and/or silicone rubber roller may be heated up to a temperature of 150° C. According to this method, it is believed that a part of low molecular weight components contained in silicone rubber is moved from the silicone rubber roller onto the surface of light-sensitive element during the press. The silicone rubber may be swollen with silicone oil. Moreover, the silicone rubber may be a form of sponge and the sponge roller may be impregnated with silicone oil or a solution of silicone surface active agent.

The application method of the compound (S) is not particularly limited, and an appropriate method can be selected depending on a state (i.e., liquid, wax or solid) of the compound (S) used. A flowability of the compound (S) can be controller using a heat medium, if desired.

The application of compound (S) is preferably performed by a means which is easily incorporated into the electrophotographic color transfer image-forming apparatus according to the present invention.

An amount of the compound (S) applied to the surface of electrophotographic light-sensitive element is adjusted in a range wherein the electrophotographic characteristics of light-sensitive element do not adversely affected in substance. Ordinarily, a thickness of the coating is sufficiently 1 μm or less. By the formation of weak boundary layer as defined in Bikerman, *The Science of Adhesive Joints*, Academic Press (1961), the releasability-imparting effect of the present invention can be obtained. Specifically, when an adhesive strength of the surface of an electrophotographic light-sensitive element to which the compound (S) has been applied is measured according to JIS Z 0237-1980 "Testing methods of pressure sensitive adhesive tapes and sheets", the resulting adhesive strength is desirably not more than 100 gram·force, more desirably not more than 50 gram·force. When the adhesive strength exceeds 100 gram·force, transfer of the transfer layer from the surface of light-sensitive element may not be conducted completely in the range of condition for transfer described hereinafter, resulting in peeling off or breaking of the transfer layer in some case.

The measurement of adhesive strength is conducted according to JIS Z 0237-1980 8.3.1. 180 *Degrees Peeling Method* with the following modifications:

(1) As a test plate, an electrophotographic light-sensitive element, on the surface of which a transfer layer is to be provided is used.

(2) As a test piece, a pressure sensitive adhesive tape of 6 mm in width prepared according to JIS C 2338-1984 is used.

(3) A peeling rate is 120 mm/min using a constant rate of traverse type tensile testing machine.

Specifically, the test piece is laid its adhesive face downward on the test plate and a roller is reciprocate one stroke at a rate of approximately 300 mm/min upon the test piece for pressure sticking. Within 20 to 40 minutes after the sticking with pressure, a part of the stuck portion is peeled approximately 25 mm in length and then peeled continuously at the rate of 120 mm/min using the constant rate of traverse type tensile testing machine. The strength is read at an interval of approximately 20 mm in length of peeling, and eventually read 4 times. The test is conducted on three test pieces. The mean value is determined from 12 measured values for three test pieces and the resulting mean value is converted in terms of 10 mm in width.

In a case wherein the application of compound (S) is simultaneously conducted with the formation of transfer layer, since a pressure sensitive adhesive tape which is a test piece can not be directly brought into contact with the surface of electrophotographic light-sensitive element to be measured, an adhesive strength between the electrophotographic light-sensitive element and the transfer layer is measured in the same manner as above using the electrophotographic light-sensitive element having the transfer layer formed thereon and the resulting value is adopted as the adhesive strength of the surface of electrophotographic light-sensitive element.

In accordance with the present invention, the surface of electrophotographic light-sensitive element is provided with appropriate releasability by the application of compound (S), and the light-sensitive element can be repeatedly employed as far as the releasability is maintained. Specifically, the application of compound (S) is not always necessarily whenever a series of steps comprising the formation of transfer layer, formation of image and transfer of the transfer layer onto a receiving material is repeated.

In order to form the transfer layer on the electrophotographic light-sensitive element in the present invention, conventional layer-forming methods can be employed. For instance, a solution or dispersion containing the composition for the transfer layer is applied onto the surface of light-sensitive element in a known manner. In particular, for the formation of transfer layer on the surface of light-sensitive element, a hot-melt coating method, electrodeposition coating method or transfer method is preferably used. These methods are preferred in view of easy formation of the transfer layer on the surface of light-sensitive element in an electrophotographic apparatus. Each of these methods will be described in greater detail below.

The hot-melt coating method comprises hot-melt coating of the composition for the transfer layer by a known method. For such a purpose, a mechanism of a non-solvent type coating machine, for example, a hot-melt coating apparatus for a hot-melt adhesive (hot-melt coater) as described in the above-mentioned *Hot-melt Secchaku no Jissai*, pp. 197 to 215 can be utilized with modification to suit with coating onto the light-sensitive drum. Suitable examples of coating machines include a direct roll coater, an offset gravure roll coater, a rod coater, an extrusion coater, a slot orifice coater, and a curtain coater.

A melting temperature of the resin at coating is usually in a range of from 50° to 180° C., while the optimum temperature is determined depending on the composition of the resin to be used. It is preferred that the resin is first molten using a closed pre-heating device having an automatic temperature controlling means and then heated in a short time to the desired temperature in a position to be coated on the light-sensitive element. To do so can prevent from degradation of the resin upon thermal oxidation and unevenness in coating.

A coating speed may be varied depending on flowability of the resin at the time of being molten by heating, a kind of coater, and a coating amount, etc., but is suitably in a range of from 1 to 100 mm/sec, preferably from 5 to 40 mm/sec.

Now, the electrodeposition coating method will be described below. According to this method, the resin is electrostatically adhered or electrodeposited (hereinafter simply referred to as electrodeposition sometimes) on the surface of light-sensitive element in the form of resin grains and then transformed into a uniform thin film, for example, by heating, thereby the transfer layer being formed.

The resin grains forming the transfer layer must have either a positive charge or a negative charge. The electroscopicity of the resin grains is appropriately determined depending on a charging property of the electrophotographic light-sensitive element to be used in combination.

The resin grains contain at least one of the resins (A) and may further contain one or more other thermoplastic resins. For instance, in case of using the combination of resins whose glass transition points or softening points are different at least 2° C. from each other as described above, improvement in transferability of the transfer layer and an enlarged latitude of transfer conditions can be achieved. In such a case, these resins may be present as a mixture in the grains or may form a layered structure such as a core/shell structure wherein a core part and a shell part are composed of different resins respectively.

An average grain diameter of the resin grains having the physical property described above is generally in a range of from 0.01 to 15 μm, preferably from 0.05 to 5 μm and more preferably from 0.1 to 2 μm. The resin grains may be employed as powder grains (in case of dry type electrodeposition) or grains dispersed in a non-aqueous system (in case of wet type electrodeposition). The resin grains dispersed in a non-aqueous system are preferred since they can easily prepare a thin layer of uniform thickness.

The resin grains used in the present invention can be produced by a conventionally known mechanical powdering method or polymerization granulation method. These methods can be applied to the production of resin grains for both of dry type electrodeposition and wet type electrodeposition.

The mechanical powdering method for producing powder grains used in the dry type electrodeposition method includes a method wherein the thermoplastic resin is directly powdered by a conventionally known pulverizer to form fine grains (for example, a method using a ball mill, a paint shaker or a jet mill). If desired, mixing, melting and kneading of the materials for resin grains before the powdering and classification for a purpose of controlling a grain diameter and after-treatment for treating the surface of grain after the powdering may be performed in an appropriate combination. A spray dry method is also employed.

Specifically, the powder grains can be easily produced by appropriately using a method as described in detail, for example, in Shadanhojin Nippon Funtai Kogyo Gijutsu Kyokai (ed.), *Zoryu Handbook*, II ed., Ohm Sha (1991), Kanagawa Keiei Kaihatsu Center, *Saishin Zoryu Gijutsu no Jissai*, Kanagawa Keiei Kaihatsu Center Shuppan-bu (1984), and Masafumi Arakawa et al (ed.), *Saishin Funtai no Sekkei Gilutsu*, Techno System (1988).

The polymerization granulation methods include conventionally known methods using an emulsion polymerization reaction, a seed polymerization reaction or a suspension polymerization reaction each conducted in an aqueous system, or using a dispersion polymerization reaction conducted in a non-aqueous solvent system.

More specifically, grains are formed according to the methods as described, for example, in Soichi Muroi, *Kobunshi Latex no Kagaku*, Kobunshi Kankokai (1970), Taira Okuda and Hiroshi Inagaki, *Gosei Jushi Emulsion*, Kobunshi Kankokai (1978), soichi Muroi, *Kobunshi Latex Nyumon*, Kobunsha (1983), I. Pürma and P. C. Wang, *Emulsion Polymerization*, I. Pürma and J. L. Gaudon, *ACS Symp. Sev.*, 24, p. 34 (1974), Fumio Kitahara et al, *Bunsan Nyukakei no Kagaku*, Kogaku Tosho (1979), and Soichi Muroi (supervised), *Chobiryushi Polymer no Saisentan Gijutsu*, C.M.C. (1991), and then collected and pulverized in such a manner as described in the reference literatures cited with respect to the mechanical method above, thereby the resin grains being obtained.

In order to conduct dry type electrodeposition of the fine powder grains thus-obtained, a conventionally known method, for example, a coating method of electrostatic powder and a developing method with a dry type electrostatic developing agent can be employed. More specifically, a method for electrodeposition of fine grains charged by a method utilizing, for example, corona charge, triboelectrification, induction charge, ion flow charge, and inverse ionization phenomenon, as described, for example, in J. F. Hughes, *Seiden Funtai Toso*, translated by Hideo Nagasaka and Machiko Midorikawa, or a developing method, for example, a cascade method, a magnetic brush method, a fur brush method, an electrostatic method, an induction method, a touchdown method and a powder cloud method, as described, for example, in Koich Nakamura (ed.), *Saikin no Denshishashin Genzo System to Toner Zairyo no Kaihatsu.Jitsuyoka*, Ch. 1, Nippon Kogaku Joho (1985) is appropriately employed.

The production of resin grains dispersed in a non-aqueous system which are used in the wet type electrodeposition method can also be performed by any of the mechanical powdering method and polymerization granulation method as described above.

The mechanical powdering method includes a method wherein the resin is dispersed together with a dispersion polymer in a wet type dispersion machine (for example, a ball mill, a paint shaker, Keddy mill, and Dyno-mill), and a method wherein the materials for resin grains and a dispersion assistant polymer (or a covering polymer) have been previously kneaded, the resulting mixture is pulverized and then is dispersed together with a dispersion polymer. Specifically, a method of producing paints or electrostatic developing agents can be utilized as described, for example, in Kenji Ueki (translated), *Toryo no Ryudo to Ganryo Bunsan*, Kyoritsu Shuppan (1971), D. H. Solomon, *The Chemistry of Organic Film Formers*, John Wiley & Sons (1967), *Paint and Surface Coating Theory and Practice*, Yuji Harasaki, *Coating Kogaku*, Asakura Shoten (1971), and Yuji Harasaki, *Coating no Kiso Kagaku*, Maki Shoten (1977).

The polymerization granulation method includes a dispersion polymerization method in a non-aqueous system conventionally known and is specifically described, for example, in *Chobiryushi Polymer no Saisentan Gijutsu*, Ch. 2, mentioned above, *Saikin no Denshishashin Genzo System to Toner Zairyo no Kaihatsu.Jitsuyoka*, Ch. 3, mentioned above, and K. E. J. Barrett, *Dispersion Polymerization in Organic Media*, John Wiley & Sons (1975).

The resin grains having a core/shell structure described above can also be prepared easily using the polymerization granulation method. Specifically, fine grains composed of the first resin are prepared by a dispersion polymerization method in a non-aqueous system and then using these fine grains as seeds, a monomer corresponding to the second resin is supplied to conduct polymerization in the same manner as above, whereby resin grains having the core/shell structure are obtained.

The introduction of component containing a moiety having a fluorine atom and/or silicon atom into the resin grains in the polymerization granulation method is performed by a copolymerization reaction using one or more monomers forming the resin (A) which are soluble in an organic solvent but becomes insoluble therein by being polymerized together with a monomer corresponding to the component containing a moiety having a fluorine atom and/or silicon atom, whereby the resin grains composed of a random copolymer are easily obtained.

The resin grains containing the component containing a moiety having a fluorine atom and/or silicon atom as a block can be prepared by conducting a polymerization reaction using, as a dispersion stabilizing resin, a block copolymer containing the component containing a moiety having a fluorine atom and/or silicon atom as a block, or conducting a copolymerization reaction using a monofunctional macromonomer having a weight average molecular weight of from $1\times10^3$ to $2\times10^4$, preferably from $3\times10^3$ to $1\times10^4$ and containing the component containing a moiety having a fluorine atom and/or silicon atom as main repeating unit together with one or more monomers forming the resin (A). Alternatively, the resin grains composed of block copolymer can be obtained by conducting a polymerization reaction using a polymer initiator (for example, azobis polymer initiator or peroxide polymer initiator) containing the component containing a moiety having a fluorine atom and/or silicon atom as main repeating unit.

As the non-aqueous solvent used in the dispersion polymerization method in a non-aqueous system, there can be used any of organic solvents having a boiling point of at most 200° C., individually or in a combination of two or more thereof. Specific examples of the organic solvent include alcohols such as methanol, ethanol, propanol, butanol, fluorinated alcohols and benzyl alcohol, ketones such as acetone, methyl ethyl ketone, cyclohexanone and diethyl ketone, ethers such as diethyl ether, tetrahydrofuran and dioxane, carboxylic acid esters such as methyl acetate, ethyl acetate, butyl acetate and methyl propionate, aliphatic hydrocarbons containing from 6 to 14 carbon atoms such as hexane, octane, decane, dodecane, tridecane, cyclohexane and cyclooctane, aromatic hydrocarbons such as benzene, toluene, xylene and chlorobenzene, and halogenated hydrocarbons such as methylene chloride, dichloroethane, tetrachloroethane, chloroform, methylchloroform, dichloropropane and trichloroethane. However, the present invention should not be construed as being limited thereto.

When the dispersed resin grains are synthesized by the dispersion polymerization method in a non-aqueous solvent system, the average grain diameter of the dispersed resin grains can readily be adjusted to at most 1 μm while simultaneously obtaining grains of mono-disperse system with a very narrow distribution of grain diameters.

A dispersive medium used for the resin grains dispersed in a non-aqueous system is usually a non-aqueous solvent having an electric resistance of not less than $10^8$ Ω·cm and a dielectric constant of not more than 3.5, since the dispersion is employed in a method wherein the resin grains are electrodeposited utilizing a wet type electrostatic photographic developing process or electrophoresis in electric fields.

The method in which grains comprising the resin forming the transfer layer dispersed in an electrical insulating solvent having an electric resistance of not less than $10^8$ Ω·cm and a dielectric constant of not more than 3.5 are supplied is preferred in view of easy preparation of the transfer layer having a uniform and small thickness.

The insulating solvents which can be used include straight chain or branched chain aliphatic hydrocarbons, alicyclic hydrocarbons, aromatic hydrocarbons, and halogen-substituted derivatives thereof. Specific examples of the solvent include octane, isooctane, decane, isodecane, decalin, nonane, dodecane, isododecane, cyclohexane, cyclooctane, cyclodecane, benzene, toluene, xylene, mesitylene, Isopar E, Isopar G, Isopar H, Isopar L (Isopar: trade name of Exxon Co.), Shellsol 70, Shellsol 71 (Shellsol: trade name of Shell Oil Co.), Amsco OMS and Amsco 460 Solvent (Amsco: trade name of Americal Mineral Spirits Co.). They may be used singly or as a combination thereof.

When the compound (S) is used together, silicone oil, for example, dimethyl polysiloxane oil (such as KF-96 manufactured by Shin-Etsu Silicone Co., Ltd. or TSF 451 manufactured by Toshiba Silicone Co., Ltd.), methyl hydrogen polysiloxane oil (such as KF-99 manufactured by Shin-Etsu Silicone Co., Ltd. or TSF 484 manufactured by Toshiba Silicone Co., Ltd.) and methyl phenyl polysiloxane oil (such as KF-50 manufactured by Shin-Etsu Silicone Co., Ltd. or TSF 437 manufactured by Toshiba Silicone Co., Ltd.) may be employed.

The insulating organic solvent described above is preferably employed as a non-aqueous solvent from the beginning of polymerization granulation of resin grains dispersed in the non-aqueous system. However, it is also possible that the granulation is performed in a solvent other than the above-described insulating solvent and then the dispersive medium is substituted with the insulating solvent to prepare the desired dispersion.

Another method for the preparation of a dispersion of resin grains in non-aqueous system is that a block copolymer comprising a polymer portion which is soluble in the above-described non-aqueous solvent having an electric resistance of not less than $10^8$ Ω·cm and a dielectric constant of not more than 3.5 and a polymer portion which is insoluble in the non-aqueous solvent is first synthesized in an organic solvent which dissolves the resulting block copolymer and then dispersed in the non-aqueous solvent described above, thereby preparing a non-aqueous latex.

In order to electrodeposit dispersed grains in a dispersive medium upon electrophoresis, the grains must be electroscopic grains of positive charge or negative charge. The impartation of electroscopicity to the grains can be performed by appropriately utilizing techniques on developing agents for wet type electrostatic photography. More specifically, it can be carried out using electroscopic materials and other additives as described, for example, in *Saikin no Denshishashin Genzo System to Toner Zairyo no Kaihatsu.Jitsuyoka*, pp. 139 to 148, mentioned above, Denshishashin Gakkai (ed.), *Denshishashin Gijutsu no Kiso to Oyo*, pp. 497 to 505, Corona Sha (1988), and Yuji Harasaki, *Denshishashin*, Vol. 16, No. 2, p. 44 (1977). Further, compounds as described, for example, in British Patents 893,429 and 934,038, U.S. Pat. Nos. 1,122,397, 3,900,412 and 4,606,989, JP-A-60-179751, JP-A-60-185963 and JP-A-2-13965 are employed.

The dispersion of resin grains in a non-aqueous system (latex) which can be employed for electrodeposition usually comprises from 0.1 to 20 g of grains containing the resin for forming the transfer layer, from 0.01 to 50 g of a dispersion stabilizing resin and if desired, from 0.0001 to 10 g of a charge control agent in one liter of an electrically insulating dispersive medium.

Furthermore, if desired, other additives may be added to the dispersion of resin grains in order to maintain dispersion stability and charging stability of grains. Suitable examples of such additives include rosin, petroleum resins, higher alcohols, polyethers, paraffin wax and triazine derivatives. The total amount of these additives is restricted by the electric resistance of the dispersion. Specifically, if the electric resistance of the dispersion in a state of excluding the grains therefrom becomes lower than $10^8$ Ω·cm, a sufficient amount of the thermoplastic resin grains deposited is reluctant to obtain and, hence, it is necessary to control the amounts of these additives in the range of not lowering the electric resistance than $10^8$ Ω·cm.

The application of the compound (S) and the formation of transfer layer can be performed simultaneously by adding the compound (S) to a dispersion used for electrodeposition. The compound (S) used in this case is preferably that which is soluble at least 0.01 g in one liter of the insulating organic solvent described above. When the compound (S) having the solubility of less than 0.01 g per liter is employed, unevenness of adsorption may occur.

The amount of compound (S) added to the insulating organic solvent may be varied depending on the compound (S) and the insulating organic solvent to be used. A suitable amount of the compound (S) is determined taking the effect to be obtained and adverse affects on electrophoresis of resin grains (e.g., decrease in electric resistance or increase in viscosity) into consideration. A preferred range of the compound (S) added is ordinarily from 0.01 to 20 g per one liter of insulating organic solvent.

The resin grains for forming the transfer layer which are prepared, provided with an electrostatic charge and dispersed in an electrically insulting liquid behave in the same manner as an electrophotographic wet type developing agent. For instance, the resin grains can be subjected to electrophoresis on the surface of light-sensitive element using a developing device, for example, a slit development electrode device as described in *Denshishashin Gijutsu no Kiso to Oyo*, pp. 275 to 285, mentioned above. Specifically, the grains comprising the resin for forming the transfer layer are supplied between the electrophotographic light-sensitive element and an electrode placed in face of the light-sensitive element, and migrate due to electrophoresis according to potential gradient applied from an external power source to adhere to or electrodeposit on the electrophotographic light-sensitive element, thereby a film being formed.

In general, if the charge of grains is positive, an electric voltage was applied between an electroconductive support of the light-sensitive element and a development electrode of a developing device from an external power source so that the light-sensitive material is negatively charged, thereby the grains being electrostatically electrodeposited on the surface of light-sensitive element.

Electrodeposition of grains can also be performed by wet type toner development in a conventional electrophotographic process. Specifically, the light-sensitive element is uniformly charged and then subjected to a conventional wet type toner development without exposure to light or after conducting a so-called print-off in which only unnecessary regions are exposed to light, as described in *Denshishashin Gijutsu no Kiso to Oyo*, pp. 46 to 79, mentioned above.

The amount of resin grain adhered to the light-sensitive element can be appropriately controlled, for example, by an external bias voltage applied, a potential of the light-sensitive element charged and a developing time.

After the electrodeposition of grains, the developing solution is wiped off upon squeeze using a rubber roller, a gap roller or a reverse roller. Other known methods, for example, corona squeeze and air squeeze can also be employed. Then, the deposit is dried with cool air or warm air or by a infrared lamp preferably to be rendered the resin grains in the form of a film, thereby the transfer layer being formed.

The electrodeposition coating method is also suitable for the formation of transfer layer having a layered structure. In case of forming the transfer layer having a layered structure, it is preferred that the compound (S) is added to a first dispersion for electrodeposition containing grains of the resin (AH) which forms the first transfer layer on the surface of light-sensitive element and a second dispersion for electrodeposition comprising grains of the resin (AL) forming the second transfer layer does not contain the compound (S).

Now, the formation of transfer layer by the transfer method will be described below. According to this method, the transfer layer provided on a releasable support typically represented by release paper (hereinafter simply referred to as release paper) is transferred onto the surface of electrophotographic light-sensitive element.

The release paper having the transfer layer thereon is simply supplied to a transfer device in the form of a roll or sheet.

The release paper which can be employed in the present invention include those conventionally known as described, for example, in *Nenchaku (Nensecchaku) no Shin Gijutsu to Sono Yoto.Kakushu Oyoseihin no Kaihatsu Siryo*, published by Keiei Kaihatsu Center Shuppan-bu (May 20, 1978), and *All Paper Guide Shi no Shohin Jiten, Jo Kan, Bunka Sangyo Hen*, published by Shigyo Times Sha (Dec. 1, 1983).

Specifically, the release paper comprises a substrate such as nature Clupak paper laminated with a polyethylene resin, high quality paper pre-coated with a solvent-resistant resin, kraft paper, a PET film having an under-coating or glassine having coated thereon a release agent mainly composed of silicone.

A solvent type of silicone is usually employed and a solution thereof having a concentration of from 3 to 7% by weight is coated on the substrate, for example, by a gravure roll, a reverse roll or a wire bar, dried and then subjected to heat treatment at not less than 150° C. to be cured. The coating amount is usually about 1 g/m$^2$.

Release paper for tapes, labels, formation industry use and cast coat industry use each manufactured by a paper making company and put on sale are also generally employed. Specific examples thereof include Separate Shi (manufactured by Oji Paper Co., Ltd.), King Rease (manufactured by Shikoku Seishi K.K.), Sun Release (manufactured by Sanyo Kokusaku Pulp K.K.) and NK High Release (manufactured by Nippon Kako Seishi K.K.).

In order to form the transfer layer on release paper, a composition for the transfer layer mainly composed of the resin is applied to releasing paper in a conventional manner, for example, by bar coating, spin coating or spray coating to form a film.

For a purpose of heat transfer of the transfer layer on release paper to the electrophotographic light-sensitive element, conventional heat transfer methods are utilized. Specifically, release paper having the transfer layer thereon is pressed on the electrophotographic light-sensitive element to heat transfer the transfer layer.

For instance, a device shown in FIG. 4 is employed for such a purpose. In FIG. 4, release paper 10 having thereon the transfer layer 12 comprising the resin (A) is heat-pressed on the surface of light-sensitive element 11 by a heating roller **117*b*, thereby the transfer layer 12 being transferred on the surface of light-sensitive element 11. The release paper 10 is cooled by a cooling roller 117*c* and recovered. The light-sensitive element is heated by a pre-heating means 17*a* to improve transferability of the transfer layer 12** upon heat-press, if desired.

The conditions for transfer of the transfer layer from release paper to the surface of light-sensitive element are preferably as follows. A nip pressure of the roller is from 0.1 to 10 kgf/cm$^2$ and more preferably from 0.2 to 8 kgf/cm$^2$. A temperature at the transfer is from 25° to 100° C. and more preferably from 40° to 80° C. A speed of the transportation is from 0.5 to 100 mm/sec and more preferably from 3 to 50 mm/sec. The speed of transportation may differ from that of the electrophotographic step or that of the heat transfer step of the transfer layer to the receiving material.

The compound (S) according to the present invention is applied onto the surface of transfer layer provided on release paper by an appropriate method described above and the resulting release paper is pressed on the electrophotographic light-sensitive element to transfer the transfer layer. According to this procedure, the application of compound (S) to the surface of electrophotographic light-sensitive element and the formation of transfer layer thereon are performed at the same time.

The present invention is characterized by applying the compound (S) to modify the surface of electrophotographic light-sensitive element to a state of releasability. Therefore, the compound (S) is applied in an amount sufficient for allowing the transfer layer to release from the surface of light-sensitive element and to transfer to a receiving material in the succeeding transfer step onto the receiving material.

Now, the electrophotographic light-sensitive element on the surface of which the transfer layer is formed will be described in detail below.

Any conventionally known electrophotographic light-sensitive element can be employed without particular limitations in the present invention.

Suitable examples of electrophotographic light-sensitive element used are described, for example, in R. M. Schaffert, *Electrophotography*, Forcal Press, London (1980), S. W. Ing, M. D. Tabak and W. E. Haas, *Electrophotography Fourth International Conference*, SPSE (1983), Isao Shinohara, Hidetoshi Tsuchida and Hideaki Kusakawa (ed.), *Kirokuzairyo to Kankoseijushi*, Gakkai Shuppan Center (1979), Hiroshi Kokado, *Kagaku to Kogyo*, Vol. 39, No. 3, p. 161 (1986), *Saikin no Kododen Zairyo to Kankotai no Kaihatsu.Jitsuyoka*, Nippon Kagaku Joho Shuppanbu (1986), Denshishashin Gakkai (ed.), *Denshishashin no Kiso to Oyo*, Corona (1986), and Denshishashin Gakkai (ed.), *Denshishashinyo Yukikankotai no Genio Symposium* (preprint), (1985).

Specifically, the photoconductive layer includes a single layer made of a photoconductive compound itself and a photoconductive layer comprising a binder resin having dispersed therein a photoconductive compound. The dispersed type photoconductive layer may have a single layer structure or a laminated structure. The photoconductive compounds used in the present invention may be inorganic compounds or organic compounds.

Inorganic photoconductive compounds used in the present invention include those conventionally known for example, zinc oxide, titanium oxide, zinc sulfide, cadmium sulfide, selenium, selenium-tellurium, silicon, lead sulfide. These compounds are used together with a binder resin to form a photoconductive layer, or they are used alone to form a photoconductive layer by vacuum evaporation or spattering.

Where an inorganic photoconductive compound, e.g., zinc oxide or titanium oxide, is used, a binder resin is usually used in an amount of from 10 to 100 parts by weight, and preferably from 15 to 40 parts by weight, per 100 parts by weight of the inorganic photoconductive compound.

Organic photoconductive compounds used may be selected from conventionally known compounds. Suitable photoconductive layers containing an organic photoconductive compound include (i) a layer mainly comprising an organic photoconductive compound, a sensitizing dye, and a binder resin as described, e.g., in JP-B-37-17162, JP-B-62-51462, JP-A-52-2437, JP-A-54-19803, JP-A-56-107246, and JP-A-57-161863; (ii) a layer mainly comprising a charge generating agent, a charge transporting agent, and a binder resin as described, e.g., in JP-A-56-146145, JP-A-60-17751, JP-A-60-17752, JP-A-60-17760, JP-A-60-254142, and JP-A-62-54266; and (iii) a double-layered structure containing a charge generating agent and a charge transporting agent in separate layers as described, e.g., in JP-A-60-230147, JP-A-60-230148, and JP-A-60-238853.

The photoconductive layer of the electrophotographic light-sensitive element according to the present invention may have any of the above-described structure.

The organic photoconductive compounds which may be used in the present invention include (a) triazole derivatives described, e.g., in U.S. Pat. No. 3,112,197, (b) oxadiazole derivatives described, e.g., in U.S. Pat. No. 3,189,447, (c) imidazole derivatives described in JP-B-37-16096, (d) polyarylalkane derivatives described, e.g., in U.S. Pat. Nos. 3,615,402, 3,820,989, and 3,542,544, JP-B-45-555, JP-B-51-10983, JP-A-51-93224, JP-A-55-108667, JP-A-55-156953, and JP-A-56-36656, (e) pyrazoline derivatives and pyrazolone derivatives described, e.g., in U.S. Pat. Nos. 3,180,729 and 4,278,746, JP-A-55-88064, JP-A-55-88065, JP-A-49-105537, JP-A-55-51086, JP-A-56-80051, JP-A-56-88141, JP-A-57-45545, JP-A-54-112637, and JP-A-55-74546, (f) phenylenediamine derivatives described, e.g., in U.S. Pat. No. 3,615,404, JP-B-51-10105, JP-B-46-3712, JP-B-47-28336, JP-A-54-83435, JP-A-54-110836, and JP-A-54-119925, (g) arylamine derivatives described, e.g., in U.S. Pat. Nos. 3,567,450, 3,180,703, 3,240,597, 3,658,520, 4,232,103, 4,175,961, and 4,012,376, JP-B-49-35702, West German Patent (DAS) 1,110,518, JP-B-39-27577, JP-A-55-144250, JP-A-56-119132, and JP-A-56-22437, (h) amino-substituted chalcone derivatives described, e.g., in U.S. Pat. No. 3,526,501, (i) N,N-bicarbazyl derivatives described, e.g., in U.S. Pat. No. 3,542,546, (j) oxazole derivatives described, e.g., in U.S. Pat. No. 3,257,203, (k) styrylanthracene derivatives described, e.g., in JP-A-56-46234, (l) fluorenone derivatives described, e.g., in JP-A-54-110837, (m) hydrazone derivatives described, e.g., in U.S. Pat. No. 3,717,462, JP-A-54-59143 (corresponding to U.S. Pat. No. 4,150,987), JP-A-55-52063, JP-A-55-52064, JP-A-55-46760, JP-A-55-85495, JP-A-57-11350, JP-A-57-148749, and JP-A-57-104144, (n) benzidine derivatives described, e.g., in U.S. Pat. Nos. 4,047,948, 4,047,949, 4,265,990, 4,273,846, 4,299,897, and 4,306,008, (o) stilbene derivatives described, e.g., in JP-A-58-190953, JP-A-59-95540, JP-A-59-97148, JP-A-59-195658, and JP-A-62-36674, (p) polyvinylcarbazole and derivatives thereof described in JP-B-34-10966, (q) vinyl polymers, such as polyvinylpyrene, polyvinylanthracene, poly-2-vinyl-4-(4'-dimethylaminophenyl)-5-phenyloxazole, and poly-3-vinyl-N-ethylcarbazole, described in JP-B-43-18674 and JP-B-43-19192, (r) polymers, such as polyacenaphthylene, polyindene, and an acenaphthylene-styrene copolymer, described in JP-B-43-19193, (s) condensed resins, such as pyrene-formaldehyde resin, bromopyrene-formaldehyde resin, and ethylcarbazole-formaldehyde resin, described, e.g., in JP-B-56-13940, and (t) triphenylmethane polymers described in JP-A-56-90833 and JP-A-56-161550.

The organic photoconductive compounds which can be used in the present invention are not limited to the above-described compounds (a) to (t), and any of known organic photoconductive compounds may be employed in the present invention. The organic photoconductive compounds may be used either individually or in combination of two or more thereof.

The sensitizing dyes which can be used in the photoconductive layer of (i) include those conventionally known as described, e.g., in *Denshishashin*, Vol. 12, p. 9 (1973) and *Yuki Gosei Kagaku*, Vol. 24, No. 11, p. 1010 (1966). Specific examples of suitable sensitizing dyes include pyrylium dyes described, e.g., in U.S. Pat. Nos. 3,141,770 and 4,283,475, JP-A-48-25658, and JPA-62-71965; triarylmethane dyes described, e.g., in *Applied Optics Supplement*, Vol. 3, p. 50 (1969) and JP-A-50-39548; cyanine dyes described, e.g., in U.S. Pat. No. 3,597,196; and styryl dyes described, e.g., in JP-A-60-163047, JP-A-59-164588, and JP-A-60-252517.

The charge generating agents which can be used in the photoconductive layer of (ii) include various conventionally known charge generating agents, either organic or inorganic, such as selenium, selenium-tellurium, cadmium sulfide, zinc oxide, and organic pigments, for example, (1) azo pigments (including monoazo, bisazo, and trisazo pigments) described, e.g., in U.S. Pat. Nos. 4,436,800 and 4,439,506, JP-A-47-37543, JP-A-58-123541, JP-A-58-192042, JP-A-58-219263, JP-A-59-78356, JP-A-60-179746, JP-A-61-148453, JP-A-61-238063, JP-B-60-5941, and JP-B-60-45664, (2) metal-free or metallized phthalocyanine pigments described, e.g., in U.S. Pat. Nos. 3,397,086 and 4,666,802, JP-A-51-90827, and JP-A-52-55643, (3) perylene pigments described, e.g., in U.S. Pat. No. 3,371,884 and JP-A-47-30330, (4) indigo or thioindigo derivatives described, e.g., in British Patent 2,237,680 and JP-A-47-30331, (5) quinacridone pigments described, e.g., in British Patent 2,237,679 and JP-A-47-30332, (6) polycyclic quinone dyes described, e.g., in British Patent 2,237,678, JP-A-59-184348, JP-A-62-28738, and JP-A-47-18544, (7) bisbenzimidazole pigments described, e.g., in JP-A-47-30331 and JP-A-47-18543, (8) squarylium salt pigments described, e.g., in U.S. Pat. Nos. 4,396,610 and 4,644,082, and (9) azulenium salt pigments described, e.g., in JP-A-59-53850 and JP-A-61-212542.

These organic pigments may be used either individually or in combination of two or more thereof.

With respect to a mixing ratio of the organic photoconductive compound and a binder resin, particularly the upper limit of the organic photoconductive compound is determined depending on the compatibility between these materials. The organic photoconductive compound, if added in an amount over the upper limit, may undergo undesirable crystallization. The lower the content of the organic photoconductive compound, the lower the electrophotographic sensitivity. Accordingly, it is desirable to use the organic photoconductive compound in an amount as much as possible within such a range that crystallization does not occur. In general, 5 to 120 parts by weight, and preferably from 10 to 100 parts by weight, of the organic photoconductive compound is used per 100 parts by weight of the total binder resins. The organic photoconductive compounds may be used either individually or in combination of two or more thereof.

The binder resins which can be used in the light-sensitive element according to the present invention include those for conventionally known electrophotographic light-sensitive elements. A preferred weight average molecular weight of the binder resin is from $5\times10^3$ to $1\times10^6$, and particularly from $2\times10^4$ to $5\times10^5$. A preferred glass transition point of the binder resin is from −40° to 200° C., and particularly from −10° to 140° C.

Conventional binder resins which may be used in the present invention are described, e.g., in Takaharu Shibata and Jiro Ishiwatari, *Kobunshi*, Vol. 17, p. 278 (1968), Harumi Miyamoto and Hidehiko Takei, *Imaging*, Vol. 1973, No. 8, Koichi Nakamura (ed.), *Kiroku Zairyoyo Binder no Jissai Gijutsu*, Ch. 10, C.M.C. (1985), Denshishashin Gakkai (ed.), *Denshishashinyo Yukikankotai no Genio Symposium* (preprint) (1985), Hiroshi Kokado (ed.), *Saikin no Kododen Zairyo to Kankotai no Kaihatsu.Jitsuyoka*, Nippon Kagaku Joho (1986), Denshishashin Gakkai (ed.), *Denshishashin Gijutsu no Kiso to Oyo*, Ch. 5, Corona (1988), D. Tatt and S. C. Heidecker, *Tappi*, Vol. 49, No. 10, p. 439 (1966), E. S. Baltazzi and R. G. Blanchlotte, et al., *Photo. Sci. Eng.*, Vol. 16, No. 5, p. 354 (1972), and Nguyen Chank Keh, Isamu Shimizu and Eiichi Inoue, *Denshi Shashin Gakkaishi*, Vol. 18, No. 2, p. 22 (1980).

Specific examples of these known binder resins used include olefin polymers or copolymers, vinyl chloride copolymers, vinylidene chloride copolymers, vinyl alkanoate polymers or copolymers, allyl alkanoate polymers or copolymers, polymers or copolymers of styrene or derivatives thereof, butadiene-styrene copolymers, isoprene-styrene copolymers, butadiene-unsaturated carboxylic ester copolymers, acrylonitrile copolymers, methacrylonitrile copolymers, alkyl vinyl ether copolymers, acrylic ester polymers or copolymers, methacrylic ester polymers or copolymers, styreneacrylic ester copolymers, styrene-methacrylic ester copolymers, itaconic diester polymers or copolymers, maleic anhydride copolymers, acrylamide copolymers, methacrylamide copolymers, hydroxy-modified silicone resins, polycarbonate resins, ketone resins, polyester resins, silicone resins, amide resins, hydroxy- or carboxy-modified polyester resins, butyral resins, polyvinyl acetal resins, cyclized rubber-methacrylic ester copolymers, cyclized rubber-acrylic ester copolymers, copolymers containing a heterocyclic ring containing no nitrogen atom (the heterocyclic ring including furan, tetrahydrofuran, thiophene, dioxane, dioxofuran, lactone, benzofuran, benzothiophene and 1,3-dioxetane rings), and epoxy resins.

Further, the electrostatic characteristics of the photoconductive layer are improved by using, as a binder resin, a resin having a relatively low molecular weight (e.g., a weight average molecular weight of from $10^3$ to $10^4$) and containing an acidic group such as a carboxy group, a sulfo group or a phosphono group. For instance, JP-A-63-217354 discloses a resin having polymer components containing an acidic group at random in the polymer main chain, JP-A-64-70761 discloses a resin having an acidic group bonded at one terminal of the polymer main chain, JP-A-2-67563, JP-A-2-236561, JPA-2-238458, JP-A-2-236562 and JP-A-2-247656 disclose a resin of graft type copolymer having an acidic group bonded at one terminal of the polymer main chain or a resin of graft type copolymer containing acidic groups in the graft portion, and JP-A-3-181948 discloses an AB block copolymer containing acidic groups as a block.

Moreover, in order to obtain a satisfactorily high mechanical strength of the photoconductive layer which may be insufficient by only using the low molecular weight resin, a medium to high molecular weight resin is preferably used together with the low molecular weight resin. For instance, JP-A-2-68561 discloses a thermosetting resin capable of forming crosslinked structures between polymers, JP-A-2-68562 discloses a resin partially having crosslinked structures, and JP-A-2-69759 discloses a resin of graft type copolymer having an acidic group bonded at one terminal of the polymer main chain. Also, in order to maintain the relatively stable performance even when ambient conditions are widely fluctuated, a specific medium to high molecular weight resin is employed in combination. For instance, JP-A-3-29954, JP-A-3-77954, JP-A-3-92861 and JP-A-3-53257 disclose a resin of graft type copolymer having an acidic group bonded at the terminal of the graft portion or a resin of graft type copolymer containing acidic groups in the graft portion. Moreover, JP-A-3-206464 and JP-A-3-223762 discloses a medium to high molecular weight resin of graft type copolymer having a graft portion formed from an AB block copolymer comprising an A block containing acidic groups and a B block containing no acidic group.

In a case of using these resins, the photoconductive substance is uniformly dispersed to form a photoconductive layer having good smoothness. Also, excellent electrostatic characteristics can be maintained even when ambient conditions are fluctuated or when a scanning exposure system using a semiconductor laser beam is utilized for the image exposure.

The photoconductive layer usually has a thickness of from 1 to 100 μm, and preferably from 10 to 50 μm.

Where a photoconductive layer functions as a charge generating layer of a laminated type light-sensitive element composed of a charge generating layer and a charge transporting layer, the charge generating layer has a thickness of from 0.01 to 5 μm, and preferably from 0.05 to 2 μm.

Depending on the kind of a light source for exposure, for example, visible light or semiconductor laser beam, various dyes may be used as spectral sensitizers. The sensitizing dyes used include carbonium dyes, diphenylmethane dyes, xanthene dyes, phthalein dyes, polymethine dyes (including oxonol dyes, merocyanine dyes, cyanine dyes, rhodacyanine dyes, and styryl dyes), and phthalocyanine dyes (including metallized dyes), as described e.g., in Harumi Miyamoto and Hidehiko Takei, *Imaging*, Vol. 1973, No. 8, p. 12, C. J. Young et al., *RCA Review*, Vol. 15, p. 469 (1954), Kohei Kiyota et al., *Denkitsushin Gakkai Ronbunshi*, Vol. J 63-C, No. 2, p. 97 (1980), Yuji Harasaki et al., *Kogyo Kagaku Zasshi*, Vol. 66, p. 78 and 188 (1963), and Tadaaki Tani, *Nihon Shashin Gakkaishi*, Vol. 35, p. 208 (1972).

Specific examples of carbonium dyes, triphenylmethane dyes, xanthene dyes, and phthalein dyes are described, e.g., in JP-B-51-452, JP-A-50-90334, JP-A-50-114227, JP-A-53-39130, JP-A-53-82353, U.S. Pat. Nos. 3,052,540 and 4,054,450, and JP-A-57-16456.

Usable polymethine dyes, such as oxonol dyes, merocyanine dyes, cyanine dyes, and rhodacyanine dyes, are described in F. M. Hamer, *The Cyanine Dyes and Related Compounds*. Specific examples of these dyes are described, e.g., in U.S. Pat. Nos. 3,047,384, 3,110,591, 3,121,008, 3,125,447, 3,128,179, 3,132,942, and 3,622,317, British Patents 1,226,892, 1,309,274, and 1,405,898, JP-B-48-7814, and JP-B-55-18892.

Further, polymethine dyes capable of performing spectral sensitization in the near infrared to infrared region of 700 nm or more include those described, e.g., in JP-A-47-840, JP-A-47-44180, JP-B-51-41061, JP-A-49-5034, JP-A-49-45122, JP-A-57-46245, JP-A-56-35141, JP-A-57-157254, JP-A-61-26044, JP-A-61-27551, U.S. Pat. Nos. 3,619,154 and 4,175,956, and *Research Disclosure*, No. 216, pp. 117–118 (1982).

The light-sensitive element of the present invention is excellent in that the characteristics thereof hardly vary with the combined use of various sensitizing dyes.

If desired, the light-sensitive element may further contain various additives conventionally known for electrophotographic light-sensitive elements. The additives include chemical sensitizers for increasing electrophotographic sensitivity and plasticizers or surface active agents for improving film properties.

Suitable examples of the chemical sensitizers include electron attracting compounds such as a halogen, benzoquinone, chloranil, fluoranil, bromanil, dinitrobenzene, anthraquinone, 2,5-dichlorobenzoquinone, nitrophenol, tetrachlorophthalic anhydride, phthalic anhydride, maleic anhydride, N-hydroxymaleimide, N-hydroxyphthalimide, 2,3-dichloro-5,6-dicyanobenzoquinone, dinitrofluorenone, trinitrofluorenone, tetracyanoethylene, nitrobenzoic acid, and dinitrobenzoic acid; and polyarylalkane compounds, hindered phenol compounds and p-phenylenediamine compounds as described in the literature references cited in Hiroshi Kokado, et al., *Saikin no Kododen Zairyo to Kankotai no Kaihatsu.Jitsuyoka*, Chs. 4 to 6, Nippon Kagaku Joho (1986). In addition, the compounds as described in JP-A-58-65439, JP-A-58-102239, JP-A-58-129439, and JP-A-62-71965 may also be used.

Suitable examples of the plasticizers, which may be added for improving flexibility of a photoconductive layer, include dimethyl phthalate, dibutyl phthalate, dioctyl phthalate, diphenyl phthalate, triphenyl phosphate, diisobutyl adipate, dimethyl sebacate, dibutyl sebacate, butyl laurate, methyl phthalyl glycolate, and dimethyl glycol phthalate. The plasticizer can be added in an amount that does not impair electrostatic characteristics of the photoconductive layer.

The amount of the additive to be added is not particularly limited, but ordinarily ranges from 0.001 to 2.0 parts by weight per 100 parts by weight of the photoconductive substance.

The photoconductive layer of the present invention can be provided on a conventionally known support. In general, a support for an electrophotographic light-sensitive layer is preferably electrically conductive. The electrically conductive support which can be used includes a substrate (e.g., a metal plate, paper, or a plastic sheet) having been rendered conductive by impregnation with a low-resistant substance, a substrate whose back side (opposite to the light-sensitive layer side) is rendered conductive and further having coated thereon at least one layer for, for example, curling prevention, the above-described substrate having formed on the surface thereof a water-resistant adhesive layer, the above-described substrate having on the surface thereof at least one precoat layer, and a paper substrate laminated with a plastic film on which aluminum, etc. has been vacuum deposited.

Specific examples of the conductive substrate and materials for rendering non-conductive substrates electrically conductive are described, for example, in Yukio Sakamoto, *Denshishashin*, Vol. 14, No. 1, pp. 2–11 (1975), Hiroyuki Moriga, *Nyumon Tokushushi no Kagaku*, Kobunshi Kankokai (1975), and M. F. Hoover, *J. Macromol. Sci. Chem.*, Vol. A-4, No. 6, pp. 1327–1417 (1970).

In order to form the toner image by an electrophotographic process according to the present invention, any methods and apparatus conventionally known can be employed. Particularly, a combination of a scanning exposure system using a laser beam based on digital information and a development system using a liquid developer is an advantageous process in order to form highly accurate images.

The developers which can be used in the present invention include conventionally known developers for electrostatic photography, either dry type or liquid type. For example, specific examples of the developer are described in *Denshishashin Gijutsu no Kiso to Oyo*, supra, pp. 497–505, Koichi Nakamura (ed.), *Toner Zairyo no Kaihatsu.Jitsuyoka*, Ch. 3, Nippon Kagaku Joho (1985), Gen Machida, *Kirokuyo Zairyo to Kankosei Jushi*, pp. 107–127 (1983), and Denshishasin Gakkai (ed.), *Imaging*, Nos. 2–5, "Denshishashin no Genzo.Teichaku.Taiden.Tensha", Gakkai Shuppan Center.

Dry developers practically used include one-component magnetic toners, two-component toners, one-component non-magnetic toners, and capsule toners. Any of these dry developers may be employed in the present invention.

The typical liquid developer is basically composed of an insulating organic solvent, for example, an isoparaffinic aliphatic hydrocarbon (e.g., Isopar H or Isopar G (manufactured by Esso Chemical Co.), Shellsol 70 or Shellsol 71 (manufactured by Shell Oil Co.) or IP-Solvent 1620 (manufactured by Idemitsu Petro-Chemical Co., Ltd.)) as a dispersion medium, having dispersed therein a colorant (e.g., an organic or inorganic dye or pigment) and a resin for imparting dispersion stability, fixability, and chargeability to the developer (e.g., an alkyd resin, an acrylic resin, a polyester resin, a styrene-butadiene resin, and rosin). If desired, the liquid developer can contain various additives for enhancing charging characteristics or improving image characteristics.

The colorant is appropriately selected from known dyes and pigments, for example, benzidine type, azo type, azomethine type, xanthene type, anthraquinone type, phthalocyanine type (including metallized type), titanium white, nigrosine, aniline black, and carbon black.

Other additives include, for example, those described in Yuji Harasaki, *Denshishashin*, Vol. 16, No. 2, p. 44, such as di-2-ethylhexylsufosuccinic acid metal salts, naphthenic acid metal salts, higher fatty acid metal salts, alkylbenzenesulfonic acid metal salts, alkylphosphoric acid metal salts, lecithin, polyvinylpyrrolidone, copolymers containing a maleic acid monoamido component, coumarone-indene resins, higher alcohols, polyethers, polysiloxanes, and waxes.

With respect to the content of each of the main components of the liquid developer, toner particles mainly comprising a resin (and, if desired, a colorant) are preferably present in an amount of from 0.5 to 50 parts by weight per 1000 parts by weight of a carrier liquid. If the toner content is less than 0.5 part by weight, the image density is insufficient, and if it exceeds 50 parts by weight, the occurrence of fog in the non-image areas may be tended to.

If desired, the above-described resin for dispersion stabilization which is soluble in the carrier liquid is added in an amount of from about 0.5 to about 100 parts by weight per 1000 parts by weight of the carrier liquid. The above-described charge control agent can be preferably added in an amount of from 0.001 to 1.0 part by weight per 1000 parts by weight of the carrier liquid. Other additives may be added to the liquid developer, if desired. The upper limit of the total amount of other additives is determined, depending on electrical resistance of the liquid developer. Specifically, the amount of each additive should be controlled so that the liquid developer exclusive of toner particles has an electrical resistivity of not less than $10^9$ Ωcm. If the resistivity is less than $10^9$ Ωcm, a continuous gradation image of good quality can hardly be obtained.

The liquid developer can be prepared, for example, by mechanically dispersing a colorant and a resin in a dispersing machine, e.g., a sand mill, a ball mill, a jet mill, or an attritor, to produce colored particles, as described, for example, in JP-B-35-5511, JP-B-35-13424, JP-B-50-40017, JP-B-49-98634, JP-B-58-129438, and JP-A-61-180248.

The colored particles may also be obtained by a method comprising preparing dispersed resin grains having a fine grain size and good monodispersity in accordance with a non-aqueous dispersion polymerization method and coloring the resulting resin grains. In such a case, the dispersed grains prepared can be colored by dyeing with an appropriate dye as described, e.g., in JP-A-57-48738, or by chemical bonding of the dispersed grains with a dye as described, e.g., in JP-A-53-54029. It is also effective to polymerize a monomer already containing a dye at the polymerization granulation to obtain a dye-containing copolymer as described, e.g., in JP-B-44-22955.

The transfer of the toner image together with the transfer layer onto a receiving material in the present invention can be performed using known methods.

The receiving material used in the present invention is not particularly limited and any material conventionally known can be employed. Suitable examples of the receiving materials include those of reflective type, for example, natural paper such as high quality paper, coated paper or art paper, synthetic paper, a metal plate such as an aluminum, iron or SUS plate, and those of transmittive type, for example, a resin film (plastic film) such as a polyester, polyolefin, polyvinyl chloride or polyacetate film.

Now, the method of forming an electrophotographic color transfer image according to the present invention will be described in greater detail with reference to the accompanying drawings, hereinbelow.

FIG. 1 is a schematic view of an apparatus for forming an electrophotographic color transfer image suitable for carrying out the method of the present invention. In this example, the transfer layer is formed by the electrodeposition coating method.

An applying unit 9 for applying the compound (S) according to the present invention onto the surface of electrophotographic light-sensitive element can be either fixed or movable.

A dispersion 12*a* of resin grains is supplied to an electrodeposition unit 14T provided in a movable liquid developing unit set 14.

The compound (S) is first supplied on the surface of light-sensitive element 11 from the applying unit 9 for the compound (S). The electrodeposition unit 14T is then brought near the surface of the light-sensitive element 11 and is kept stationary with a gap of 1 mm therebetween. The light-sensitive element 11 is rotated while supplying the dispersion 12*a* of resin grains into the gap and applying an electric voltage across the gap from an external power source (not shown), whereby the grains are deposited over the entire image-forming areas of the surface of the light-sensitive element 11.

The dispersion 12*a* of resin grains excessively adhered to the surface of the light-sensitive element 11 is removed by a squeezing device built in the electrodeposition unit 14T, and the light-sensitive element is dried by passing under the suction/exhaust unit 15. Then the resin grains are fused by the pre-heating means 17*a* and thus a transfer layer 12 in the form of resin film is obtained.

Thereafter the transfer layer is cooled to a predetermined temperature, if desired, from an outside of the light-sensitive element or from an inside of the drum of the light-sensitive element by a cooling device which is similar to the suction/exhaust unit 15, although not shown.

After moving away the electrodeposition unit 14T, the liquid developing unit set 14 is posited. The unit set 14 is provided with liquid developing units containing yellow, magenta, cyan and black liquid developer, respectively. The unit may be provided, if desired, with a pre-bathing means, a rinsing means and/or a squeeze means in order to prevent stains of the non-image portions. As the pre-bathing solution and the rinse solution, a carrier liquid for the liquid developer is generally used.

The light-sensitive element 11 bearing thereon the transfer layer 12 of the resin is then subjected to the electrophotographic process. Specifically, when it is uniformly charged to, for instance, a positive polarity by a corona charger 18 and then is exposed imagewise by an exposure device (e.g., a semi-conductor laser) 19 on the basis of yellow image information, the potential is lowered in the exposed regions and thus, a contrast in potential is formed between the exposed regions and the unexposed regions. A yellow liquid developing unit 14*y* containing a liquid developer comprising yellow pigment particles having positive electrostatic charge dispersed in an electrically insulating dispersive medium among the liquid developing unit set 14 is brought near the surface of the light-sensitive element 11 and is kept stationary with a gap of 1 mm therebetween.

The light-sensitive material is first pre-bathed by a pre-bathing means provided in the developing unit set, and then the yellow liquid developer is supplied on the surface of the light-sensitive material while applying a developing bias voltage between the light-sensitive material and a development electrode by a bias voltage source and wiring (not shown). The bias voltage is applied so that it is slightly lower than the surface potential of the unexposed regions, while the development electrode is charged to positive and the light-sensitive material is charged to negative. When the bias voltage applied is too low, a sufficient density of the toner image cannot be obtained.

The liquid developer is subsequently washed off by a rinsing means built in the developing unit and the rinse solution adhering to the surface of the light-sensitive material is removed by a squeeze means. Then, the light-sensitive material is dried by passing under the suction/exhaust unit 15.

The above described electrophotographic process is repeated with respect to each image information of magenta, cyan and black. Meanwhile a heat transfer means 17 is kept away from the surface of the light-sensitive material.

After four color images are formed on the transfer layer, the transfer layer is pre-heated by a pre-heating means 17*a* and is pressed against a rubber roller 17*b* having therein a heater with a temperature control means with the receiving material 16 intervening therebetween. The transfer layer and the receiving material are then passed under a cooling roller 17*c*, thereby heat-transferring the toner image to the receiving material 16 together with the transfer layer. Thus a cycle of steps is terminated.

The heat transfer means 17 for heating-transferring the transfer layer to the receiving material comprises the pre-heating means 17*a*, the heating roller 17*b* which is in the form of a metal roller having therein a heater and is covered with rubber, and the cooling roller 17*c*. As the pre-heating means 17*a*, a non-contact type heater such as an infrared line heater, a flash heater or the like is used, and the transfer layer is pre-heated in a range below a temperature of the surface of the light-sensitive material achieved with heating by the heating roller 17*b*. The surface temperature of light-sensitive material heated by the heating roller 17*b* is preferably in a range of from 50° to 150° C., and more preferably from 80° to 120° C.

The cooling roller 17*c* comprises a metal roller which has a good thermal conductivity such as aluminum, copper or the like and is covered with silicone rubber. It is preferred that the cooling roller 17*c* is provided with a cooling means therein or on a portion of the outer surface which is not brought into contact with the receiving material in order to radiate heat. The cooling means includes a cooling fan, a coolant circulation or a thermoelectric cooling element, and it is preferred that the cooling means is coupled with a temperature controller so that the temperature of the cooling roller is maintained within a predetermined range.

The nip pressure of the rollers is preferably in a range of from 0.2 to 20 kgf/cm$^2$ and more preferably from 0.5 to 15 kgf/cm$^2$. Although not shown, the rollers may be pressed by springs provided on opposite ends of the roller shaft or by an air cylinder using compressed air.

A speed of the transportation is suitably in a range of from 0.1 to 100 mm/sec and preferably in a range of from 1 to 30 mm/sec. The speed of transportation may differ between the electrophotographic process and the heat transfer step.

By stopping the apparatus in the state where the transfer layer has been formed, the next operation can start with the electrophotographic process. Further, the transfer layer acts to protect the light-sensitive layer and prevent the properties of the light-sensitive layer from deteriorating due to environmental influence.

It is needless to say that the above-described conditions should be optimized depending on the physical properties of the transfer layer, the light-sensitive element (i.e., the light-sensitive layer and the support) and the receiving material. Especially it is important to determine the conditions of pre-heating, roller heating and cooling in the heat transfer step taking into account the factors such as glass transition point, softening temperature, flowability, tackiness, film properties and film thickness of the transfer layer. Specifically, the conditions should be set so that the tackiness of the transfer layer increases and the transfer layer is closely adhered to the receiving material when the transfer layer softened to a certain extent by the pre-heating means passes the heating roller, and so that the temperature of the transfer layer is decreased to reduce the flowability and the tackiness after the transfer layer subsequently passes the cooling roller and thus the transfer layer is peeled as a film from the surface of the light-sensitive element together with the toner thereon.

FIG. 2 is a schematic view of another apparatus for forming an electrophotographic color transfer image suitable for carrying out the method of the present invention, in which the transfer layer is formed by the hot-melt coating method.

The transfer layer 12 is coated on the surface of a light-sensitive element 11 provided on the peripheral surface of a drum by a hot-melt coater 13 and is caused to pass under a suction/exhaust unit 15 to be cooled to a predetermined temperature. After the hot-melt coater 13 is moved to the stand-by position indicated as 13*a*, a liquid developing unit set 14 is moved to the position where the hot-melt coater 13 was. The unit set 14 is provided with developing units containing yellow, magenta, cyan and black liquid developers, respectively.

The light-sensitive element 11 bearing thereon the transfer layer 12 composed of the resin (A) is then subjected to the electrophotographic process. Details of the process are the same as those described above in conjunction with the example where the electrodeposition coating method is used. Also, other conditions related to the apparatus are the same as those described above.

FIG. 3 is a schematic view of a still another apparatus for forming an electrophotographic color transfer image suitable for carrying out the method of the present invention, in which the transfer layer is formed by the transfer method.

The apparatus of FIG. 3 has essentially the same constitution as the apparatus (FIG. 1) used in the electrodeposition coating method described above except for means for forming the transfer layer on the surface of light-sensitive element. The electrophotographic process, the transfer process and the conditions thereof performed after forming the transfer layer 12 on the surface of light-sensitive element 11 are also the same as those described above.

In FIG. 3, the apparatus separately provided with a transfer means 117 for transferring the transfer layer 12 from release paper 10 onto the light-sensitive element 11 and a transfer means 17 for transferring the transfer layer having a toner image thereon onto the receiving material 16 is shown. However, a method wherein the transfer layer 12 is first transferred from the release paper 10 to the light-sensitive element using the transfer means 117, a toner image is formed thereon by an electrophotographic process and then the toner image is transferred to the receiving material 16 together with the transfer layer using again the transfer means 117 while now supplying the receiving material 16 can also be employed.

When the transfer layer is composed of plural layers, plural transfer layer-forming devices (such as those of 13, 14T and 117) are provided. The transfer layer-forming units may be used together or may be movable and replaced one with the other. The processes and the conditions thereof after the formation of transfer layer having a layered structure are the same as those described above.

FIG. 6 is a schematic view of a still another apparatus for forming an electrophotographic color transfer image suitable for carrying out the method of the present invention.

A dispersion 12*a* of resin grains containing the compound (S) is supplied to an electrodeposition unit 14T provided in a movable liquid developing unit set 14. The electrodeposition unit 14T is first brought near the surface of the light-sensitive element 11 and is kept stationary with a gap of 1 mm between the light-sensitive element and a development electrode of the electrodeposition unit 14T. The light-sensitive element 11 is rotated while supplying the dispersion 12*a* of resin grains into the gap and applying an electric voltage across the gap from an external power source (not shown), whereby the grains accompanied with the compound (S) are deposited over the entire image-forming areas of the surface of the light-sensitive element 11.

The dispersion 12*a* of resin grains excessively adhered to the surface of the light-sensitive element 11 is removed by a squeezing device built in the electrodeposition unit 14T, and the light-sensitive element is dried by passing under the suction/exhaust unit 15. Then the resin grains are fused by the pre-heating means 17*a* and thus a transfer layer 12 in the form of resin film is obtained.

The subsequent procedures are the same as those described with reference to FIG. 1 above.

FIG. 7 is a schematic view of a still another apparatus for forming an electrophotographic color transfer image suitable for carrying out the method of the present invention.

The apparatus according to the present invention can be provided with the electrodeposition unit 14T and the liquid developing unit set 14 separately as shown in FIG. 7. In this case, the transfer layer 12 is first formed on the surface of light-sensitive element 11 by the electrodeposition unit 14T. After the electrodeposition unit 14T is moved to the stand-by position indicated as 14Ta, the liquid developing unit set 14 is moved to the position where the electrodeposition unit was. Other processes than the above are the same as those described with respect to FIG. 6 above.

Further, when the transfer layer is composed of plural layers, an electrodeposition unit 14T similar to the above is further provided. These electrodeposition units may be used together or may be movable and replaced one with the other. The processes and the conditions thereof after the formation of transfer layer having a layered structure are the same as those described above.

Figure 1:
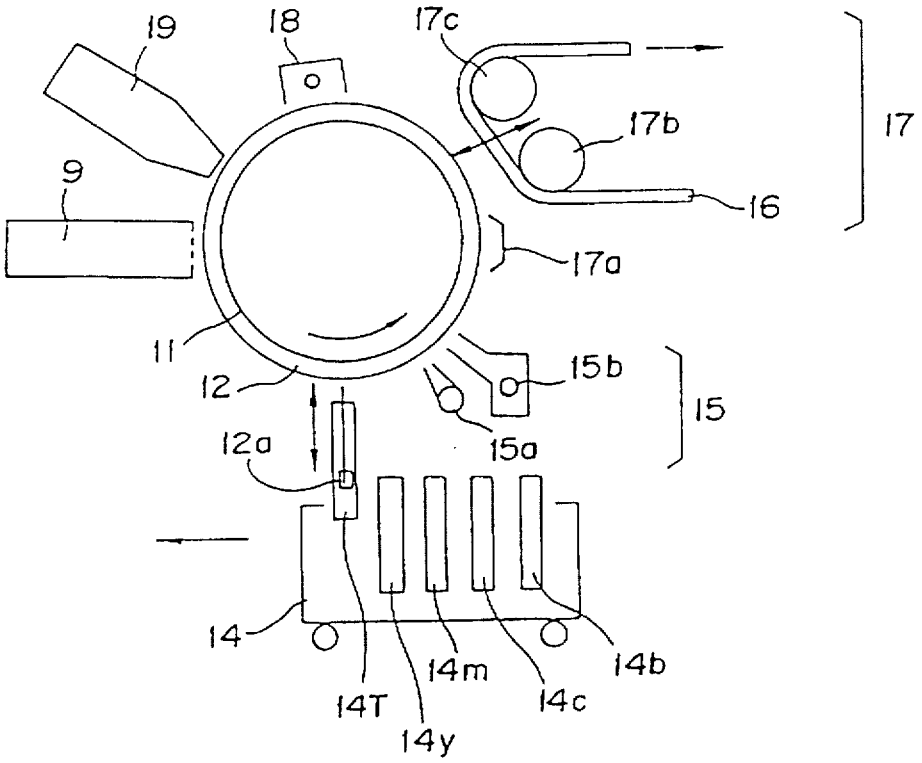
FIG. 1 is a schematic view of an apparatus for forming a color transfer image using the electrodeposition coating method for the formation of transfer layer.

Explanation of the Symbols:

9 Applying unit for compound (S)
10 Release paper
11 Light-sensitive element
12 Transfer layer
**12*a*** Dispersion of resin grains
13 Hot-melt coater
**13*a*** Stand-by position of hot-melt coater
14 Liquid developing unit set
14T Electrodeposition unit
14Ta Stand-by position of electrodeposition unit
**14*y*** Yellow liquid developing unit
**14*m*** Magenta liquid developing unit
**14*c*** Cyan liquid developing unit
**14*b*** Black liquid developing unit
15 Suction/exhaust unit
**15*a*** Suction part
**15*b*** Exhaust part
16 Receiving material
17 Heat transfer means
**17*a*** Pre-heating means
**17*b*** Heating roller
**17*c*** Cooling roller
18 Corona charger
19 Exposure device
117 Heat transfer means
**117*b*** Heating roller
**117*c*** Cooling roller
120 Transfer roll
121 Metering roll
122 Compound (S)

BEST MODE FOR CONDUCTING THE INVENTION

The present invention is illustrated in greater with reference to the following examples, but the invention is not to be construed as being limited thereto.

Synthesis Examples of Resin Grain (A)

SYNTHESIS EXAMPLE 1 OF RESIN GRAIN (A) : (A-1)

A mixed solution of 10 g of Dispersion Stabilizing (Q-1) having the structure shown below, 100 g of vinyl acetate, and 384 g of Isopar H was heated to a temperature of 70° C. under nitrogen gas stream while stirring. To the solution was added 0.8 g of 2,2'-azobis(isovaleronitrile) (abbreviated as AIVN) as a polymerization initiator, followed by reacting for 3 hours. Twenty minutes after the addition of the polymerization initiator, the reaction mixture became white turbid, and the reaction temperature rose to 88° C. Then, 0.5 g of the above-described initiator was added to the reaction mixture, the reaction were carried out for 2 hours. The temperature was raised to 100° C. and stirred for 2 hours to remove the unreacted vinyl acetate by distillation. After cooling, the reaction mixture was passed through a nylon cloth of 200 mesh to obtain a white dispersion which was a latex of good monodispersity with a polymerization ratio of 90% and an average grain diameter of 0.23 μm. The grain diameter was measured by CAPA-500 manufactured by Horiba Ltd.

A part of the white dispersion was centrifuged at a rotation of $1\times10^4$ r.p.m. for 60 minutes and the resin grains precipitated were collected and dried. A weight average molecular weight (Mw) and a glass transition point (Tg) of the resin grain were measured (Mw and Tg of resin grain being measured in the same manner hereinafter).

Mw: $2\times10^5$ (measured by a GPC method and calculated in terms of polystyrene)

Tg: 38° C.

Dispersion Stabilizing Resin (Q-1)

Dispersion Stabilizing Resin (Q-1)

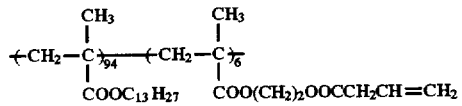

Mw: $4\times10^4$

SYNTHESIS EXAMPLE 2 OF RESIN GRAIN (A) : (A-2)

A mixed solution of 15 g of Dispersion Stabilizing resin (Q-2) having the structure shown below, 75 g of benzyl methacrylate, 25 g of methyl acrylate, 1.3 g of methyl 3-mercaptopropionate and 552 g of Isopar H was heated to a temperature of 50° C. under nitrogen gas stream while stirring. To the solution was added 1 g of 2,2'-azobis(2-cyclopropylpropionitrile) (abbreviated as ACPP) as a polymerization initiator, followed by reacting for 2 hours. To the reaction mixture was added 0.8 g of ACPP, followed by reacting by reacting for 2 hours. Further, 0.8 g of AIVN was added thereto and the reaction temperature was adjusted to 75° C., and the reaction was continued for 3 hours. Then, the temperature was raised to 90° C., and the unreacted monomers were distilled off under a reduced pressure of 20 to 30 mm Hg. After cooling the reaction mixture was passed through a nylon cloth of 200 mesh to obtain a white dispersion which was a latex of good monodispersity with a polymerization ratio of 98% and an average grain diameter of 0.20 μm. An Mw of the resin grain was $2.8\times10^4$ and a Tg thereof was 55° C.

Dispersion Stabilizing Resin (Q-2)

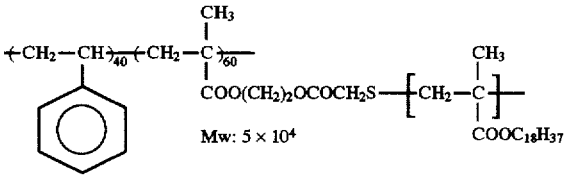

Mw: $5 \times 10^4$

SYNTHESIS EXAMPLE 3 OF RESIN GRAIN (A) : (A-3)

A mixed solution of 14 g of Dispersion Stabilizing Resin (Q-3) having the structure shown below and 382 g of Isopar G was heated to a temperature of 50° C. under nitrogen gas stream while stirring. To the solution was added dropwise a mixture of 80 g of benzyl methacrylate, 20 g of vinyl toluene and 0.8 g of ACPP over a period of one hour, followed by reacting for one hour. To the reaction mixture was further added 0.8 g of ACPP, followed by reacting for 2 hours. Then, 0.8 g of AIVN was added thereto and the temperature was adjusted to 80° C., and the reaction was continued for 2 hours. To the reaction mixture was further added 0.5 g of AIVN, followed by reacting for 2 hours. Then, the temperature was raised to 100° C., and the unreacted monomers were distilled off under a reduced pressure of 10 to 20 mm Hg. After cooling, the reaction mixture was passed through a nylon cloth of 200 mesh to obtain a white dispersion which was a latex of good monodispersity with a polymerization ratio of 90% and an average grain diameter of 0.17 μm. An Mw of the resin grain was $1\times10^5$ and a Tg thereof was 55° C.

Dispersion Stabilizing Resin (Q-3)

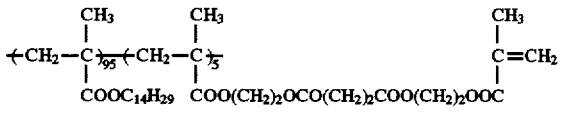

Mw: $5 \times 10^4$

SYNTHESIS EXAMPLE 4 OF RESIN GRAIN (A) : (A-4)

A mixed solution of 14 g of Dispersion Stabilizing Resin (Q-4) having the structure shown below, 10 g of a monofunctional macromonomer of dimethylsiloxane (Macromonomer (M-1)) (FM-0725 manufactured of Chisso Corp.; MW: $1\times10^4$) and 553 g of Isopar H was heated to a temperature of 50° C. under nitrogen gas stream while stirring. To the solution was added dropwise a mixture of 70 g of methyl methacrylate, 20 g of ethyl acrylate, 1.3 g of methyl 3-mercaptopropionate and 1.0 g of ACPP over a period of 30 minutes, followed by reacting for 1.5 hours. To the reaction mixture was further added 0.8 g of ACPP, followed by reacting for 2 hours. Then, 0.8 g of AIVN was added thereto and the temperature was adjusted to 80° C., and the reaction was continued for 2 hours. To the reaction mixture was further added 0.5 g of ACPP, followed by reacting for 2 hours. After cooling, the reaction mixture was passed through a nylon cloth of 200 mesh to obtain a white dispersion which was a latex of good monodispersity with a polymerization ratio of 99% and an average grain diameter of 0.15 μm. An Mw of the resin grain was $3\times10^4$ and a Tg thereof was 50° C.

Dispersion Stabilizing Resin (Q-4)

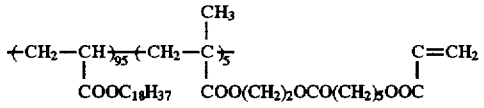

Mw: $4.5 \times 10^4$

SYNTHESIS EXAMPLES 5 TO 15 OF RESIN GRAIN (A): (A-5) TO (A-15)

Each of the resin grains was synthesized in the same manner as in Synthesis Example 4 of Resin Grain (A) except for using each of the macromonomers (Mw thereof being in a range of from $8\times10^3$ to $1\times10^4$) shown in Table A below in place of 10 g of Macromonomer (M-1). A polymerization ratio of each of the resin grains was in a range of from 98 to 99% and an average grain diameter thereof was in a range of from 0.15 to 0.25 μm with good monodispersity. An Mw of each of the resin grains was in a range of from $2.5\times^4$ to $4\times10^4$ and a Tg thereof was in a range of from 40° C. to 70° C.

TABLE A

| Synthesis Example of Resin Grain (A) | Resin Grain (A) | Macromonomer |
|---|---|---|
| 5 | A-5 | 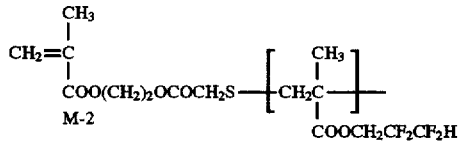 M-2 |
| 6 | A-6 | 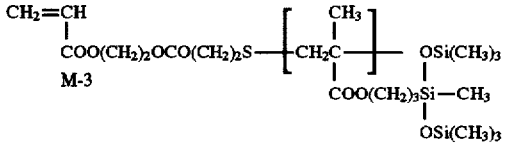 M-3 |

TABLE A-continued
| Synthesis Example of Resin Grain (A) | Resin Grain (A) | Macromonomer |
|---|---|---|
| 7 | A-7 | 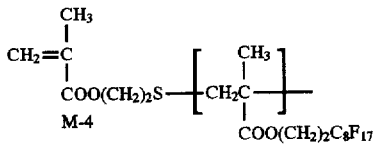 M-4 |
| 8 | A-8 | 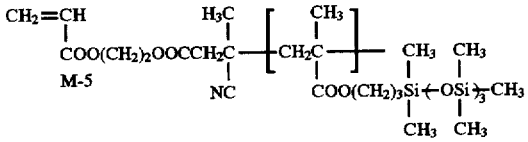 M-5 |
| 9 | A-9 | 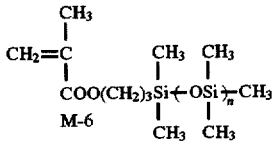 M-6 |
| 10 | A-10 | 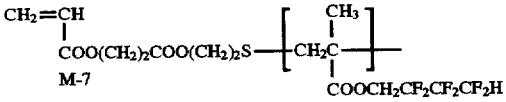 M-7 |
| 11 | A-11 | 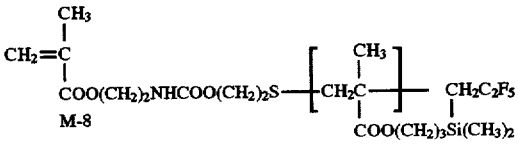 M-8 |
| 12 | A-12 | 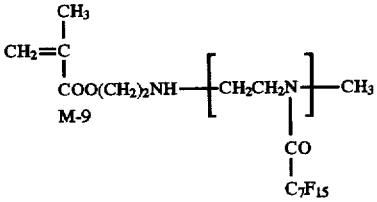 M-9 |
| 13 | A-13 | 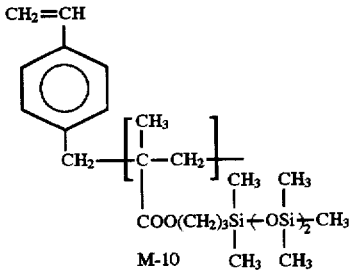 M-10 |
| 14 | A-14 | 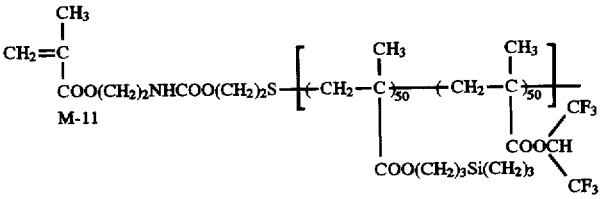 M-11 |

TABLE A-continued

| Synthesis Example of Resin Grain (A) | Resin Grain (A) | Macromonomer |
|---|---|---|
| 15 | A-15 | $CH_2{=}CH(COO(CH_2)_3Si(CH_3)_2(OSi(CH_3)_2)_nCH_3)$ M-12 |

SYNTHESIS EXAMPLES 16 TO 25 OF RESIN GRAIN (A): (A-16) TO (A-25)

Each of the resin grains was synthesized in the same manner as in Synthesis Example 3 of Resin Grain (A) except for using each of the monomers shown in Table B below in place of 80 g of benzyl methacrylate and 20 g of vinyl toluene used in Synthesis Example 3 of Resin Grain (A). A polymerization ratio of each of the resulting white dispersion was in a range of from 95 to 99% and an average grain diameter thereof was in a range of from 0.15 to 0.30 μm. An Mw of each of the resin grains was in a range of from $1\times10^5$ to $3\times10^5$ and a Tg thereof was in a range of from 35° C. to 70° C.

TABLE B

| Synthesis Example of Resin Grain (A) | Resin Grain (A) | Macromonomer | |
|---|---|---|---|
| 16 | A-16 | Methyl methacrylate | 70 g |
| | | Ethyl acrylate | 30 g |
| 17 | A-17 | Phenethyl methacrylate | 90 g |
| | | Methyl acrylate | 10 g |
| 18 | A-18 | Styrene | 80 g |
| | | Vinyl toluene | 20 g |
| 19 | A-19 | Vinyl acetate | 80 g |
| | | Vinyl benzoate | 20 g |
| 20 | A-20 | Vinyl acetate | 97 g |
| | | Crotonic acid | 3 g |
| 21 | A-21 | Methyl methacrylate | 50 g |
| | | Butyl methacrylate | 50 g |
| 22 | A-22 | Methyl methacrylate | 75 g |
| | | Macromonomer of n-butyl acrylate (AB-6 manufactured by Toagosei Chemical Industry Co., Ltd., Mw: $1.5\times10^4$) | 25 g |
| 23 | A-23 | Methyl methacrylate | 55 g |
| | | Methyl acrylate | 40 g |
| | | Acrylic acid | 5 g |
| 24 | A-24 | Methyl methacrylate | 64 g |
| | | Ethyl acrylate | 30 g |
| | | Acrylonitrile | 6 g |
| 25 | A-25 | Ethyl methacrylate | 90 g |
| | | N-(2-Methylphenyl)-acryiamide | 10 g |

SYNTHESIS EXAMPLE 26 OF RESIN GRAIN (A): (A-26)

As the resin (A), 5 g of coarse powder of methyl methacrylate/octadecyl methacrylate (90/10 ratio by weight) copolymer (Mw: $6\times10^4$, Tg: 95° C.) pulverized by a trioblender, 4 g of a dispersion stabilizing resin (Sorprene 1205 manufactured by Asahi Kasei Kogyo Kabushiki Kaisha) and 51 g of Isopar H was dispersed in a paint shaker (manufactured by Toyo Seiki Seisakusho Co.) with glass beads having a diameter of about 4 mm for 20 minutes. The resulting pre-dispersion was subjected to a wet type dispersion process using Dynomill KDL (manufactured by Sinmaru Enterprises Co., Ltd.) with glass beads having a diameter of from 0.75 to 1 mm at a rotation of 4500 r.p.m. for 6 hours, and then passed through a nylon cloth of 200 mesh to obtain a white dispersion which was a latex having an average grain diameter of 0.4 μm.

SYNTHESIS EXAMPLE 27 OF RESIN GRAIN (A): (A-27)

A mixed solution of 40 g of styrene, 20 g of vinyl toluene, 40 g of Macromonomer (M-13) having the structure shown below and 200 g of toluene was heated to a temperature of 80° C. under nitrogen gas stream while stirring. To the solution was added 1 g of 2,2'-azobis(isobutyronitrile) (abbreviated as AIBN), followed by reacting for 3 hours. To the reaction mixture was added 0.8 g of AIBN, followed by reacting for 3 hours and then further was added 0.5 g of AIBN, followed by reacting for 3 hours. After cooling, the reaction mixture was reprecipitated from one liter of methanol and the resulting precipitate was collected and dried. An Mw of the polymer obtained was $3.5\times10^4$ and a Tg thereof was 48° C.

A mixture of 20 g of the above described powder of the polymer and 80 g of Isopar G was stirred at a temperature of 60° C. for 2 hours to prepare a bluish white dispersion which was a latex of good monodispersity having an average grain diameter of 0.10 μm.

Macromonomer (M-13)

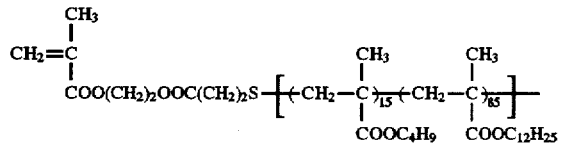

SYNTHESIS EXAMPLES 28 TO 38 OF RESIN GRAIN (A): (A-28) TO (A-38)

Each dispersion was prepared according to a wet type dispersion process in the same manner as in Synthesis Example 26 of Resin Grain (A) except for using each of the compounds shown in Table C below in place of the methyl methacrylate/octadecyl methacrylate copolymer used in Synthesis Example 26 of Resin Grain (A). An average grain diameter of each of the white dispersion obtained was in a range of from 0.3 to 0.6 μm. A softening point of each of the resin grains was in a range of from 40° C. to 100° C.

TABLE C

| Synthesis Example of Resin Grain (A) | Resin Grain (A) | Resin (A) |
|---|---|---|
| 28 | A-28 | Ethylene/methacrylic acid copolymer (96.4:3.6 by molar ratio) (Nimacrel N-699 manufactured by Du Pont-Mitsui Polychemicals Co., Ltd.) |
| 29 | A-29 | Ethylene/vinyl acetate copolymer (Evaflex 420 manufactured by Du Pont-Mitsui Polychemicals Co., Ltd.) |
| 30 | A-30 | Ethylene/ethyl acrylate copolymer (Evaflex-EEA, A-703 manufactured by Du Pont-Mitsui Polychemicals Co., Ltd.) |
| 31 | A-31 | Vinyl chloride/vinyl acetate copolymer (UCAR-VYHH Resin manufactured by Union Carbide Co., Ltd.) |
| 32 | A-32 | Cellulose acetate butyrate (Cellidor Bsp. manufactured by Bayer AG) |
| 33 | A-33 | Polyvinyl butyral resin (S-Lec manufactured by Sekisui Chemical Co., Ltd.) |
| 34 | A-34 | 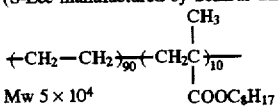 Mw $5\times10^4$ |
| 35 | A-35 | 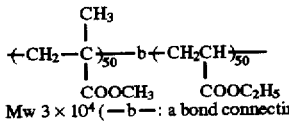 Mw $3\times10^4$ (—b—: a bond connecting blocks, hereinafter the same) |
| 36 | A-36 | 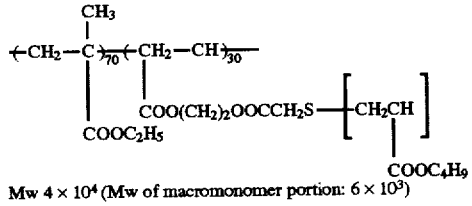 Mw $4\times10^4$ (Mw of macromonomer portion: $6\times10^3$) |
| 37 | A-37 | 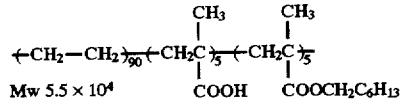 Mw $5.5\times10^4$ |
| 38 | A-38 | 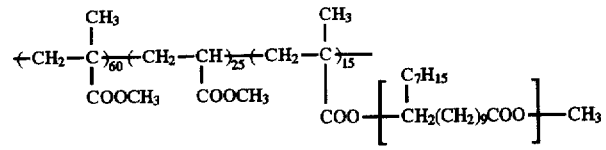 Mw $4\times10^4$ (Mw of macromonomer portion: $4\times10^3$) |

SYNTHESIS EXAMPLE 39 OF RESIN GRAIN (A): (A-39)

A mixed solution of 12 g of Dispersion Stabilizing Resin (Q-1) described above, 70 g of vinyl acetate, 30 g of vinyl butyrate and 388 g of Isopar H was heated to a temperature of 80° C. under nitrogen gas stream while stirring. To the solution was added 1.5 g of AIBN as a polymerization initiator, followed by reacting for 2 hours. Then, 0.8 g of AIBN was added to the reaction mixture, the reaction was carried out for 2 hours and 0.8 g of AIBN was further added thereto, followed by reacting for 2 hours. After cooling, the reaction mixture was passed through a nylon cloth of 200 mesh to obtain a white dispersion which was a latex of good monodispersity having a polymerization ratio of 93% and an average grain diameter of 0.18 μm. An Mw of the resin grain was $8\times10^4$ and a Tg thereof was 18° C.

SYNTHESIS EXAMPLE 40 OF RESIN GRAIN (A): (A-40)

A mixed solution of 18 g of Dispersion Stabilizing Resin (Q-3) described above and 549 g of Isopar H was heated to a temperature of 55° C. under nitrogen gas stream with stirring. To the mixture was added dropwise a mixture of 70 g of benzyl methacrylate, 30 g of methyl acrylate, 2.6 g of methyl 3-mercaptopropionate and 1.0 g of AIVN over a period of one hour, followed by further reacting for one hour. Then 0.8 g of AIVN was added to the reaction mixture, the temperature thereof was raised to 75° C., and the reaction was conducted for 2 hours. Further, 0.8 g of AIVN was added thereto, followed by reacting for 3 hours. After cooling, the reaction mixture was passed through a nylon cloth of 200 mesh to obtain a white dispersion which was a latex of good monodispersity having a polymerization ratio of 98% and an average grain diameter of 0.18 μm. An Mw of the resin grain was $3\times10^4$ and a Tg thereof was 18° C.

SYNTHESIS EXAMPLES 41 TO 50 OF RESIN GRAIN (A): (A-41) TO (A-50)

Each of the resin grains (A) was synthesized in the same manner as in Synthesis Example 40 of Resin Grain (A) except for using each of the monomers shown in Table D below in place of 70 g of benzyl methacrylate and 30 g of methyl acrylate used in Synthesis Example 40 of Resin Grain (A). A polymerization ratio of each of the white dispersions obtained was in a range of from 90 to 99% and an average grain diameter thereof was in a range of from 0.13 to 0.20 μm with good monodispersity. A Tg of each of the resin grains was in a range of from 10° C. to 25° C.

TABLE D

| Synthesis Example of Resin Grain (A) | Resin Grain (A) | Monomer | |
|---|---|---|---|
| 41 | A-41 | Phenetyl methacrylate | 70 g |
| | | Methyl acrylate | 30 g |
| 42 | A-42 | 3-Phenylpropyl methacrylate | 80 g |
| | | Ethyl acrylate | 20 g |
| 43 | A-43 | Methyl methacrylate | 60 g |
| | | 2-Methoxyethyl methacrylate | 40 g |
| 44 | A-44 | Vinyl toluene | 20 g |
| | | 2-Ethylhexyl methacrylate | 15 g |
| | | Methyl methacrylate | 65 g |
| 45 | A-45 | Vinyl acetate | 70 g |
| | | Vinyl valerate | 30 g |
| 46 | A-46 | Methyl methacrylate | 60 g |
| | | Butyl methacrylate | 20 g |
| | | 2,3-Dipropoxypropyl methacrylate | 20 g |
| 47 | A-47 | Methyl methacrylate | 65 g |
| | | Ethyl methacrylate | 30 g |
| | | Macromonomer (M-1) | 5 g |
| 48 | A-48 | Benzyl methacrylate | 60 g |
| | | Benzyl acrylate | 30 g |
| | | Macromonomer (M-3) | 10 g |
| 49 | A-49 | Benzyl methacrylate | 70 g |
| | | Ethylene glycol monomethylether monomethacrylate | 25 g |
| | | Macromonomer (M-4) | 5 g |
| 50 | A-50 | 2-Phenyl-2-methylethyl methacrylate | 75 g |
| | | Methyl acrylate | 25 g |

SYNTHESIS EXAMPLE 51 OF RESIN GRAIN (A): (A-51)

A mixture of 5 g of coarse powder of a styrene-butadiene copolymer (48/52 ratio by weight) (Sorprene 303 manufactured by Asahi Kasei Kogyo Kabushiki Kaisha) having a softening point of 45° C., as the resin (A), pulverized by a trioblender, 4 g of a dispersion stabilizing resin (Sorprene 1205 manufactured by Asahi Kasei Kogyo Kabushiki Kaisha) and 51 g of Isopar H was dispersed in a paint shaker (manufactured by Toyo Seiki Seisakusho Co.) with glass beads having a diameter of about 4 mm for 20 minutes. The resulting pre-dispersion was subjected to a wet type dispersion process using Dyno-mill KDL (manufactured by Sinmaru Enterprises Co., Ltd.) with glass beads having a diameter of from 0.75 to 1 mm at a rotation of 4500 r.p.m. for 6 hours, and then passed through a nylon cloth of 200 mesh to obtain a white dispersion which was a latex having an average grain diameter of 0.4 μm.

SYNTHESIS EXAMPLE 52 OF RESIN GRAIN (A): (A-52)

A mixed solution of 12 g of Dispersion Stabilizing Resin (Q-1) described above, 70 g of vinyl acetate, 30 g of vinyl butyrate and 388 g of Isopar H was heated to a temperature of 80° C. under nitrogen gas stream while stirring. To the solution was added 1.5 g of AIBN as a polymerization initiator, followed by reacting for 2 hours. Then, 0.8 g of AIBN was added to the reaction mixture, the reaction was carried out for 2 hours and 0.8 g of AIBN was further added thereto, followed by reacting for 2 hours. After cooling, the reaction mixture was passed through a nylon cloth of 200 mesh to obtain a white dispersion which was a latex of good monodispersity having a polymerization ratio of 93% and an average grain diameter of 0.18 μm. An Mw of the resin grain was $8\times10^4$ and a Tg thereof was 18° C.

A mixture of the whole amount of the resulting resin dispersion (as seed) and 10 g of Dispersion Stabilizing Resin (Q-5) having the structure shown below was heated to a temperature of 60° C. under nitrogen gas stream with stirring. To the mixture was added dropwise a mixture of 10 g of Macromonomer (M-1), 50 g of methyl methacrylate, 40 g of 2-butoxyethyl methacrylate, 2.0 g of methyl 3-mercaptopropionate, 0.8 g of AIVN and 400 g Isopar G over a period of 2 hours, followed by further reacting for 2 hours. Then 0.8 g of AIVN was added to the reaction mixture, the temperature thereof was adjusted to 70° C., and the reaction was conducted for 2 hours. Further, 0.6 g of AIVN was added thereto, followed by reacting for 3 hours. After cooling, the reaction mixture was passed through a nylon cloth of 200 mesh to obtain a white dispersion which was a latex of good monodispersity having a polymerization ratio of 98% and an average grain diameter of 0.25 μm.

Dispersion Stabilizing Resin (Q-5)

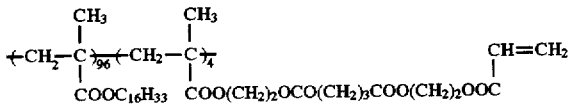

Mw: $4 \times 10^4$

EXAMPLE A-1

An amorphous silicon light-sensitive element was installed as an electrophotographic light-sensitive element in an apparatus as shown in FIG. 1. The adhesive strength of the surface of light-sensitive element was 180 g·f.

Impartation of releasability to the surface of light-sensitive element was conducted by dipping the light-sensitive element in a solution of the compound (S) according to the present invention (dip method). Specifically, the light-sensitive element rotated at a circumferential speed of 10 mm/sec was brought into contact with a bath containing a solution prepared by dissolving 1.0 g of Compound (S-1) shown below in one liter of Isopar G (manufactured by Esso Standard Oil Co.) for 7 seconds and dried using air-squeezing. The adhesive strength of the surface of the light-sensitive element thus-treated was 5 g·f and the light-sensitive element exhibited good releasability.

Compound (S-1)

Silicone surface active agent (SILWet FZ-2171 manufactured by Nippon Unicar Co., Ltd.)

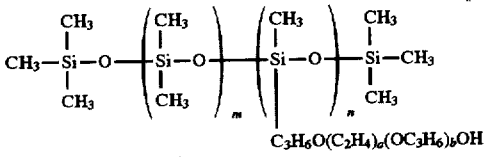

(presumptive structure)

On the surface of light-sensitive element installed on a drum, whose surface temperature was adjusted to 60° C. and which was rotated at a circumferential speed of 10 mm/sec, Dispersion of Positively Charged Resin Grains (L-1) shown below was supplied using a slit electrodeposition device, while putting the light-sensitive element to earth and applying an electric voltage of −200 V to an electrode of the slit electrodeposition device, whereby the resin grains were electrodeposited. The resin grains were fixed. A thickness of the transfer layer was 5 μm.

| Dispersion of Positively Charged Resin Grains (L-1) | |
|---|---|
| Resin Grain (A-1) | 8 g (solid basis) |
| Positive-Charge Control Agent (CD-1) (octadecyl vinyl ether/N-hexadecyl maleic monoamide (1/1 ratio by mole) copolymer) | 0.02 g |
| Isopar G | up to make 1.0 liter |

The resulting electrophotographic light-sensitive material (hereinafter, simply referred to as light-sensitive material sometimes) was charged to 700 V with a corona discharge in a dark place and exposed to light using a semiconductor laser having an oscillation wavelength of 780 nm at an irradiation dose of 25 erg/cm$^2$ on the surface of light-sensitive material in a negative mirror image mode on the basis of digital image data on an information for yellow. The residual potential of the exposed areas was 120 V. The exposed light-sensitive material was subjected to development using a liquid developer prepared by diluting a yellow toner for an electrostatic color plotter (Versateck 3000 manufactured by Xerox Corp.) with 50-fold Isopar H in a developing device having a pair of flat development electrodes while applying a bias voltage of 300 V to the electrode on the side of the light-sensitive material to thereby electrodeposite yellow toner particles on the unexposed areas. The light-sensitive material was then rinsed in a bath of Isopar H alone to remove stains in the non-image areas.

The above procedure was repeated using each information for magenta, cyan and black in place of the information for yellow.

The light-sensitive material having yellow, magenta, cyan and black toner images on the transfer layer thereof was brought into contact with coated paper as a receiving material and they were passed between a pair of rubber rollers which were in contact with each other under a pressure of 10 kgf/cm$^2$ and whose surface temperature was constantly maintained at 85° C. at a transportation speed of 10 mm/sec.

After cooling the both materials while being in contact with each other to room temperature, the coated paper was stripped from the light-sensitive element thereby obtaining a color duplicate. As a result of visual evaluation of the color duplicate using an optical microscope of 200 magnifications, it was clear and neither defect in the toner image areas nor background stain in the non-image areas was observed. Further, strength of the images was sufficiently high and the images did not fall off when they were rubbed.

For comparison, the same procedure as above was repeated except that the transfer layer was formed without the treatment with Compound (S-1). At the step of transfer onto coated paper, the transfer layer did not completely released from the light-sensitive element and break of the coated paper even occurred.

For another comparison, the same procedure as above was repeated except that the transfer layer was not formed after the treatment for impartation of releasability to the surface of light-sensitive element. Many cuttings of the image were observed on coated paper and also a lot of residual toner image was found on the surface of light-sensitive material. The color duplicate obtained was practically unusable.

From these results, it can be seen that the method of forming a color image wherein the releasability is imparted on the surface of light-sensitive element, the transfer layer is formed thereon and the toner images are transferred together with the transfer layer is excellent in complete reproduction of images without defect of duplicated images.

EXAMPLE A-2

Color images were formed on coated paper in the same manner as in Example A-1, except for replacing the means for imparting releasability to the surface of light-sensitive element with the following method. Specifically, a metering roll having a silicone rubber layer on the surface thereof was brought into contact with a bath containing an oil of Compound (S-2) shown below on one side and with the light-sensitive element on the other side and they were rotated at a circumferential speed of 15 mm/sec for 20 seconds. The adhesive strength of the surface of resulting light-sensitive element was 5 g·f.

Compound (S-2)

Carboxy-modified silicone oil (TSF 4770 manufactured by Toshiba Silicone Co., Ltd.)

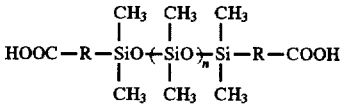

Further, a transfer roll having a styrene-butadiene layer on the surface thereof was placed between the metering roll dipped in the silicone oil bath of Compound (S-2) and the light-sensitive element, and the treatment was conducted in the same manner as above. Good releasability of the surface of light-sensitive element similar to the above was obtained.

Figure 5:
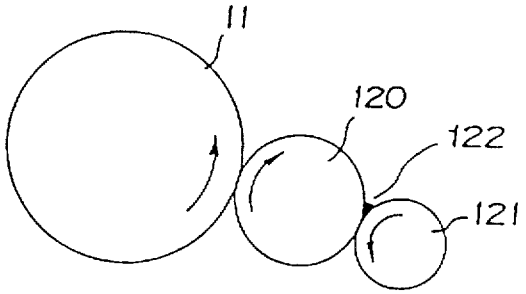
FIG. 5 is a schematic view of a device for applying the compound (S).

Moreover, Compound (S-2) was supplied between the metering roll 121 and the transfer roll 120 as shown in FIG. 5 and the treatment was conducted in the same manner as above. Again, good result similar to the above was obtained.

EXAMPLE A-3

Color images were formed on coated paper in the same manner as in Example A-1, except for replacing the means for imparting releasability to the surface of light-sensitive element with the following method. Specifically, an AW-treated felt (material: wool having a thickness of 15 mm and a width of 20 mm) impregnated uniformly with 2 g of Compound (S-3), i.e., dimethyl silicone oil KF-96L-2.0 (manufactured by Shin-Etsu Silicone Co., Ltd.) was pressed under a pressure of 200 g on the surface of light-sensitive element and the light-sensitive element was rotated at a circumferential speed of 20 mm/sec for 30 seconds. The adhesive strength of the surface of light-sensitive element thus-treated was 10 g·f. The final color images on coated paper thus-obtained were good similar to those in Example A-1.

EXAMPLE A-4

Color images were formed on coated paper in the same manner as in Example A-1, except for replacing the means for imparting releasability to the surface of light-sensitive element with the following method. Specifically, a rubber roller having a heating means integrated therein and covered with cloth impregnated with Compound (S-4), i.e., fluorine-containing surface active agent (Sarflon S-141 manufactured by Asahi Glass Co., Ltd.) was heated to a surface temperature of 60° C., then brought into contact with the light-sensitive element and they were rotated at a circumferential speed of 20 mm/sec for 30 seconds. The adhesive strength of the surface of light-sensitive element thus-treated was 12 g·f. The final color images on coated paper thus-obtained were good similar to those in Example A-1.

EXAMPLE A-5

Color images were formed on coated paper in the same manner as in Example A-1, except for replacing the means for imparting releasability to the surface of light-sensitive element with the following method. Specifically, a silicone rubber roller comprising a metal axis covered with silicone rubber (manufactured by Kinyosha K.K.) was pressed on the light-sensitive element at a nip pressure of 500 g·f/cm$^2$ and rotated at a circumferential speed of 15 mm/sec for 10 seconds. The adhesive strength of the surface of light-sensitive element thus-treated was 48 g·f. The final color images on coated paper thus-obtained were good similar to those in Example A-1.

EXAMPLE A-6

Color images were formed on coated paper in the same manner as in Example A-1, except for forming a transfer layer of a double-layered structure shown below on the surface of electrophotographic light-sensitive element in place of the transfer layer formed using Dispersion of Positively Charged Resin Grains (L-1).

Formation of Transfer Layer

Using Dispersion of Resin Grains (L-2) prepared by adding 6 g (solid basis) of Resin Grain (A-2), 0.02 g of Positive-Charge Control Agent (CD-1) described above and 10 g of branched octadecyl alcohol (FOC-1800 manufactured by Nissan Chemical Industries, Ltd.) to Isopar G to make one liter, a first transfer layer having a thickness of 3 μm was formed on the surface of electrophotographic light-sensitive element.

Using Dispersion of Resin Grains (L-3) prepared in the same manner as in Dispersion of Resin Grains (L-2) above except for replacing 6 g of Resin Grain (A-2) with 6 g (solid basis) of Resin Grain (A-39), a second transfer layer having a thickness of 1 μm was formed on the first transfer layer.

The final color images on coated paper thus-obtained were good similar to those in Example A-1.

EXAMPLE A-7

Figure 2:
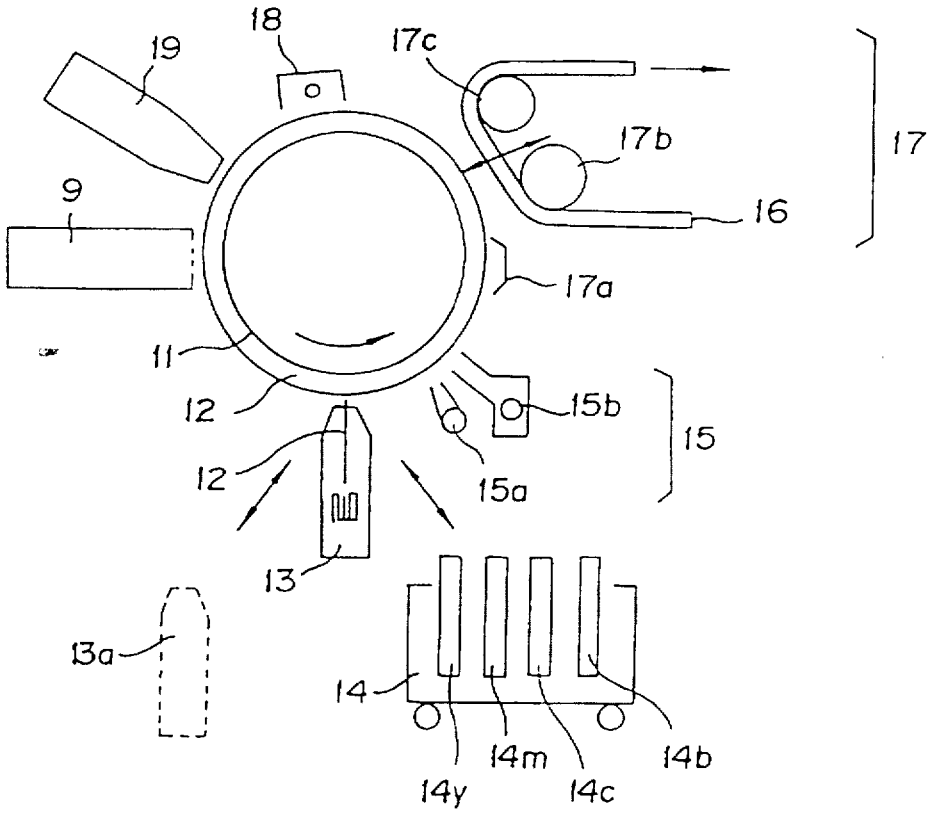
FIG. 2 is a schematic view of an apparatus for forming a color transfer image using the hot-melt coating method for the formation of transfer layer.

An amorphous silicon light-sensitive element was installed as an electrophotographic light-sensitive element in an apparatus as shown in FIG. 2. Impartation of releasability to the surface of light-sensitive element was conducted in the same manner as in Example A-1. As a result, the adhesive strength of the surface of light-sensitive element was decreased from 180 g·f to 5 g·f.

An ethylene-vinyl acetate copolymer (content of vinyl acetate: 20% by weight; softening point measured by ring and ball method: 90° C.) was coated as the resin (A) on the surface of light-sensitive element at a rate of 20 mm/sec by a hot melt coater adjusted at 120° C. and cooled by blowing cool air from a suction/exhaust unit, followed by maintaining the surface temperature of light-sensitive element at 30° C. to prepare a transfer layer having a thickness of 3 μm.

The resulting light-sensitive material was charged to +700 V with a corona discharge in a dark place and exposed to light using a semiconductor laser having an oscillation wavelength of 780 nm on the basis of digital image data on an information for yellow color separation among digital image data on informations for yellow, magenta, cyan and black color separations which had been obtained by reading an original by a color scanner, conducting several corrections relating to color reproduction peculiar to color separation system and stored in a hard disc. The potential in the exposed area was +220 V while it was +600 V in the unexposed area.

The exposed light-sensitive material was pre-bathed with Isopar H (manufactured by Esso Standard Oil Co.) by a pre-bathing means installed in a developing unit and then subjected to reversal development by supplying a liquid developer prepared by diluting a positively charged yellow toner for an electrostatic color plotter (Versateck 3000 manufactured by Xerox Corp.) with 50-fold Isopar H from the developing unit to the surface of light-sensitive material while applying a bias voltage of +500 V to the developing unit side to thereby electrodeposite yellow toner particles on the unexposed areas. The light-sensitive material was then rinsed in a bath of Isopar H alone to remove stains in the non-image areas and dried by a suction/exhaust unit.

The above procedure was repeated using each information for magenta, cyan and black in place of the information for yellow.

The light-sensitive material having yellow, magenta, cyan and black toner images on the transfer layer thereof was passed under an infrared line heater to maintain a surface temperature thereof measured by a radiation thermometer at about 80° C. and brought into contact with coated paper as a receiving material and they were passed between a pair of heating rubber rollers which were in contact with each other under a pressure of 10 kgf/cm$^2$ and whose surface temperature was constantly maintained at 120° C. at a transportation speed of 15 mm/sec.

After cooling the sheets while being in contact with each other by passing under a cooling roller, the coated paper was stripped from the light-sensitive element whereby the toner images on the light-sensitive material were wholly heat-transferred together with the transfer layer onto the coated paper. Further, the toner images were completely covered with the resin of transfer layer on the coated paper and thus they did not fall off when they were rubbed.

EXAMPLE A-8

Figure 3:
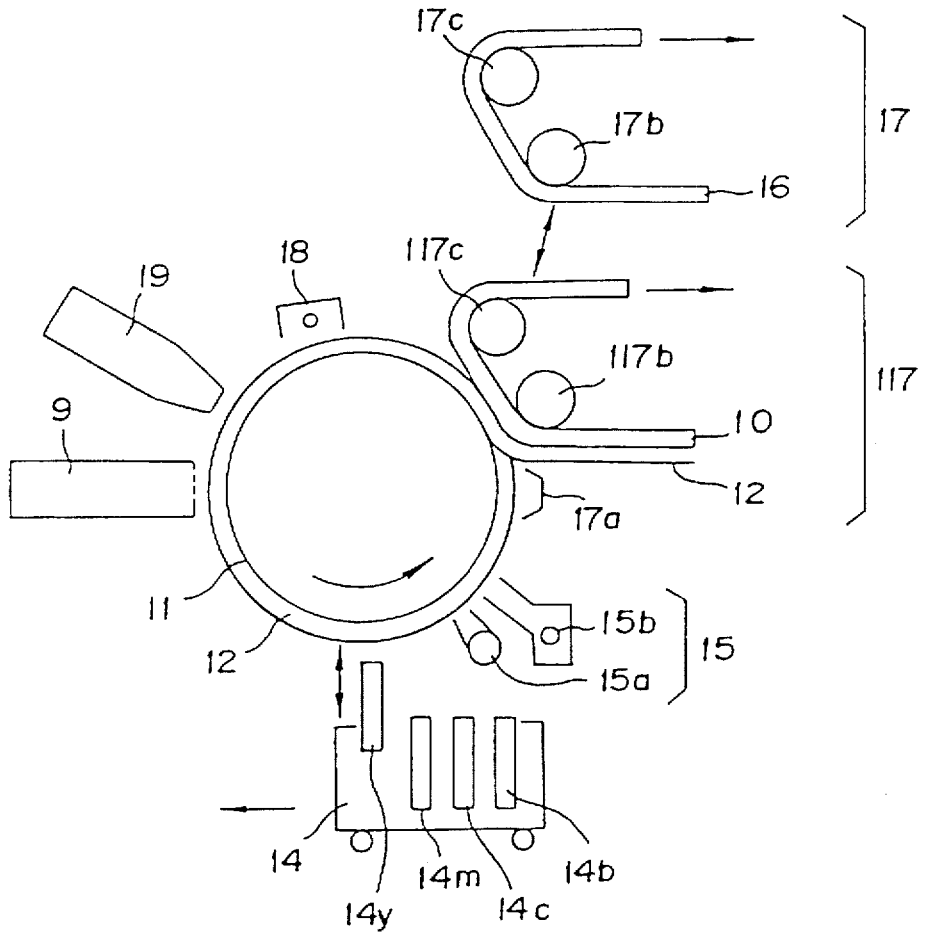
FIG. 3 is a schematic view of an apparatus for forming a color transfer image using the transfer method for the formation of transfer layer.

The amorphous silicon electrophotographic light-sensitive element same as in Example A-7 was installed in an apparatus as shown in FIG. 3, and impartation of releasability to the surface of light-sensitive element was conducted in the same manner as in Example A-1.

The formation of transfer layer on the light-sensitive element was performed by the transfer method from release paper. Specifically, on Separate Shi (manufactured by Oji Paper Co., Ltd.) as release paper, was coated a mixture of poly(vinyl acetate) having a glass transition point of 38° C. and poly(phenetylmethacrylate) having a glass transition point of 45° C. (5:5 by weight) to prepare a transfer layer having a thickness of 3 μm. The resulting paper was brought into contact with the light-sensitive element whereby the transfer layer was transferred from the release paper onto the surface of light-sensitive element.

The resulting light-sensitive element was subjected to the formation of color image and transfer onto coated paper in the same manner as in Example A-7 to form a color duplicate. The color images obtained on coated paper were good and free from stain and had excellent strength similar to those in Example A-7.

EXAMPLES A-9 TO A-24

The procedure for the formation of color image same as in Example A-7 was repeated except that each of the resins shown in Table H below was used in place of the ethylene-vinyl acetate copolymer used in the transfer layer of Example A-7. Similar results to those in Example A-7 were obtained. A softening point of each of the resins in Table H was in a range of from 35° C. to 100° C.

TABLE H

| Example | Thermoplastic Resin |
|---|---|
| A-9 | Cellulose Acetate Butyrate (Cellidor Bsp manufactured by Bayer AG) |
| A-10 | Polyvinyl Butyral Resin (S-Lec manufactured by Sekisui Chemical Co., Ltd.) |
| A-11 | Cellulose Propionate (Cellidoria manufacture Daicel Co., Ltd.) |
| A-12 | Polyvinyl Acetate |
| A-13 | Mixture of Vinyl Acetate/Crotonic Acid (99/1 by weight) Copolymer and Cellidor Bsp (8/2 by weight) |
| A-14 | Methyl Methacrylate/Methyl Acrylate (60/40 by weight) Copolymer |
| A-15 | Polypropyl Methacrylate |
| A-16 | Mixture of Polyvinyl Methyl Ether and Polyvinyl Acetate (5/5 by weight) |

TABLE H-continued

| Example | Thermoplastic Resin |
|---|---|
| A-17 | Styrene/Butadiene Copolymer (Sorprene 1204 manufactured by Asahi Kasei Kogyo K.K.) |
| A-18 | Mixture of Styrene/Butadiene Copolymer (Sorprene 1204) and Polyvinyl Acetate (2/3 by weight) |
| A-19 | Polydecamethylene Terephthalate |
| A-20 | Polydecamethylene Isophthalate |
| A-21 | Styrene/Vinyl Acetate (20/80 by weight) Copolymer |
| A-22 | Polyhexamethylene Succinate |
| A-23 | Poly-4-methylpentene-1 |
| A-24 | Polypentamethylene Carbonate |

EXAMPLE A-25

Color images were formed on coated paper in the same manner as in Example A-1, except for replacing Dispersion of Positively Charged Resin Grains (L-1) for Dispersion of Resin Grains (L-4) shown below.

| Dispersion of Resin Grains (L-4) | |
|---|---|
| Resin Grain (A-39) (a glass transition point of the resin being 18° C.) | 4 g (solid basis) |
| Resin Grain (A-2) (a glass transition point of the resin being 55° C.) | 4 g (solid basis) |
| Charge Control Agent (CD-2) (1-tetradecene/N-dodecyl maleic monoamide (1/1 ratio by mole) copolymer | 0.02 g |
| Branched Tetradecyl Alcohol (FOC-1400 manufactured by Nissan Chemical Industries, Ltd.) | 10 g |
| Isopar G | up to make 1.0 liter |

The color images obtained on coated paper had clear image free from background stain and sufficient image strength.

Further, the transfer procedure of toner image from the light-sensitive element to coated paper was conducted under condition of lower temperature and higher transportation speed as follows:

Surface temperature of heating roller: 70° C.

Circumferential speed of the drum: 20 mm/sec

The color images obtained on coated paper according to the transfer procedure under the condition as described above were also good. Also, the residue of transfer layer was not observed at all on the surface of light-sensitive element after the transfer procedure.

These results illustrate that transfer of the transfer layer can be easily performed using the transfer layer composed of the resin (A) having a low glass transition point and the resin (A) having a high glass transition point. As a result, a reduced capacity of heating means in the transfer device due to the moderation of transfer condition and an increased speed in the whole system due to the increase in transfer speed can be achieved.

EXAMPLES A-26 TO A-35

Color images were formed in the same manner as in Example A-25 except for using each of the resin grains (AL) having a low glass transition point and each of the resin grains (AH) having a high glass transition point at a weight ratio shown in Table I below in the total amount of 8 g in place of 4 g of Resin Grain (A-39) and 4 g of Resin Grain (A-2) in Dispersion of Resin Grain (L-4) employed in Example A-25.

TABLE I

| Example | Resin Grain (A) | Weight Ratio |
|---|---|---|
| A-26 | A-2/A-39 | 4/6 |
| A-27 | A-4/A-40 | 5/5 |
| A-28 | A-5/A-41 | 6/4 |
| A-29 | A-11/A-42 | 7/3 |
| A-30 | A-12/A-43 | 4/6 |
| A-31 | A-51/A-45 | 5/5 |
| A-32 | A-28/A-46 | 8/2 |
| A-33 | A-29/A-49 | 5/5 |
| A-34 | A-31/A-48 | 4/6 |
| A-35 | A-32/A-50 | 4/6 |

The color duplicates obtained had clear image free from background stain. Specifically, the toner images formed on the light-sensitive material had excellent image forming property of good image reproducibility and no fog in the non-image portion, and were wholly transferred together with the transfer layer to coated paper without the formation of unevenness. Further, the color duplicates obtained were held between various polymer sheets for filing and allowed to pile one on another. As a result, cutting of color images based on peeling of image portions due to adhesion of the color duplicates onto the polymer sheets did not occur. Moreover, retouch and seal were conducted on the color duplicates same as on conventional paper.

EXAMPLES A-36 TO A-45

Color duplicates were prepared in the same manner as in Example A-6 except for using each of the resin grains for the first transfer layer and second transfer layer shown in Table J below in place of Resin Grain (A-2) in Dispersion of Resin Grains (L-2) and Resin Grain (A-39) in Dispersion of Resin Grains (L-3) employed in Example A-6, respectively. The total thickness of the first and second transfer layers was 5 μm.

TABLE J

| Example | Resin Grain First Transfer Layer/ Second Transfer Layer | Thickness Ratio First Transfer Layer/ Second Transfer Layer |
|---|---|---|
| A-36 | A-4/A-39 | 6/4 |
| A-37 | A-5/A-39 | 6/4 |
| A-38 | A-11/A-45 | 7/3 |
| A-39 | A-12/A-46 | 5/5 |
| A-40 | A-51/A-44 | 7/3 |
| A-41 | A-28/A-39 | 5/5 |
| A-42 | A-29/A-50 | 6/4 |
| A-43 | A-30/A-40 | 7/3 |
| A-44 | A-31/A-41 | 5/5 |
| A-45 | A-33/A-42 | 6/4 |

The evaluation on various characteristics with each of the color duplicates was conducted in the same manner as in Example A-6. Good results similar to those in Example A-6 were obtained. Specifically, the color duplicates had clear images free from background stain and exhibited good aptitudes for filing, retouching and sealing.

EXAMPLES A-46 TO A-52

Color images were formed on coated paper in the same manner as in Example A-8 except that the formation of transfer layer was performed in the following manner.

Formation of Transfer Layer

Figure 4:
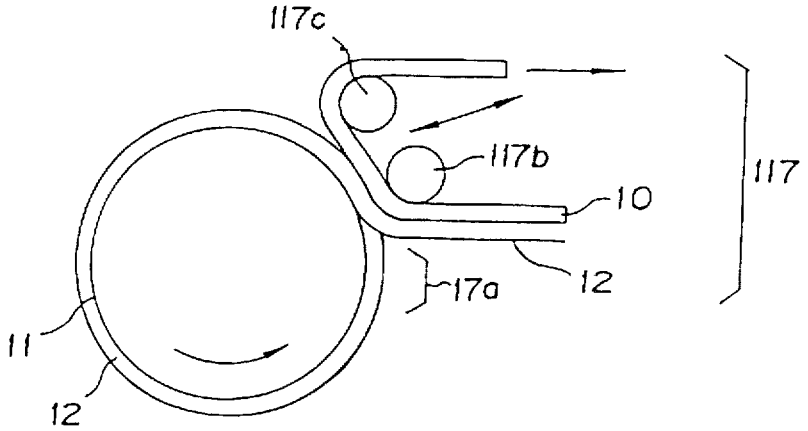
FIG. 4 is a schematic view of a device for the formation of transfer layer utilizing release paper.

On release paper (Sanrelease manufactured by Sanyo-Kokusaku Pulp Co., Ltd.) was provided a transfer layer having a thickness of 4 μm composed of each of the resins (A) shown in Table K below. The resulting paper was installed in a heat transfer means 117 of a device shown in FIG. 4 and the transfer layer was peeled from the release paper and transferred onto the surface of light-sensitive element under conditions of a nip pressure of the rollers of 3 kgf/cm$^2$, a surface temperature of 80° C. and a transportation speed of 10 mm/sec. A glass transition point of each of the resins (A) shown in Table K was not more than 80° C.

TABLE K

| Example | Resin (A) |
|---|---|
| A-46 | Mixture of Vinyl Acetate/Vinyl Butyrate (8/2 by weight) Copolymer and Benzyl Methacrylate/Methyl Methacrylate (8/2 by weight) Copolymer (60/40 by weight) |
| A-47 | 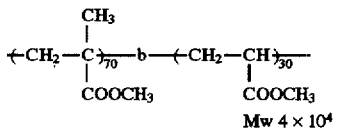 Mw $4 \times 10^4$ |
| A-48 | 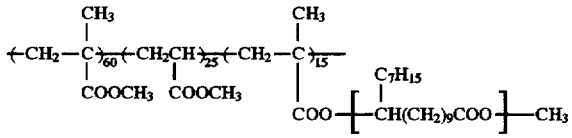 Mw $4 \times 10^4$ (Mw of graft portion $4 \times 10^3$) |
| A-49 | 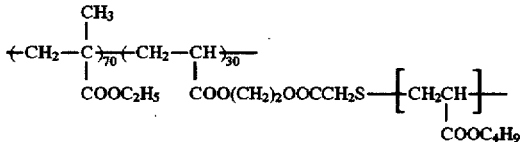 Mw $4 \times 10^4$ (Mw of graft portion $6 \times 10^3$) |

TABLE K-continued

| Example | Resin (A) |
|---|---|
| A-50 | Mixture of Vinyl Acetate/Vinyl Propionate (7/3 by weight) Copolymer and Evaflex ® 420 (70/30 by weight) |
| A-51 | Mixture of 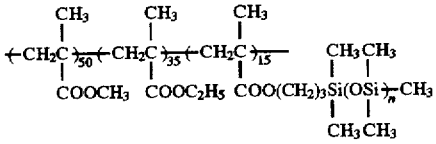 Mw $5\times10^4$ (Mw of graft portion $1\times10^4$) and Polyvinyl Acetate (40/60 by weight) |
| A-52 | 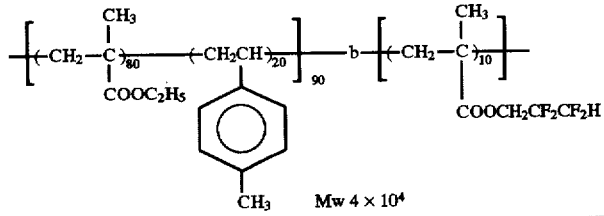 Mw $4\times10^4$ |

The color images obtained were clear and free from background stain, and degradation of image quality was not substantially observed when compared with the original.

These results illustrate that in a case wherein a transfer layer is formed on the surface of light-sensitive element using release paper and transferred onto coated paper after the formation of toner image thereon, the transfer layer is uniformly and completely transferred at each transfer step without any adverse effect on image quality.

EXAMPLE A-53

5 g of 4,4'-bis(diethylamino)-2,2'-dimethyltriphenylmethane as an organic photoconductive substance, 4 g of Binder Resin (B-2) having the structure shown below, 40 mg of Dye (D-2) having the structure shown below, and 0.2 g of Anilide Compound (B) having the structure shown below as a chemical sensitizer were dissolved in a mixed solvent of 30 ml of methylene chloride and 30 ml of ethylene chloride to prepare a dispersion for light-sensitive layer.

Binder Resin (B-2)

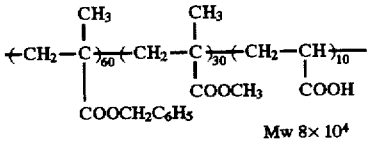

Mw $8\times10^4$

Dye (D-2)

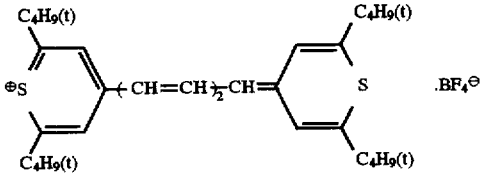

-continued

Anilide Compound (B)

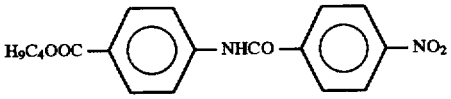

The resulting dispersion for light-sensitive layer was coated on a conductive transparent substrate composed of a 100 μm-thick polyethylene terephthalate film having a deposited layer of indium oxide thereon (surface resistivity: $10^3$ Ω) by a wire round rod to prepare a light-sensitive element having an organic light-sensitive layer having a thickness of about 4 μm.

Using the resulting light-sensitive element in place of the light-sensitive element employed in Example A-1, the same procedure as in Example A-1 was repeated to prepare transferred images. The color images obtained on coated paper were clear and free from background stain and the image strength thereof was also good.

EXAMPLE A-54

A mixture of 100 g of photoconductive zinc oxide, 15 g of Binder Resin (B-4) having the structure shown below, 5 g of Binder Resin (B-5) having the structure shown below, 0.01 g of Dye (D-1) having the structure shown below, 0.1 g of salicylic acid and 150 g of toluene was dispersed in a ball mill for 2 hours to prepare a dispersion for light-sensitive layer.

Binder Resin (B-4)

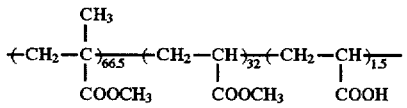

Mw $6.8 \times 10^4$

Binder Resin (B-5)

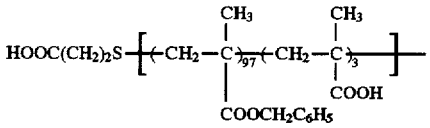

Mw $8 \times 10^3$

Dye (D-1)

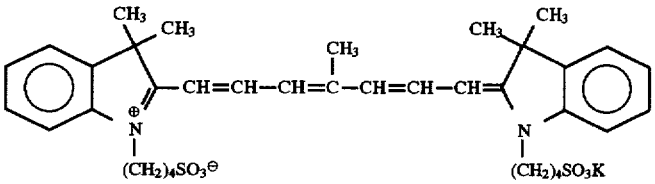

The resulting dispersion was coated on base paper for a paper master having a thickness of 0.2 mm, which had been subjected to electrically conductive treatment and solvent-resistant treatment, by a wire bar, set to touch, heated in a circulating oven at 110° C. for 20 seconds and allowed to stand in a dark place under conditions of −25° C. and 65% RH for 24 hours.

On the surface of the resulting light-sensitive element was formed a transfer layer in the same manner as in Example A-1.

The resulting light-sensitive material was charged to −600 V with a corona discharge in dark and exposed to light using a semiconductor laser having an oscillation wavelength of 780 nm at an irradiation dose of 25 erg/cm$^2$ on the surface of light-sensitive material in a positive mirror image mode based on the digital image data same as those in Example A-1. The residual potential of the exposed areas was −120 V. The exposed light-sensitive material was subjected to normal development using a liquid developer prepared by diluting a yellow toner for an electrostatic color plotter (Versateck 3000 manufactured by Xerox Corp.) with 50-fold Isopar H in a developing device having a pair of flat development electrodes with a bias voltage of −200 V being applied to the electrode on the light-sensitive material side to thereby electrodeposit the toner particles on the non-exposed areas. The light-sensitive material was then rinsed in a bath of Isopar H alone to remove stains on the non-image areas.

The above procedure was repeated using each information for magenta, cyan and black in place of the information for yellow.

The transfer layer having color images formed thereon was transferred on coated paper as a receiving material. The color images obtained on coated paper were clear and free from background stain and the image strength thereof was also good.

EXAMPLE A-55

A mixture of 5 g of a bisazo pigment having the structure shown below, 5 g of a polyester resin (Vylon 200 manufactured by Toyobo Co., Ltd.) and 95 g of tetrahydrofuran was thoroughly pulverized in a ball mill. The mixture was added to 520 g of tetrahydrofuran with stirring. The resulting dispersion was coated on a conductive transparent substrate as described in Example A-53 by a wire round rod to prepare a charge generating layer having a thickness of about 0.7 μm.

Bisazo Pigment

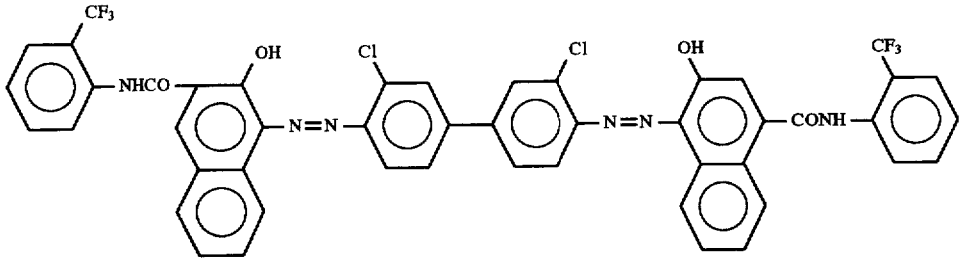

A mixed solution of 20 g of the hydrazone compound having the structure shown below, 20 g of a polycarbonate resin (Lexan 121 manufactured by General Electric Co., Ltd.) and 160 g of tetrahydrofuran was coated on the above-described charge generating layer by a wire round rod, dried at 60° C. for 30 seconds and then heated at 100° C. for 20 seconds to form a charge transporting layer having a thickness of about 18 μm whereby an electrophotographic light-sensitive element having a light-sensitive layer of a double-layered structure was prepared.

Hydrazone Compound

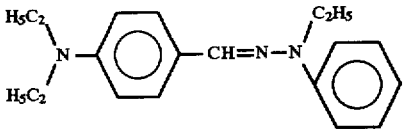

On the surface of the resulting electrophotographic light-sensitive element was formed a transfer layer in the same manner as in Example A-1.

Using the resulting light-sensitive material, a color duplicate was prepared in the same manner as in Example A-1 except for charging to +500 V of a surface potential in dark and exposing to light using a He—Ne laser having an oscillation wavelength of 633 nm at an irradiation dose on the surface of light-sensitive material of 30 erg/cm$^2$. The color images obtained on coated paper were clear and free from background stain. Further, strength of the images was sufficiently high and the images did not fall off when they were rubbed.

EXAMPLES A-56 TO A-76

Each color duplicate was prepared in the same manner as in Example A-1 except for using each of the compounds (S) shown in Table L below in place of Compound (S-1) employed in Example A-1.

TABLE L

| Example | Compound (S) | | Amount (g/l) |
|---|---|---|---|
| A-56 | (S-5) Polyether-modified silicone (TSF 4446 manufactured by Toshiba Silicone Co., Ltd.) $CH_3$—Si(CH$_3$)(CH$_3$)O(Si(CH$_3$)(CH$_3$)O)$_x$(Si(CH$_3$)(POA)O)$_y$Si(CH$_3$)(CH$_3$)—$CH_3$ (presumptive structure) | POA:polyoxyalkylene comprising ethylene oxide (EO) and propylene oxide(PO) (EO/PO: 100/0 by mole) | 0.5 |
| A-57 | (S-6) Polyether-modified silicone (TSF 4453 manufactured by Toshiba Silicone Co., Ltd.) $CH_3$—Si(CH$_3$)(CH$_3$)O(Si(CH$_3$)(CH$_3$)O)$_x$(Si(CH$_3$)(POA)O)$_y$Si(CH$_3$)(CH$_3$)—$CH_3$ (presumptive structure) | POA portion (EO/PO: 75/25 by mole) | 0.8 |
| A-58 | (S-7) Polyether-modified silicone (TSF 4460 manufactured by Toshiba Silicone Co., Ltd.) $CH_3$—Si(CH$_3$)(CH$_3$)O(Si(CH$_3$)(CH$_3$)O)$_x$(Si(CH$_3$)(POA)O)$_y$Si(CH$_3$)(CH$_3$)—$CH_3$ (presumptive structure) | POA portion (EO/PO: 0/100 by mole) | 0.5 |
| A-59 | (S-8) Higher fatty acid-modified silicone (TSF 411 manufactured by Toshiba Silicone Co., Ltd.) | | |

TABLE L-continued

| Example | Compound (S) | Amount (g/l) |
|---|---|---|
| | $R'OCORSiO(SiO)_nSiRCOOR'$ (presumptive structure) | 1.0 |
| A-60 | (S-9) Epoxy-modified silicone (XF42-A5041 manufactured by Toshiba Silicone Co., Ltd.) $(CH_3)_3SiO(SiO)_x(SiO)_y(SiO)_zSi(CH_3)$ (presumptive structure) | 1.2 |
| A-61 | (S-10) Fluorine containing oligomer (Sarflon S-382 manufacturd by Asahi Glass Co., Ltd.) (structure unknown) | 0.3 0.3 |
| A-62 | (S-11) $(CH_2-C(COOC_8H_{17}))_{60}-b-(CH_2C(COO(CH_2)_2C_8F_{17}))_{40}$ Mw $6\times10^3$ | 1.5 |
| A-63 | (S-12) $(CH_2-C(COO(CH_2)_3Si(OSi(CH_3)_3)-CH_3))_{75}(CH_2-C(COO(CH_2)_2S-[CH_2CH(COO(CH_2CH_2O)_2OCH_3)]-))_{25}$ Mw $8\times10^3$ (Mw of graft portion $3\times10^3$) | 2 |
| A-64 | (S-13) $R_fO(C_2H_4O)_m(C_3H_6O)_mH$ $R_f$: $C_8F_{17}$–$C_{12}F_{25}$ | 0.1 |
| A-65 | (S-14) $CH_2OCOC_8F_{17}$ / $CHOH$ / $CH_2OCOC_8F_{17}$ | 0.5 |
| A-66 | (S-15) $R_fC_2H_4OOCCH_2$ / $R_fC_2H_4OOC-COOCNHC_6H_{12}NHCOOC-COOC_2H_4R_f$ / $R_fC_2H_4OOCCH_2$; $CH_2COOC_2H_4R_f$ / $CH_2COOC_2H_4R_f$ $R_f$: $C_4F_9$ | 0.3 |
| A-67 | (S-16) $SH$ / $CHCOOC_8H_{17}$ / $CH_2COOC_2H_4C_{10}F_{21}$ | 1.0 |
| A-68 | (S-17) $(SiO(CH_3))_a(SiO(C_2H_4CF_3))_b(SiO(C_3H_6(OC_2H_4)_nOH))_c$ | 0.5 |
| A-69 | (S-18) $F(CF(CF_3)CF_2O)_n(C_3H_6O)_mCH_3$ | 0.4 |
| A-70 | (S-19) Carboxy-modified silicone (X-22-3701E manufactured by Shin-Etsu Silicone Co., Ltd.) | |

TABLE L-continued

| Example | Compound (S) | Amount (g/l) |
|---|---|---|
| | 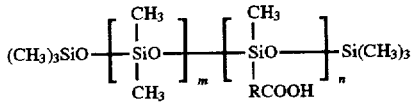 (presumptive structure) | 0.5 |
| A-71 | (S-20) Carbinol-modified silicone (X-22-176B manufactured by Shin-Etsu Silicone Co., Ltd.) 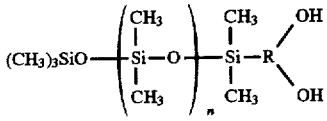 (presumptive structure) | 1.0 |
| A-72 | (S-21) Mercapto-modified silicone (X-22-167B manufactured by Shin-Etsu Silicone Co., Ltd.) 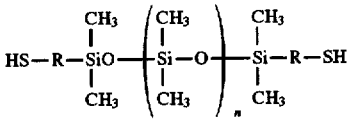 (presumptive structure) | 2 |
| A-73 | (S-22) Amino-modified silicone (KF-804 manufactured by Shin-Etsu Silicone Co., Ltd.) 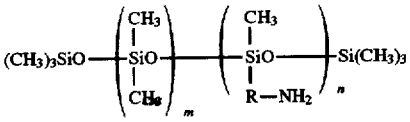 (presumptive structure) | 2.5 |
| A-74 | (S-23) 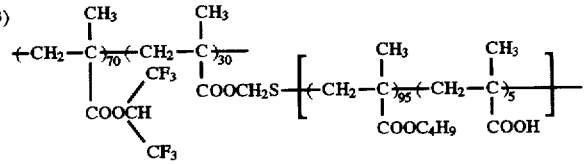 Mw $1\times10^4$ (Mw of graft portion $6\times10^3$) | 5 |
| A-75 | (S-24) 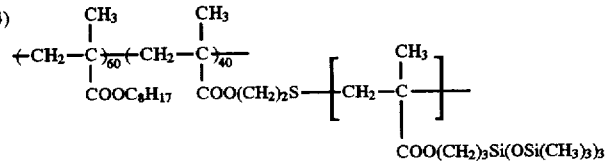 Mw $8\times10^4$ (Mw of graft portion $4\times10^3$) | 10 |
| A-76 | (S-25) 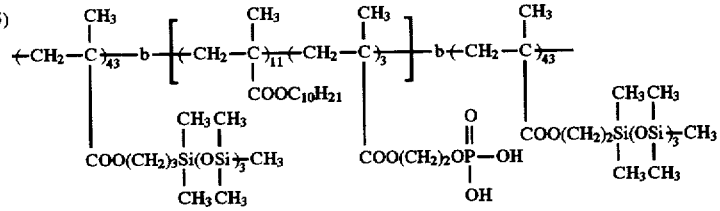 Mw $1.5\times10^4$ | 8 |

With each of the examples, the transferability of transfer layer was excellent same as in Example A-1 and degradation of toner image due to unevenness in transfer was not observed. Also, image quality of each color duplicate obtained was good same as in Example A-1.

EXAMPLE A-77

A transfer layer having a thickness of 2.5 μm was provided on a light-sensitive element in the same manner as in Example A-1 except for using. 8 g (solid basis) of Resin Grain (A-52) in place of 8 g of Resin Grain (A-1) used in Dispersion of Positively Charged Resin Grains (L-1) of Example A-1 and charging an electric voltage applied at the electrodeposition to −120 V.

Four color toner images were formed on the electrophotographic light-sensitive material in the same manner as in Example A-1. The color images were transferred onto coated paper under conditions of the pressure of 4 Kgf/cm$^2$, the temperature of 60° C. and the transportation speed of 100 mm/sec. The color images obtained on coated paper exhibited the excellent characteristics same as in Example A-1. These results demonstrate that the pressure and temperature for transfer are reduced and in addition the transportation speed is greatly increased by employing the resin grains of core/shell type.

EXAMPLE B-1

A mixture of 2 g of X-form metal-free phthalocyanine (manufactured by Dainippon Ink and Chemicals, Inc.), 10 g of Binder Resin (B-6) having the structure shown below, 0.15 g of Compound (X) having the structure shown below, and 80 g of tetrahydrofuran was put into a 500 ml-volume glass container together with glass beads and dispersed in a paint shaker (manufactured by Toyo Seiki Seisakusho Co.) for 60 minute were separated ads were separated by filtration to prepare a dispersion for a light-sensitive layer.

Binder Resin (B-6)

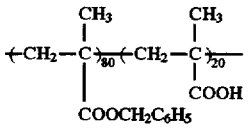

Mw 3.5 × 10$^4$

Compound (X)

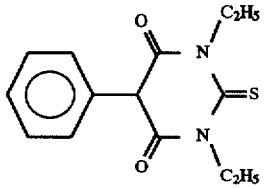

The resulting dispersion was coated on base paper for a paper master having a thickness of 0.2 mm, which had been subjected to electrically conductive treatment and solvent-resistant treatment, by a wire bar, set to touch, and heated in a circulating oven at 100° C. for 20 seconds to form a light-sensitive layer having a thickness of 8 μm. The adhesion strength of the surface of the resulting electrophotographic light-sensitive element was 400 g·f.

Figure 6:
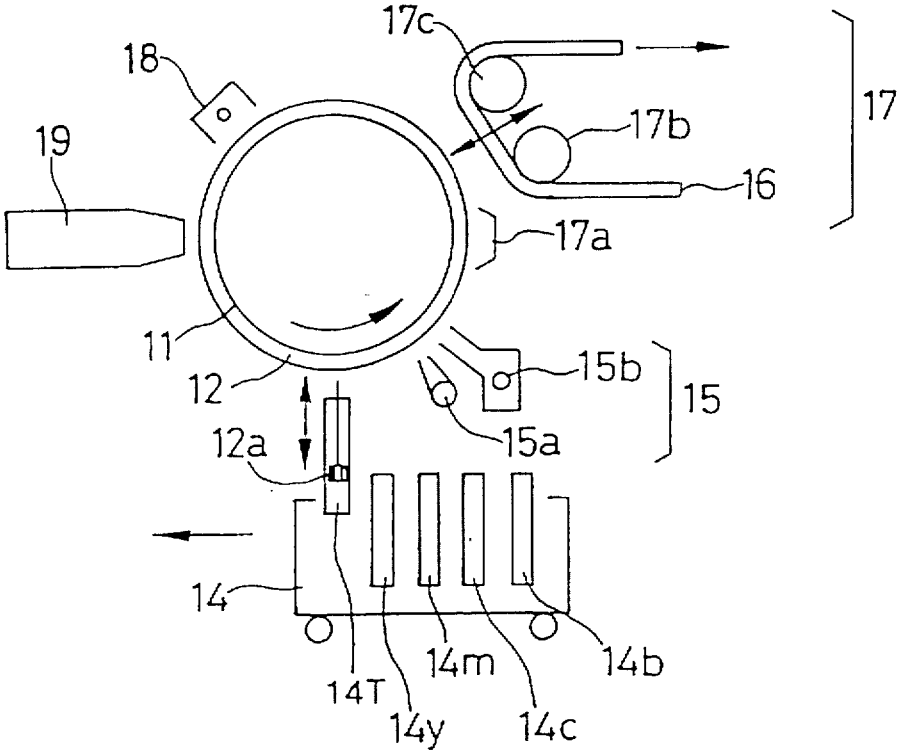
FIG. 6 is a schematic view of an apparatus for forming a color transfer image using the electrodeposition coating method for the formation of transfer
Figure 7:
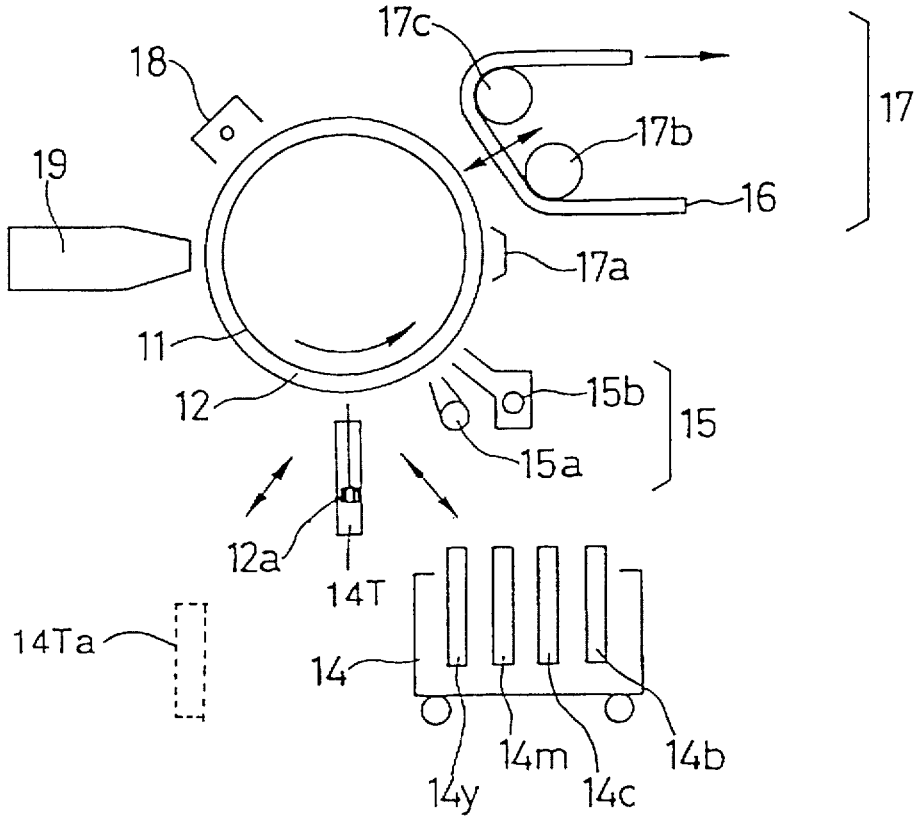
FIG. 7 is a schematic view of an apparatus for a color transfer image using the electrodeposition coating method for the formation of transfer layer.

The light-sensitive element was installed as an electrophotographic light-sensitive element in an apparatus as shown in FIG. 6. On the surface of light-sensitive element installed on a drum which was rotated at a circumferential speed of 10 mm/sec, Dispersion of Resin Grains (L-101) for electrodeposition shown below was supplied using a slit electrodeposition device, while putting the light-sensitive element to earth and applying an electric voltage of −180 V to an electrode of the slit electrodeposition device, whereby the resin grains were electrodeposited. The dispersion medium was removed by air-squeezing, and the resin grains were fused by an infrared line heater to form a film, whereby a transfer was prepared on the light-sensitive element. A thickness of the transfer layer was 3 μm.

| Dispersion of Resin Grains (L-101) | |
|---|---|
| Resin Grain (A-1) | 6 g (solid basis) |
| Compound (S-1) | 0.5 g |
| Positive-Charge Control Agent (CD-3) (octadecyl vinyl ether/N-dodecyl maleic monoamide (1/1 ratio by mole) copolymer) | 0.02 g |
| Branched Tetradecyl Alcohol (FOC-1400 manufactured by Nissan Chemical Industries, Ltd.) | 10 g |
| Isopar H (manufactured by Esso Standard Oil Co.) | 1 liter |

The adhesive strength of the transfer layer measured according to the method described above was 6 g·f and the whole transfer layer was uniformly peeled from the surface of light-sensitive element.

The resulting light-sensitive material was charged to +450 V with a corona discharge in dark and exposed to light using a gallium-aluminum-arsenic semiconductor laser (output: 5 mW; oscillation wavelength: 780 nm) at an irradiation dose of 30 erg/cm$^2$ on the surface of the light-sensitive material, a pitch of 25 μm, and a scanning speed of 300 cm/sec in a negative mirror image mode based on digital image data on an information for yellow color separation among digital image data on informations for yellow, magenta, cyan and black color separations which had been obtained by reading an original by a color scanner, conducting several corrections relating to color reproduction peculiar to color separation system and stored in a hard disc.

Thereafter, the exposed light-sensitive material was subjected to reversal development using a liquid developer prepared by diluting a yellow liquid developer for Signature System (manufactured by Eastman Kodak Co.) with 75-fold by weight Isopar H (manufactured by Esso Standard Oil Co.) in a developing device having a pair of flat development electrodes while a bias voltage of +400 V was applied to the electrode on the side of the light-sensitive material to thereby electrodeposit toner particles on the exposed areas. The light-sensitive material was then rinsed in a bath of Isopar H alone to remove stains in the non-image areas.

The above procedure was repeated using each information for magenta, cyan and black in place of the information for yellow.

The light-sensitive material was then subjected to fixing by means of a heat roller whereby the toner images thus-formed were fixed. In order to determine reproducibility of duplicated images before transfer, the images were visually evaluated for fog and image quality using an optical microscope of 200 magnifications. It was found that the image quality of toner image areas was good even in highly accurate image portions such as fine lines, fine letters and dots for continuous graduation, and image density was more than 1.2 in the maximum density areas which was good. Also, no fog was observed in the non-image areas.

The light-sensitive material heaving yellow, magenta, cyan and black toner images was brought into contact with coated paper as a receiving material and they were passed between a pair of rubber rollers which were in contact with each other under a pressure of 8 kgf/cm$^2$ and whose surface temperature was constantly maintained at 80° C. at a transportation speed of 12 mm/sec.

After cooling the sheets while being in contact with each other to room temperature, the coated paper was stripped from the light-sensitive element. The color images transferred on coated paper were visually evaluated for fog and image quality in the same manner as above.

As a result it was found that the transfer layer was wholly transferred together with the toner images onto the coated paper without remaining the transfer layer on the light-sensitive element. The toner images on the coated paper was visually evaluated using an optical microscope of 200 magnifications. It was found that cutting and spreading were not observed in highly accurate image portions such as fine lines, fine letters and dots, and the reproducibility of original in the duplicate was good.

A solution prepared by dissolving 0.01 g of Compound (S-1) of the present invention in one liter of Isopar H was applied on the surface of the electrophotographic light-sensitive element described above and set to touch. As a result of measuring the adhesive strength of the surface of light-sensitive element, it was found to be 20 g·f. This fact indicates that Compound (S-1) is adsorbed on (or adheres to) the surface of light-sensitive element to impart the releasability thereto.

COMPARATIVE EXAMPLE B-1

In the same manner as in Example B-1, a transfer layer was formed on the electrophotographic light-sensitive element except for using a dispersion of resin grains prepared d by eliminating 0.5 g of Compound (S-1) from Dispersion of Resin Grains (L-101). The resulting light-sensitive material was subjected to the measurement of adhesive strength. As a result, a pressure-sensitive adhesive tape was peeled from the transfer layer and the transfer layer was not released from the light-sensitive element. This fact means that transferability of the transfer layer is not effected.

From the results shown above it can be seen that by forming the transfer layer on the surface of light-sensitive element using the dispersion for electrodeposition according to the present invention, the releasability is imparted on the surface thereof and the transfer layer adheres to a receiving material and is easily transferred thereto, whereby a full-color duplicate can be formed.

EXAMPLE B-2

An amorphous silicon light-sensitive element was installed as an electrophotographic light-sensitive element in an apparatus as shown in FIG. 6. The adhesive strength of the surface thereof was 265 g·f.

On the surface of light-sensitive element installed on a drum, whose surface temperature was adjusted to 60° C. and which was rotated at a circumferential speed of 10 mm/sec, Dispersion of Resin Grains (L-102) for electrodeposition shown below was supplied using a slit electrodeposition device, while putting the light-sensitive element to earth and applying an electric voltage of −200 V to an electrode of the slit electrodeposition device, whereby the resin grains were electrodeposited and fixed.

| Dispersion of Resin Grains (L-102) | |
|---|---|
| Resin Grain (A-4) | 6 g (solid basis) |
| Compound (S-26) shown below | 0.3 g |
| Positive-Charge Control Agent (CD-4) (zirconium naphthenate) | 0.05 g |
| Isopar G | 1.0 liter |
| Compound (S-26) | |
| Silicone surface active agent (SILWet L-722 manufactured by Nippon Unicar Co., Ltd.) | |

-continued

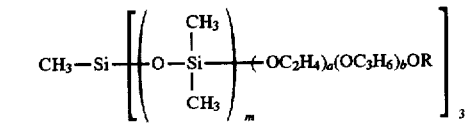

(presumptive structure)

On the resulting light-sensitive material, toner images were then formed. Specifically, the light-sensitive material was charged to 700 V with a corona discharge in a dark place and exposed to light using a semiconductor laser having an oscillation wavelength of 780 nm at an irradiation dose of 25 erg/cm$^2$ on the surface of light-sensitive material in a positive mirror image mode on the basis of digital image data on an information for yellow same as those described in Example B-1. The residual potential of the exposed areas was 120 V. The exposed light-sensitive material was subjected to development using a liquid developer prepared by diluting a yellow toner for an electrostatic color plotter (Versateck 3000 manufactured by Xerox Corp.) with 50-fold Isopar H (manufactured by Esso Standard Oil Co.) in a developing device having a pair of flat development electrodes while a bias voltage of 300 V was applied to the electrode on the side of the light-sensitive material to thereby electrodeposit toner particles on the unexposed areas. The light-sensitive material was then rinsed in a bath of Isopar H alone to remove stains in the non-image areas.

The above procedure was repeated using each information for magenta, cyan and black in place of the information for yellow.

The light-sensitive material having yellow, magenta, cyan and black toner images was brought into contact with coated paper as a receiving material and they were passed between a pair of rubber rollers which were in contact with each other under a pressure of 10 kgf/cm$^2$ and whose surface temperature was constantly maintained at 70° C. at a transportation speed of 10 mm/sec.

After cooling the sheets while being in contact with each other to room temperature, the coated paper was stripped from the light-sensitive element thereby obtaining a color duplicate. As a result of visual evaluation of the color duplicate using an optical microscope of 200 magnifications, it was clear and neither defect in the toner image areas nor background stain in the non-image areas was observed. Further, strength of the images was sufficiently high and the images did not fall off when they were rubbed.

EXAMPLE B-3

5 g of 4,4'-bis(diethylamino)-2,2'-dimethyltriphenylmethane as an organic photoconductive substance, 5 g of a polyester resin (Vylon 200 manufactured by Toyobo Co., Ltd.), 40 mg of Dye (D-3) having the structure shown below and 0.2 g of Anilide Compound (B) described above as a chemical sensitizer were dissolved in a mixed solvent of 30 ml of methylene chloride and 30 ml of ethylene chloride to prepare a light-sensitive solution.

Dye (D-3)

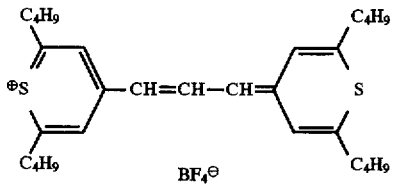

The resulting light-sensitive solution was coated on a conductive transparent substrate composed of a 100 μm thick polyethylene terephthalate film having a deposited layer of indium oxide thereon (surface resistivity: $10^5$ Ω) by a wire round rod to prepare a light-sensitive element having an organic light-sensitive layer having a thickness of about 4 μm.

The adhesive strength of the surface of the thus-obtained electrophotographic light-sensitive element was more than 450 g·f and did not exhibit releasability at all.

The light-sensitive element was installed in an apparatus as shown in FIG. 6, and on the surface thereof was formed a transfer layer in the same manner as in Example B-1 but using Dispersion of Resin Grains (L-103) for electrodeposition shown below.

| Dispersion of Resin Grains (L-103) | |
|---|---|
| Resin Grain (A-37) | 7 g (solid basis) |
| Compound (S-2) | 1.0 g |
| Positive-Charge Control Agent (CD-1) | 0.05 g |
| Branched Octadecyl Alcohol (FOC-1800 manufactured by Nissan Chemical Industries, Ltd.) | 10 g |
| Isopar G (manufactured by Esso Standard Oil Co.) | 1 liter |

Using the resulting light-sensitive material, a color duplicate was prepared in the same manner as in Example B-1 except for charging to +500 V of a surface potential in dark and exposing to light using a He—Ne laser having an oscillation wavelength of 633 nm at an irradiation dose on the surface of light-sensitive material of 30 erg/cm$^2$. The color images obtained on coated paper were clear and free from background stain. Further, strength of the images was sufficiently high and the images did not fall off when they were rubbed.

EXAMPLE B-4

Using the light-sensitive element described in Example A-55, a transfer layer was formed thereon in the same manner as in Example B-3, thereby preparing a full-color duplicate. The color images obtained were clear and free from background stain similar to those in Example B-3. Further, the storage stability of duplicate was good without the occurrence of cutting of image portion and a sufficiently high film-strength was maintained.

EXAMPLE B-5

A mixture of 100 g of photoconductive zinc oxide, 2 g of Binder Resin (B-7) having the structure shown below, 18 g of Binder Resin (B-8) having the structure shown below, 0.01 g of Dye (D-4) having the structure shown below, 0.10 g of N-hydroxysuccinimide and 150 g of toluene was dispersed in a homogenizer (manufactured by Nippon Seiki K.K.) at a rotation of $1\times10^5$ r.p.m. for 5 minutes.

Binder Resin (B-7)

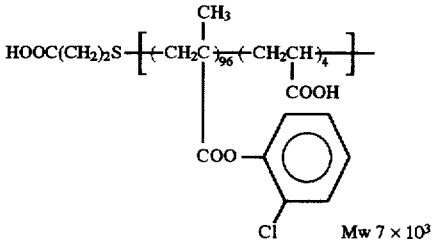

Mw $7\times10^3$

Binder Resin (B-8)

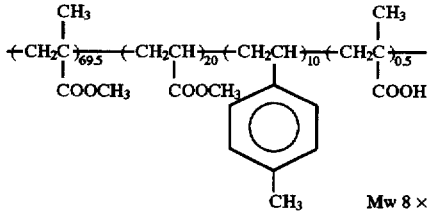

Mw $8\times10^4$

Dye (D-4)

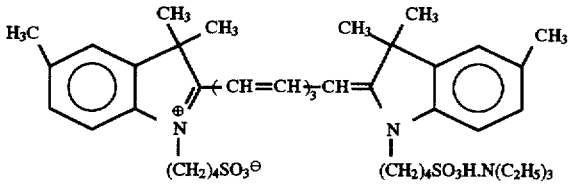

The resulting dispersion was coated on base paper for a paper master having a thickness of 0.2 mm, which had been subjected to electrically conductive treatment and solvent-resistant treatment by a wire bar and heated in a circulating oven at 110° C. for 15 seconds to prepare a light-sensitive layer having a thickness of 12 μm.

On the light-sensitive layer was formed a transfer layer having a thickness of 4 μm in the same manner as in Example B-1 but using Dispersion of Resin Grains (L-104) for electrodeposition shown below. The adhesive strength between the transfer layer and the light-sensitive element was 10 g·f as a result of the test using a pressure sensitive adhesive tape as described above.

| Dispersion of Resin Grains (L-104) | |
|---|---|
| Resin Grain (A-17) | 4 g (solid basis) |
| Resin Grain (A-39) | 2 g (solid basis) |
| Compound (S-27) shown below | 1 g |
| Isopar H | 1 liter |

Compound (S-27)

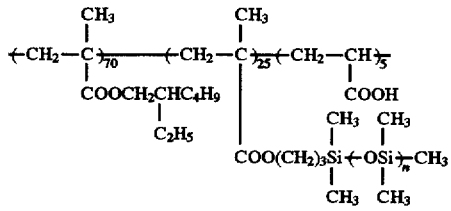

Mw $8\times10^3$ (Mw of graft portion $3\times10^3$)

The resulting light-sensitive material was charged to −550 V with a corona discharge in dark, exposed imagewise with flash exposure using a halogen lamp of 1.6 kW and subjected to normal development using as a liquid developer a color toner for Versateck 3000 used in Example B-2 while applying a bias voltage of 100 V to a developing unit to form color images. The duplicated images formed on the transfer layer were good and clear even in highly accurate image portions such as letters, fine lines and continuous tone areas composed of dots. Also, background stain in the non-image areas was not observed.

The light-sensitive material having the toner images was brought into contact with coated paper and they were passed between a pair of hollow metal rollers covered with silicone rubber each having an infrared lamp heater integrated therein. A surface temperature of each of the rollers was 80° C., a nip pressure between the rollers was 10 kgf/cm$^2$, and a transportation speed was 10 mm/sec.

After cooling the sheets while being in contact with each other to room temperature, the coated paper was separated from the light-sensitive element. The color duplicate thus-obtained had clear images and no stain in the non-image areas. Also, the images had good strength and storage stability.

EXAMPLES B-6 TO B-26

Each color duplicate was prepared in the same manner as in Example B-2 except for using each of the compounds (S) shown in Table M below in place of 0.3 g of Compound (S-26) employed in Dispersion of Resin Grains (L-102) for electrodeposition of Example B-2.

TABLE M

| Example | Compound (S) | Amount (g/l) |
|---|---|---|
| B-6 | (S-5) | 0.5 |
| B-7 | (S-6) | 0.8 |
| B-8 | (S-7) | 0.5 |
| B-9 | (S-8) | 1.0 |
| B-10 | (S-9) | 1.2 |
| B-11 | (S-10) | 0.3 |
| B-12 | (S-11) | 1.5 |
| B-13 | (S-12) | 2.0 |
| B-14 | (S-13) | 0.1 |
| B-15 | (S-14) | 0.5 |
| B-16 | (S-15) | 0.3 |
| B-17 | (S-16) | 1.0 |
| B-18 | (S-17) | 0.5 |
| B-19 | (S-18) | 0.4 |
| B-20 | (S-19) | 0.5 |
| B-21 | (S-20) | 1.0 |
| B-22 | (S-21) | 2.0 |
| B-23 | (S-22) | 2.5 |
| B-24 | (S-23) | 5.0 |
| B-25 | (S-24) | 10 |
| B-26 | (S-25) | 8.0 |

With each of the examples, the transferability of transfer layer was excellent same as in Example B-2 and degradation of toner image due to unevenness in transfer was not observed. Also, image quality of each color duplicate obtained was good same as in Example B-2.

EXAMPLE B-27

An electrophotographic light-sensitive material was formed in the same manner as in Example B-1 except for forming a transfer layer compound of two layers by applying a first transfer layer having a thickness of 2 μm to the surface of X-form metal-free phthalocyanine light-sensitive element using Dispersion of Resin Grains (L-105) for electrodeposition described below and then applying a second transfer layer having a thickness of 2 μm on the first transfer layer using Dispersion of Resin Grains (L-106) for electrodeposition described below in place of the transfer layer using Dispersion of Resin Grains (L-101) for electrodeposition employed in Example B-1.

| Dispersion of Resin Grains (L-105): First Transfer Layer | |
|---|---|
| Resin Grain (A-34) | 6 g (solid basis) |
| Compound (S-1) | 0.5 g |
| Positive-Charge Control Agent (CD-3) | 0.02 g |
| Branched Octadecyl Alcohol (FOC-1800) | 10 g |
| Isopar G | 1 liter |

| Dispersion of Resin Grains (L-106): Second Transfer Layer | |
|---|---|
| Resin Grain (A-45) | 6 g (solid basis) |
| Positive-Charge Control Agent (CD-3) | 0.025 g |
| Branched Octadecyl Alcohol (FOC-1800) | 10 g |
| Isopar G | 1 liter |

Using the resulting light-sensitive material, full-color images were formed on coated paper according to the same procedure as in Example B-1. The color duplicate thus-obtained had clear images free from background stain. Specifically, the toner images formed on the light-sensitive material had excellent image forming property of good image reproducibility and no fog in the non-image areas, and the transfer of toner images together with the transfer layer onto coated paper was completely performed without the formation of unevenness.

Further, the color duplicates obtained were held between various polymer sheets for filing and allowed to pile one on another. As a result, cutting of color images based on peeling of image portions due to adhesion of the color duplicates onto the polymer sheets did not occur. Moreover, retouch and seal were conducted on the color duplicates same as on conventional paper. From these results it can be seen that practically usable ranges are expanded in all aspects of the releasability at an interface between the light-sensitive element and the transfer layer, the adhesion of transfer layer onto the surface of receiving material and the strength of transfer layer covered images on the receiving material by using the transfer layer composed of two layers.

EXAMPLES B-28 TO B-37

Each color duplicate was prepared in the same manner as in Example B-2 except for using each of the dispersion of resin grains for electrodeposition shown below in place of Dispersion of Resin Grains (L-102) for electrodeposition employed in Example B-2.

| Dispersion of Resin Grains for Electrodeposition | |
|---|---|
| Resin Grain shown in Table N below | 6 g (solid basis) |
| Compound (S-28) shown below | 0.5 g |
| Positive-Charge Control Agent (CD-3) | 0.03 g |
| Charge Imparting Aid shown below | 1 g |
| Isopar G | 1 liter |

Compound (S-28)

Silicone surface active agent (SILWet FZ-2166 manufactured by Nippon Unicar Co., Ltd.)

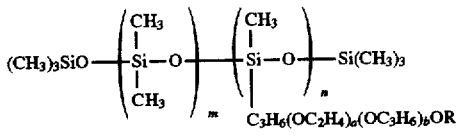

-continued

Charge Imparting Aid

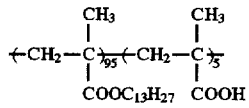

Mw $3 \times 10^4$

TABLE N

| Example | Resin Grain (A) | Weight Ratio |
|---|---|---|
| B-28 | A-11 | — |
| A-29 | A-16/A-40 | 5/5 |
| A-30 | A-18/A-41 | 6/4 |
| A-31 | A-20/A-42 | 7/3 |
| A-32 | A-22/A-43 | 4/6 |
| A-33 | A-25/A-39 | 5/5 |
| A-34 | A-26/A-46 | 8/2 |
| A-35 | A-27/A-49 | 5/5 |
| A-36 | A-32/A-50 | 4/6 |
| A-37 | A-28/A-45 | 4/6 |

Each of the color duplicate thus-obtained had good color images similar to those in Example B-2. Also, the image preservability thereof was excellent.

EXAMPLES B-38 TO B-47

Each color duplicate was prepared in the same manner as in Example B-27 except for using each of the resin grains for the first transfer layer and second transfer layer shown in Table 0 below in place of Resin Grain (A-34) in Dispersion of Resin Grains (L-105) for electrodeposition and Resin Grain (A-45) in Dispersion of Resin Grains (L-106) for electrodeposition used in Example B-27 respectively. The total thickness of the first and second transfer layers was 4.5 μm.

TABLE O

| Example | Resin Grain First Transfer Layer/ Second Transfer Layer | Thickness Ratio First Transfer Layer/ Second Transfer Layer |
|---|---|---|
| A-38 | A-3/A-39 | 6/4 |
| B-39 | A-7/A-45 | 6/4 |
| B-40 | A-12/A-38 | 7/3 |
| B-41 | A-29/A-39 | 5/5 |
| B-42 | A-33/A-41 | 7/3 |
| B-43 | A-36/A-46 | 5/5 |
| B-44 | A-30/A-40 | 6/4 |
| B-45 | A-31/A-39 | 7/3 |
| B-46 | A-27/A-44 | 5/5 |
| B-47 | A-24/A-46 | 6/4 |

The evaluation on various characteristics with each of the color duplicates was conducted in the same manner as in Example B-27. Good results similar to those in Example B-27 were obtained. Specifically, the color duplicates had clear images free from background stain and exhibited good aptitudes for filing, retouching and sealing.

POSSIBILITY OF UTILIZATION IN INDUSTRY

By means of the method and apparatus for forming an electrophotographic color transfer image according to the present invention, color duplicates having images of high accuracy and high quality and excellent in the storage stability can be stably obtained at a low cost.

What is claimed is:

1. A method of forming an electrophotographic color transfer image comprising (i) a step of forming a peelable transfer layer on the surface of an electrophotographic light-sensitive element, (ii) a step of forming at least one color toner image by an electrophotographic process on the transfer layer, and (iii) a step of heat-transferring the toner image together with the transfer layer onto a receiving material, wherein prior to or simultaneously with the formation of the transfer layer a compound (S) which contains a fluorine atom and/or silicon atom is applied to the surface of the electrophotographic light-sensitive element to improve releasability of the surface of the electrophotographic light-sensitive element; wherein steps (i), (ii) and (iii) are in sequence; and wherein the peelable transfer layer is formed by an electrodeposition coating method which is carried out using grains comprising a resin (A) which has a glass transition point of not more than 140° or a softening point of not more than 180°, said grains being supplied between the electrophotographic light-sensitive element and an electrode placed in opposition to the light-sensitive element, and migrate due to electrophoresis according to potential gradient applied from an external power source to adhere to or electrodeposit on the electrophotographic light-sensitive element.

2. A method of forming an electrophotographic color transfer image as claimed in claim 1, wherein after the application of Compound (S), the surface of the electrophotographic light-sensitive element has an adhesive strength of not more than 100 gram·force.

3. A method of forming an electrophotographic color transfer image as claimed in claim 1, wherein the compound (S) is soluble at least 0.01 g in 1.0 liter of an electrically insulating organic solvent having an electric resistance of not less than $10^8$ Ω·cm and a dielectric constant of not more than 3.5.

4. A method of forming an electrophotographic color transfer image as claimed in claim 1, wherein the resin (A) comprises at least one resin (AH) having a glass transition point of from 30° C. to 140° C. or a softening point of from 35° C. to 180° C. and at least one resin (AL) having a glass transition point of from −30° C. to 40° C. or a softening point of from 0° C. to 45° C. in which a difference in the glass transition point or softening point between the resin (AH) and the resin (AL) is at least 2° C.

5. A method of forming an electrophotographic color transfer image as claimed in claim 1, wherein the peelable, transfer layer has a layered structure comprising, from the electrophotographic light-sensitive element side, a layer comprising a resin (AH) and a layer comprising a resin (AL).

6. A method of forming an electrophotographic color transfer image as claimed in claim 1, wherein the step of forming the peelable transfer layer is carried out after the step of applying the compound (S).

7. A method of forming an electrophotographic color transfer image as claimed in claim 1, wherein the step of applying the compound (S) and the step of forming the peelable transfer layer are carried out simultaneously.

8. A method of forming an electrophotographic color transfer image as claimed in claim 7, wherein the peelable transfer layer comprises a resin (A) having a glass transition point of not more than 140° C. or a softening point of not more than 180° C.

9. A method of forming an electrophotographic color transfer image as claimed in claim 8, wherein the step of applying the compound (S) and the step of forming the peelable transfer layer are carried out by an electrodeposition coating method.

10. A method of forming an electrophotographic color transfer image as claimed in claim 9, wherein a dispersion of an electrically insulating organic solvent containing grains of the resin (A) and the compound (S) is used.

11. An apparatus for forming an electrophotographic color transfer image comprising (i) an electrophotographic light-sensitive element, (ii) a means for applying a compound (S) which contains a fluorine atom and/or silicon atom to the surface of electrophotographic light-sensitive element, (iii) a means for forming a peelable transfer layer on the surface of electrophotographic light-sensitive element, wherein said means for forming a peelable transfer layer is an electrodeposition means (iv) a means for forming a toner image by an electrophotographic process on the peelable transfer layer and (v) a means for heat-transferring the toner image together with the transfer layer onto a receiving material, and wherein the electrophotographic light-sensitive element is repeatedly usable.

* * * * *